US007337727B2

(12) United States Patent
Forbes

(10) Patent No.: US 7,337,727 B2
(45) **Date of Patent: *Mar. 4, 2008**

(54) DROPPED DECK CENTER BEAM RAIL ROAD CAR

(75) Inventor: James W. Forbes, Campbellville (CA)

(73) Assignee: National Steel Car Limited, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/192,008

(22) Filed: Jul. 29, 2005

(65) Prior Publication Data

US 2005/0263033 A1 Dec. 1, 2005

Related U.S. Application Data

(60) Division of application No. 10/639,547, filed on Aug. 13, 2003, now Pat. No. 6,962,114, which is a continuation of application No. 10/290,039, filed on Nov. 7, 2002, now Pat. No. 6,920,829, which is a continuation of application No. 09/705,056, filed on Nov. 2, 2000, now abandoned.

(51) Int. Cl.
*B61D 17/00* (2006.01)

(52) U.S. Cl. ..... 105/404; 105/355; 105/416; 105/418

(58) Field of Classification Search ..... 105/404, 105/411, 416, 418, 413, 421, 422, 355; 296/184.1; 410/42; 280/789
See application file for complete search history.

(56) References Cited

U.S. PATENT DOCUMENTS

| | | | | |
|---|---|---|---|---|
| 190,542 | A | | 5/1877 | Brooks |
| 401,528 | A | | 4/1889 | Zurcher |
| 831,648 | A | | 9/1906 | Dodds |
| 831,654 | A | | 9/1906 | Dodds |
| 934,578 | A | | 9/1909 | Stoller |
| 975,861 | A | | 11/1910 | Harrigan |
| 2,061,673 | A | | 11/1936 | Robinson |
| 2,062,948 | A | * | 12/1936 | Swank et al. ..... 410/42 |
| 2,167,427 | A | | 7/1939 | Tatum |
| 2,650,856 | A | | 9/1953 | Mashburn, Jr. et al. |
| 2,710,221 | A | | 6/1955 | Hinners |
| 2,724,611 | A | | 11/1955 | Robertson |
| 2,759,737 | A | | 8/1956 | Manning |

(Continued)

FOREIGN PATENT DOCUMENTS

CA 1265388 2/1990

(Continued)

OTHER PUBLICATIONS

Car Builders' Cyclopedia of American Practice, 14th ed., Simmons-Boardman Publishing Corporation, New York, NY, 1937, pp. 209-214.

(Continued)

*Primary Examiner*—Mark T. Le
(74) *Attorney, Agent, or Firm*—Morrison & Foerster LLP

(57) ABSTRACT

A center beam car has a main deck structure extending laterally from a main center sill, a laterally extending top truss structure, and a central vertically oriented web work structure for carrying vertical shear loads between the top truss and the center sill and decking. The center beam so formed defines bunks upon in which to carry cargo. The upper region of the web-work structure includes a deep upper beam structure that has downwardly extending skirts. The skirts provide an extended bearing area upon against which bundled loads can be secured. The skirts are inwardly reinforced to discourage deflection between adjacent upright members of the deep upper beam structure.

19 Claims, 31 Drawing Sheets

U.S. PATENT DOCUMENTS 2,768,004 A 10/1956 Wagner
2,801,597 A 8/1957 Ecoff
2,803,201 A 8/1957 Johnson et al.
2,810,602 A 10/1957 Abrams
2,839,328 A 6/1958 Pickett et al.
2,851,301 A 9/1958 Jagsch
2,883,945 A 4/1959 Walker
2,904,340 A 9/1959 Simpson
2,940,402 A 6/1960 Hansen et al.
2,996,020 A 8/1961 Udstad
3,009,426 A 11/1961 Nampa
3,028,191 A 4/1962 Magor
3,079,874 A 3/1963 Hansen et al.
3,159,112 A 12/1964 Tomlinson
3,240,168 A 3/1966 Charles et al.
3,244,120 A 4/1966 Taylor
3,357,371 A 12/1967 Gutridge
3,485,184 A 12/1969 Berry
3,509,829 A 5/1970 Henrikson et al.
3,540,384 A * 11/1970 Charles ..... 105/418
3,659,724 A 5/1972 Miller et al.
3,675,592 A 7/1972 Bateson et al.
3,677,193 A 7/1972 Pringle
3,713,400 A 1/1973 Teoli
3,724,394 A 4/1973 Pringle
3,734,031 A 5/1973 Wagner
3,751,102 A 8/1973 Stoneburner
3,774,554 A 11/1973 O'Neill et al.
3,777,671 A 12/1973 Miller et al.
3,779,411 A 12/1973 Moretti, Jr.
3,788,702 A 1/1974 Toboll
3,806,182 A 4/1974 Bateson et al.
3,814,028 A 6/1974 Adler
3,818,843 A 6/1974 Lee
3,820,476 A 6/1974 Harter et al.
3,820,747 A 6/1974 Bateson et al.
3,841,236 A 10/1974 Hammonds et al.
3,885,506 A 5/1975 Mundinger et al.
3,964,399 A 6/1976 Miller et al.
4,024,821 A 5/1977 Yang
4,079,676 A 3/1978 Miller
4,082,045 A 4/1978 McNally et al.
4,091,742 A 5/1978 Cordani
4,092,039 A 5/1978 Lutkenhouse
4,128,062 A 12/1978 Roberts
4,194,451 A 3/1980 Dehner
RE30,388 E 9/1980 Mundinger et al.
4,221,427 A 9/1980 Sentle, Jr. et al.
4,236,459 A 12/1980 Teoli
4,254,714 A 3/1981 Heap
4,331,083 A 5/1982 Landregan et al.
4,348,963 A 9/1982 Dancy
4,361,097 A 11/1982 Jones et al.
4,373,447 A 2/1983 Pfister
4,385,856 A 5/1983 O'Neal
4,408,542 A 10/1983 Heap
4,478,155 A 10/1984 Cena et al.
4,543,887 A 10/1985 Baker
4,569,289 A 2/1986 Gielow et al.
4,580,844 A 4/1986 Farmer
4,626,017 A 12/1986 Robertson
4,633,787 A 1/1987 Przybylinski et al.
4,635,997 A * 1/1987 Holt et al. ..... 296/184.1
4,637,320 A 1/1987 Paton et al.
4,646,653 A 3/1987 Balbi et al.
4,681,041 A 7/1987 Harris et al.
4,686,907 A 8/1987 Woollam et al.
4,688,976 A 8/1987 Rowley et al.
4,690,072 A 9/1987 Wille et al.
4,738,203 A 4/1988 Gielow et al.
4,751,882 A 6/1988 Wheatley et al.
4,753,175 A 6/1988 Harris et al.
4,756,256 A 7/1988 Rains et al.
4,770,578 A 9/1988 Coleman
4,771,705 A 9/1988 Przybylinski et al.
4,771,706 A 9/1988 Lindauer et al.
4,784,067 A 11/1988 Harris et al.
4,802,420 A 2/1989 Butcher et al.
4,805,539 A 2/1989 Ferris et al.
4,806,065 A * 2/1989 Holt et al. ..... 414/481
4,807,722 A 2/1989 Jamrozy et al.
4,876,968 A 10/1989 Lindauer et al.
4,889,055 A 12/1989 Jamrozy et al.
4,901,649 A 2/1990 Fehrenbach et al.
4,911,082 A 3/1990 Richmond
4,944,232 A 7/1990 Schlaeger
4,951,575 A 8/1990 Dominguez et al.
5,024,567 A 6/1991 Dominguez et al.
5,088,417 A 2/1992 Richmond et al.
5,111,753 A 5/1992 Zigler et al.
5,114,169 A * 5/1992 Botkin et al. ..... 280/423.1
5,159,882 A 11/1992 Krug et al.
5,259,322 A 11/1993 Dominguez et al.
5,271,336 A 12/1993 Willetts
5,410,970 A 5/1995 Stephenson, Jr.
5,520,489 A 5/1996 Butcher et al.
5,582,495 A 12/1996 Schroeder
5,626,083 A 5/1997 Saxton
5,692,792 A 12/1997 Klar
5,758,584 A 6/1998 Saxton
5,878,548 A 3/1999 Sauer et al.
5,899,646 A 5/1999 Tatina et al.
5,943,963 A 8/1999 Beals
6,050,202 A 4/2000 Thompson
6,183,176 B1 2/2001 Weiner
6,199,486 B1 3/2001 Landrum et al.
6,237,506 B1 5/2001 Forbes
6,283,700 B1 9/2001 Oltrogge
6,431,085 B1 8/2002 Saxton et al.
6,470,808 B1 * 10/2002 Clark et al. ..... 105/404
6,494,146 B1 12/2002 Landrum et al.
6,523,484 B2 2/2003 Saxton et al.
6,604,470 B1 8/2003 Forbes
6,612,793 B2 9/2003 Forbes
6,647,895 B2 11/2003 Saxton et al.
6,659,017 B2 12/2003 Forbes
6,679,187 B2 1/2004 Dorian et al.
6,685,685 B2 2/2004 Sugita et al.
6,709,207 B1 3/2004 Forbes
6,796,758 B2 9/2004 Coslovi et al.
6,920,829 B2 * 7/2005 Forbes et al. ..... 105/355
6,983,702 B2 1/2006 Forbes
7,025,003 B2 4/2006 Khattab et al.
7,044,062 B2 * 5/2006 Forbes ..... 105/355
2002/0124766 A1 9/2002 Forbes
2004/0234353 A1 11/2004 Forbes
2005/0045060 A1 3/2005 Forbes
2005/0117990 A1 6/2005 Coslovi et al.
2005/0263033 A1 12/2005 Forbes

FOREIGN PATENT DOCUMENTS

CA 2313834 A1 1/2002
EP 0306584 3/1989
NL 37659 1/1933

OTHER PUBLICATIONS

Car Builders' Cyclopedia of American Practice, 18th ed., Simmons-Boardman Publishing Corporation, New York, NY, 1949-51, pp. 155.

Car Builders' Cyclopedia of American Practice, 19th ed., Simmons-Boardman Publishing Corporation, New York, NY, 1953, pp. 284-285.

Railway Age Weekly, Simmons-Boardman Publishing Corporation, Boston, Conn., Jan. 5, 1959, pp. 19, 22 & 23.
Car Builders' Cyclopedia of American Practice, 21st ed., Simmons-Boardman Publishing Corporation, New York, NY, 1961, pp. 168-172, 447-448.
Blodgett, Orner W. (1966) "Rigid-Frame Knees (Elastic Design)" in Design of Welded Structures, James F. Lincoln Arc Welding Foundation, pp. 5.11-1 to 5.11-20.
Railway Age Weekly, Simmons-Boardman Publishing Corporation, Boston, Conn., Mar. 20, 1967, pp. 15.
Railway Age Weekly, Simmons-Boardman Publishing Corporation, Boston, Conn., Dec. 18, 1967, pp. 58.
Railway Age Weekly, Simmons-Boardman Publishing Corporation, Boston, Conn., Feb. 19, 1968.
Railway Age Weekly, Simmons-Boardman Publishing Corporation, Boston, Conn., Apr. 28, 1969.
Car and Locomotive Cyclopedia of American Practice, 2nd ed., Simmons-Boardman Publishing Corporation, New York, NY, 1970, pp. 287-289 and p. 126.
Car and Locomotive Cyclopedia of American Practice, 3rd ed., Simmons-Boardman Publishing Corporation, New York, NY, 1974, pp. S3-165 and S3-173 to S3-176.
Car and Locomotive Cyclopedia of American Practice, 4th ed., Simmons-Boardman Publishing Corporation, Omaha, NE, 1980, pp. 73, 76, 242-243, 256.
Car and Locomotive Cyclopedia of American Practice, 5th ed., Simmons-Boardman Publishing Corporation, Omaha, NE, 1984, pp. 169.
Various photographs showing a dropped deck center beam car bearing model No. THRX 3001 manufactured by Thrall (date and location unknown).
Photograph showing a flatcar bearing model No. BCOL 866688 (date and location unknown).
Various photographs showing a center beam car bearing model No. BNSF 564124 (date and location unknown).
Illustration showing a model of a car built for Pulpwood Service in 1963.
Various photographs taken on Sep. 19, 2000, Chicago, IL, showing a dropped deck center beam car bearing model No. THRX 3001 manufactured by Thrall.
Various photographs taken on Sep. 27, 2000, Campbellville, Ontario Canada showing a flatcar bearing model No. CN 602376.
Various photographs taken on Sep. 27, 2000, Milton, Ontario Canada showing a flatcar bearing model No. BCOL 52098.
U.S. Appl. No. 09/705,056, Forbes.
U.S. Appl. No. 11/202,397, no date, Forbes.
U.S. Appl. No. 11/202,398, no date, Forbes.
U.S. Appl. No. 11/349,047, no date, Khattab.

* cited by examiner

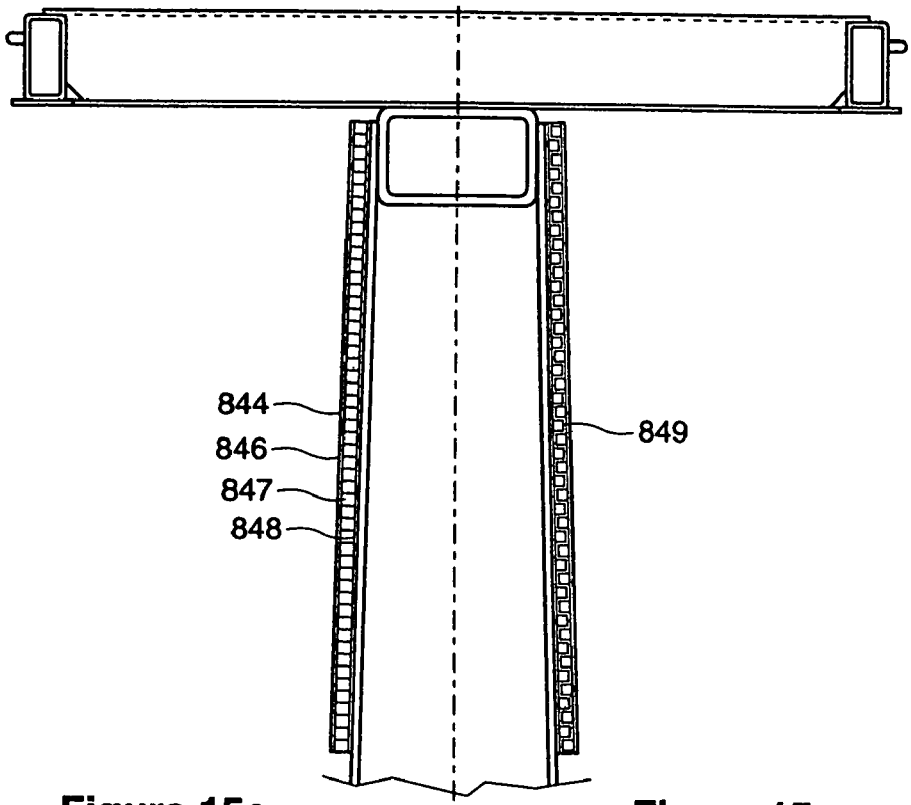
Figure 15c
Figure 15e
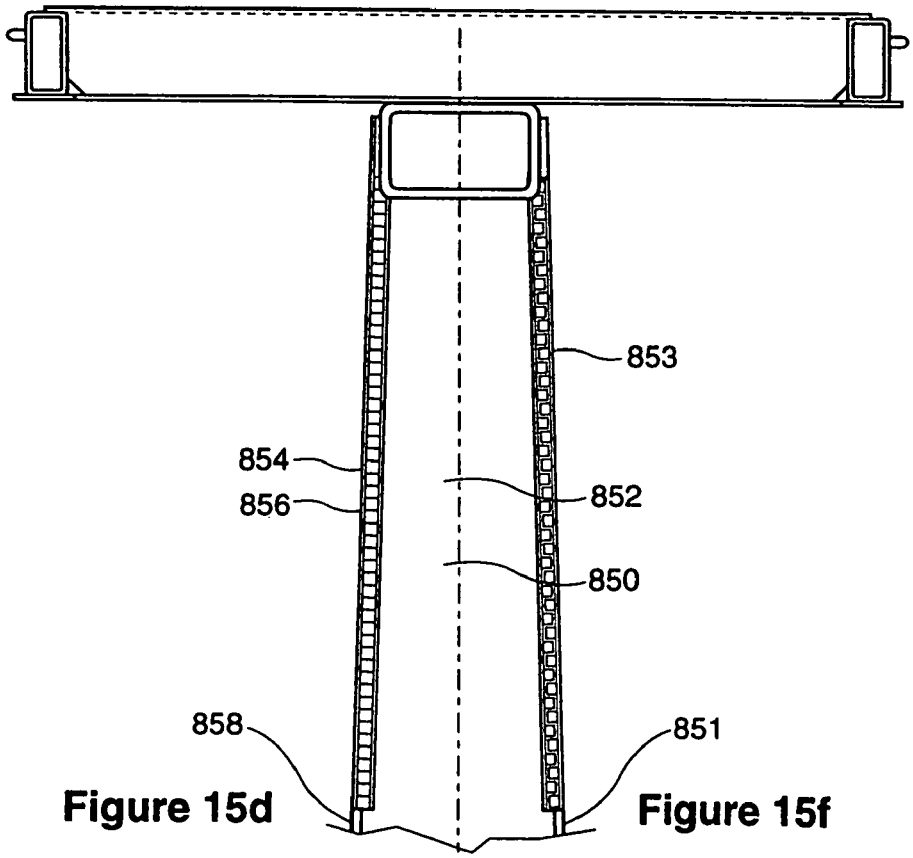
Figure 15d
Figure 15f

DROPPED DECK CENTER BEAM RAIL ROAD CAR

This application is a division of Ser. No. 10/639,547, filed Aug. 13, 2003, now U.S. Pat. No. 6,962,114, which is a continuation of Ser. No. 10/290,039, filed Nov. 7, 2002, now U.S. Pat. No. 6,920,829, which is a continuation of Ser. No. 09/705,056, filed Nov. 2, 2000, now abandoned.

FIELD OF THE INVENTION

This invention relates generally to center beam rail road cars, and, in particular, to center beam cars having a depressed deck portion between a pair of rail car trucks.

BACKGROUND OF THE INVENTION

Center beam rail road cars, in cross-section, generally have a rack-like body, namely a center beam structure in the shape of an I in which the top flange is narrower than the bottom flange. The center beam structure is carried on a pair of rail car trucks. The rack, or center beam structure, has a pair of bulkheads at either longitudinal end that extend transversely to the rolling direction of the car. The lading supporting structure of the beam includes laterally extending decking mounted above, and spanning the space between, the trucks. A center beam web structure, typically in the nature of an open frame truss for carrying vertical shear loads, stands upright from the deck and runs along the longitudinal centerline of the car between the end bulkheads. This kind of webwork structure can be constructed from an array of parallel uprights and appropriate diagonal bracing. Most often, a top truss assembly is mounted on top of the vertical web and extends laterally to either side of the centerline of the car. The top truss is part of an upper beam assembly, (that is, the upper or top flange end of the center beam) and is usually manufactured as a wide flange, or wide flange-simulating truss, both to co-operate with the center sill to resist vertical bending, and also to resist bending due to horizontal loading of the car while travelling on a curve. Typically, a center sill extends the length of the car. The center beam thus formed is conceptually a deep girder beam whose bottom flange is the center sill, and whose top flange is the top truss (or analogous structure) of the car.

Center beam cars are commonly used to transport packaged bundles of lumber, although other loads such as pipe, steel, engineered wood products, or other goods can also be carried. The space above the decking and below the lateral wings of the top truss on each side of the vertical web of the center beam forms left and right bunks upon which bundles of wood can be loaded. The base of the bunk generally includes risers that are mounted to slant inward, and the vertical web of the center beam is generally tapered from bottom to top, such that when the bundles are stacked, the overall stack leans inward toward the longitudinal centerline of the car.

Lading is most typically secured in place using straps or cables. Generally, the straps extend from a winch device mounted at deck level, upward outside the bundles, to a top fitting. The top fitting can be located at one of several intermediate heights for partially loaded cars. Most typically, the cars are fully loaded and the strap terminates at a fitting mounted to the outboard wing of the upper beam assembly. Inasmuch as the upper beam assembly is narrower than the bundles, when the strap is drawn taut by tightening the winch, it binds on the upper outer corner of the topmost bundle and exerts a force inwardly and downwardly, tending thereby to hold the stack in place tight against the center beam web.

Each bundle typically contains a number of pieces of lumber, commonly the nominal 2"×4", 2"×6", 2"×8" or other standard size. The lengths of the bundles vary, typically to ranging from 8' to 24', in 2' increments. The most common bundle size is nominally 32 inches deep by 49 inches wide, although 24 inch deep bundles are also used, and 16 inch deep bundles can be used, although these latter are generally less common. A 32 inch nominal bundle may contain stacks of 21 boards, each 1-½ inch thick, making 31-½ inches, and may include a further 1-½ inches of dunnage for a total of 33 inches. The bundles are loaded such that the longitudinal axes of the boards are parallel to the longitudinal, or rolling, axis of the car generally. The bundles are often wrapped in a plastic sheeting to provide some protection from rain and snow, and also to discourage embedment of abrasive materials such as sand, in the boards. The bundles are stacked on the car bunks with the dunnage located between the bundles such that a fork-lift can be used for loading and unloading. For bundles of kiln dried softwood lumber the loading density is taken as 1600 to 2000 Lbs. per 1000 board-feet.

It has been observed that when the straps are tightened, the innermost, uppermost boards of the topmost bundle bear the greatest portion of the lateral reaction force against the center beam due to the tension in the straps or cables. It has also been observed that when these bundles bear against the vertical posts of the center beam, the force is borne over only a small area. As the car travels, it is subject to vibration and longitudinal inertia loads. Consequently the plastic sheeting may tend to be torn or damaged in the vicinity of the vertical posts, and the innermost, uppermost boards can be damaged. The physical damage to these boards may tend to make them less readily saleable. Further, whether or not the boards are damaged, if the plastic is ripped, moisture can collect inside the sheeting. This may lead to the growth of molds, and may cause discolouration of the boards. In some markets the aesthetic appearance of the wood is critical to its saleability, and it would be advantageous to avoid this discolouration.

In part, the difficulty arises because the bearing area may be too small. Further, the join between the upstanding web portion of the center beam and the upper beam assembly can coincide with the height of the topmost boards. This join is not always smooth. Further still, when the posts are fabricated the flanges may not stand perfectly perpendicular to the web, such that one edge of the flange may bear harder against the bundles than another.

It is also desirable that the bundles stack squarely one upon another. Although it is possible to use wooden battens at the top end of the center beam web, this will tend to cause the top bundle to sit outwardly of its neighbours. It has been observed that a thin wooden batten, of ¾" thickness may tend to bow inwardly between adjacent posts, and may not spread the wear load as much as may be desired. A 1-½ inch thick wooden batten may have a greater ability to resist this bowing effect. However, the space available for employing a batten may tend to be limited by the design envelope of the car. Inasmuch as is advantageous to load the car as fully as possible, and given that the design of the car may usually reflect a desire to maximize loading within the permissible operational envelope according to the applicable AAR standard, the use of a relatively thick wooden batten may tend to push the outside edge of the top bundle outside the permissible operational envelope. Wooden battens may also be prone to rotting if subject to excessive exposure to moisture, or may be consumable wear items that may require relatively frequent periodic replacement.

It would be desirable to have an upper beam assembly that is integrated into the structure, that is formed to spread the bearing load across a larger area, that would tend to resist the bowing phenomenon, that would tend not to require frequent replacement, and that would tend not to be prone to rotting.

Existing center beam cars tend to have been made to fall within the car design envelope, or outline, of the American Association of Railroads standard AAR Plate C, and tend to have a flat main deck that runs at the level of the top of the main bolsters at either end of the car. In U.S. Pat. No. 4,951,575, of Dominguez et al., issued Aug. 28, 1990, a center beam car is shown that falls within the design envelope of plate C, and also has a depressed center deck between the car trucks. It would be advantageous to be able to operate center beam cars that exceed Plate C and fall within AAR Plate F, with a full load of lumber in bundles stacked 5 bundles high. A five bundle high load of 33 inch bundles requires a vertical clearance in the left and right hand bunks of at least 165 inches. This significantly exceeds the vertical loading envelope of a plate C car.

Increased vertical loading to exceed Plate C, as in a Plate F car, may tend also to increase the height of the center of gravity of a loaded car above the allowable vertical center of gravity height limit of 98 inches measured from top-of-rail (TOR). Consequently it may be desired to drop the center portion of the deck further to once again lower the center of gravity. However, as the deck is dropped further, the deck must also become narrower to remain within the AAR design envelope, whether of Plate C or Plate F. Further still, when the truck centers of the car exceed 46 ft. 3 in., the mid-span car width must be reduced due to swing out as the car travels through corners. That is, the car must lie within the design envelope of a 10'-8" wide car with 46'-3" truck centers, on a 13° curve (equivalent to a track center radius of 441.7 ft.). For a car having a nominal length of 73 ft, and a 56 ft well, will probably have a distance between truck centers of the order of 67 or 68 ft. The allowance for swing out, (that is, the reduction in width to match a car having 46'-3" truck centers), for such a car is significant.

As the allowable car width becomes narrower, either due to increasing the truck centers beyond 46 ft. 3 in., or due to lowering the height of the decking, it is highly desirable to retain as much of the remaining lateral width as possible to support the bundles. Moreover, it has become desirable to provide a bunk width sufficient to carry 51 inch wide bundles, as well as 49 inch wide bundles. In the past, as shown in U.S. Pat. No. 4,951,575 winches have been installed outboard of the side sills at longitudinal stations corresponding to the longitudinal stations of the outboard ends of the cross bearers. These winches are used to cinch the strapping that is used to secure the load to the center beam top compression member wings, or, in the case of a partially loaded car, to the center beam main vertical web assembly. The winches tend to extend further laterally outboard, relative to the longitudinal centerline, than any other part of the car. Given the inwardly angled profile of the lower portions of the Plate C and Plate F envelopes, each incremental decrease in overall car width measured from the centerline to the outboard extremity of the winch permits an incremental lowering of the loaded center of gravity of the car. Consequently, it is advantageous to make the winch mounting as laterally compact as possible.

In known center beam cars, such as those shown in U.S. Pat. No. 4,951,575 and in U.S. Pat. No. 4,802,420 of Butcher et al., issued Feb. 7, 1989, the deck structure of the cars has included inwardly tapering risers mounted above the cross bearers, with longitudinally extending side sills running along the ends of the cross-bearers. The side sills have been angle or channel sections. In U.S. Pat. No. 4,951,575 the side sills are z-sections with the upper leg of the Z extending outward, the lower leg extending inward, and the web between the two legs running vertically. In U.S. Pat. No. 4,802,420 of Butcher et al., the side sill is a channel section, with the legs extending laterally outward and the web, being the back of the channel, extending vertically between the two legs. In both cases the winch is mounted outward of the vertical web.

In center beam cars it is desirable that the main center sill be aligned with the couplers to reduce or avoid eccentric draft or buff loads from being transmitted. In dealing with lateral loads, the side sills act as opposed flanges of a beam. The loads in the side sills, whether in tension, compression, vertical shear or lateral bending, tend to be transferred to the main sill through a main bolster assembly at each end of the car. In general the bolster is located at a level corresponding to the height of the main sill, and the shear plate, if one is used, is typically at a level corresponding to the level of the upper flange of the main sill.

It is desirable to have a well deck, also called a depressed center deck or dropped deck, between the trucks, to increase the load that can be carried, and so to increase the overall ratio of loaded weight to empty weight of the car, and also to reduce the height of the center of gravity of the car when loaded, as compared to a car having a flat, straight-through deck from end to end carrying the same load. In the case of a well deck, compression and tension loads in the side sills must be carried from the level of the side sills in the well, to the level of the side sills over the trucks, and then through the bolster structure and into the main sill. The transmission of forces through the vertical distance of the eccentricity of the rise in the side sills from the well to the bolster results in the generation of a moment. When the side sill has a knee at the transition from the well to the end structure of the car, the height of the knee defines the arm of the moment. It is advantageous not to create an unnecessarily large moment couple, and hence to keep the knee height small.

The coupler height of rail road cars is 34-½" above top of rail (TOR). This is a standard height to permit interchangeable use of various types of rail cars. The main sill, or stub sill if used, tends to have a hollow box or channel section, the hollow acting as a socket into which the coupler is mounted. The minimum height of the main sill at the trucks (or stub sill, if one is used) and end structure bolsters tends to be determined by the coupler height, and the height required to clear the wheels. The height of the well deck is limited by the design envelope, be it Plate C, Plate F, or some other. In general, however, the height of the shear plate, or top flange of the bolster, to the well decking is less than the desired 33 inch bundle height. It is desirable for the top of the first layer of bundles stacked in the well to be at a height that permits the next layer of bundles to match the height of bundles stacked over the trucks. Consequently it would be advantageous to have a false deck, or staging, mounted above the shear plate, or if there is no end structure shear plate, then above the bolster, at a level to match the level of the top of the bundles carried in the well between the trucks.

One way to reduce the stress concentration at the knee is to make the side sill section of the end portion of the sill deeper. Another way to reduce the stress concentration at the knee is to make the knee member wider. On the longitudinally inwardly facing side of the knee (that is, the side oriented toward the lading in the well) the flange of the vertical leg of the knee may tend to extend perpendicularly. On the longitudinally outboard side, that is, the side facing the truck, the longitudinally outboard flange can be angled, or swept, resulting in a tapering leg, rather than one with parallel flanges. An increase in the section width, due to tapering the longitudinally outboard flange is desirable, as it permits a reduction in the stress concentration in the side sill assembly at the knee, and tends to provide greater truck clearance.

It may also be desirable or advantageous to be able to adjust the height of the structure over the bolster under circumstances where loads other than 33 inch bundles of lumber are carried, either by raising or lowering the staging to a different height, or lowering or removing it altogether such that the load is borne through the bolster and shear plate structure.

SUMMARY OF THE INVENTION

In an aspect of the invention there is a center beam railroad car having a longitudinal centerline. The railroad car is supported by rail car trucks at either end thereof. The railroad car comprises a cargo support structure borne between the trucks, upon which cargo can be carried. There is a web work assembly including an array of posts mounted along the longitudinal centerline of the rail road car. The array extends upwardly of the cargo support structure, and the array is braced longitudinally. An upper beam assembly surmounts the web work assembly. The upper beam assembly has cantilevered wings extending laterally of the longitudinal centerline. The railroad car has a load limit height defined at a level measured upwardly from the cargo support structure, and has a nominal load height that is equal to the largest integer multiple of 33 inches that is less than the load limit height. The web work assembly has at least one skirt member mounted thereto to define a longitudinally extending face against which loads placed laterally outward thereof can bear. The skirt member extends from a first height that is at least as high as the nominal load height to a second height that is at least as low as a height that is six inches below the nominal load height.

In another aspect of the invention there is a center beam car having a longitudinal centerline. The center beam car is supported by rail car trucks at either end thereof. The center beam rail car has a center sill extending between the trucks. There is a decking structure extending laterally of the center sill upon which loads can be placed. An open truss structure extends upwardly from the center sill. An upper beam assembly is mounted upon the open truss structure. The upper beam structure includes laterally extending wing portions and a vertical stem portion. The stem portion is mounted to the open truss structure at a joining interface, and the laterally extending wing portions are mounted to the stem. The stem includes a pair of longitudinally extending, laterally spaced apart, skirt members. The skirt members each have an outwardly facing surface against which cargo placed laterally outboard thereof can bear. The center beam car has an upper load limit height defined at a level between the decking structure and the laterally extending wings. The skirts are located to overlap the load limit height. The outside lateral dimension of the stem matches the overall outside dimension of the open truss structure at the joining interface.

In another aspect of the invention there is a center beam car having a longitudinal centerline. The center beam car is supported by rail car trucks at either end thereof. The center beam railroad car has a center sill extending between the trucks, a decking structure extending laterally of the center sill upon which loads can be placed, an open truss structure extending upwardly from the center sill and an upper beam assembly mounted upon the open truss structure. The upper beam structure includes laterally extending wing portions. The open truss structure has a pair of longitudinally extending, laterally spaced apart, skirt members mounted thereto. The skirt members each have an outwardly facing surface against which cargo placed laterally outboard thereof can bear. The center beam car has an upper load limit height defined at a level between the decking structure and the laterally extending wings. The skirts are located to overlap the load Limit height. The skirts have at least one reinforcement mounted laterally inboard thereof to discourage lateral deflection of the faces when cargo placed laterally outward thereof bears against the skirts.

In a further aspect of the invention, there is a rail road car having a longitudinal centerline. It comprises a pair of rail car trucks and a center beam assembly carried thereupon. The center beam assembly has a lower flange assembly, an upper flange assembly, and a web assembly extending between the upper and lower flange assemblies. The web assembly has a plurality of upwardly extending posts. The posts have a lower region and an upper region. The web assembly has a non-consumable skirt mounted to the upper region of the posts. The skirt presents a bearing surface. The bearing surface faces laterally outward relative to the longitudinal centerline of said rail road car. Cargo can bear against the bearing surface.

In another aspect of the invention there is a center beam rail road car having a center beam car body mounted on a pair of first and second spaced apart rail car trucks. The body has a deck structure and a central vertical web assembly running along the car. The vertical web assembly extends upwardly of the deck structure. A top truss assembly surmounts the vertical web assembly. The deck structure includes first and second end decking portions mounted over the respective first and second trucks, and a medial decking portion lying between the trucks. The medial decking portion is stepped downward relative to the first and second end decking portions. The top truss assembly is mounted at a height exceeding AAR Plate C.

In an additional feature, the body has a bunk defined between the deck structure and the top truss. The bunk has a loading height measured between the medial decking to portion and the top truss that is at least 165 inches. In another additional feature, the car has a center sill. The deck structure is supported thereby. The web assembly includes an array of posts extending upwardly from the main sill and has an upper region adjacent to the top truss and a lower region adjacent to the decking structure. The upper region of the web assembly has at least one longitudinally extending skirt against which lading can be placed.

In still another additional feature, the car has a center sill. The deck structure is supported thereby. The web assembly includes an array of posts extending upwardly from the main sill and has a lower region adjacent to the decking structure and an upper region distant therefrom. The car has an upper beam assembly. The upper beam assembly includes the top truss and a beam stem. The top truss is mounted upon the beam stem and the beam stem is mounted to the upper region of the web assembly. The beam stem includes at least one longitudinally extending skirt against which lading can be placed.

In yet another additional feature, the medial decking portion lying between the two trucks is at least 28'-0" long.

In a further additional feature, the medial decking portion lying between the two trucks is at least 40'-0" long.

In another additional feature, the end decking portions and the medial decking portion each have a load bearing interface, and the load bearing interface of the end decking portions is stepped upwardly relative to the load bearing interface of the medial decking portion a distance of at least 30 inches. In still another additional feature, at least one of the end decking portions has staging mounted thereon to define a load bearing interface spaced upwardly of at least one end decking portion. In yet another additional feature, the staging is moveable to a storage position. In an additional feature, the car has a pair of side sills extending along the deck structure. The side sills each have a medial side sill portion mounted to the medial decking portion. The medial side sill portion has a first depth of section. The side sills each have end side sill portions mounted to the end decking structures. The end side sill portions have a second depth of section. The first depth of section is less than the second depth of section.

In still another additional feature, the end decking portions include lading support structure mounted thereon defining an end section lading interface. The end section lading interface lies at a height greater than 42 inches above top of rail. In yet another additional feature, the car has a pair of side sills extending along the deck structure. The side sills each have a medial side sill portion mounted to the medial decking portion. The medial side sill portion has a first depth of section. The side sills each have end side sill portions mounted to the end decking structures. The end side sill portions have a second depth of section. The first depth of section is less than the second depth of section.

In still yet another additional feature, the car has a pair of side sills extending along the deck structure. The side sills each have a side sill medial portion mounted to the medial decking portion. The medial side sill portion has a first depth of section. The side sills each have side sill end portions mounted to the end decking structures. The end side sill portions have a second depth of section. Each of the side sills has a knee joining the side sill medial portion to each of the side sill end portions. Each knee has a longitudinally inboard flange, a longitudinally outboard flange, and webbing extending therebetween. The longitudinally outboard flange has a lower extremity and an upper extremity. The lower extremity lies at a longitudinally inboard station relative to the upper extremity.

In another additional feature, the car has a pair of side sills extending along the deck structure. The side sills each have a medial side sill portion mounted to the medial decking portion. The side sills each have end side sill portions mounted to the end decking structures. The medial side sill portion has a medial portion side sill web extending from a first edge to a second edge. The first edge lies at a greater height than the second edge, and the first edge lies a further distance transversely outboard than the second edge. In yet another additional feature, the medial decking portion has at least one lading securement apparatus mounted to the medial portion side sill web.

In another aspect of the invention, there is a center beam rail road car having a longitudinal centerline and a pair of ends. The rail road car is supported by rail car trucks at either end thereof. The rail road car has a cargo support structure borne between the trucks, upon which cargo can be carried. The cargo support structure includes a pair of first and second end structures each mounted over a respective one of the trucks, and a medial structure mounted between the trucks. The medial structure is stepped downwardly relative to the end structures. A web assembly includes an array of spaced apart posts mounted at intervals along the longitudinal centerline of the rail road car. The array extends upwardly of the cargo support structure. An upper beam assembly surmounts the web assembly. The upper beam assembly has cantilevered wings extending laterally of the longitudinal centerline. The railroad car has a load limit height defined at a level measured upwardly from the medial structure, and having a nominal load height that is at least as great as the largest integer multiple of 33 inches that is less than the load limit height. The web assembly has at least one skirt member against which loads placed laterally outward thereof can bear. The skirt member extends between a first height and a second height straddling the nominal load height.

In an additional feature of this aspect of the invention, the skirt extends a longitudinal distance corresponding to at least one of the intervals. In another additional feature, the first height is at least as great as the load limit height, and the second height is at least 6 inches below the nominal load height.

In another aspect of the invention, there is a center beam rail road car having a center beam car body mounted on a pair of first and second spaced apart rail car trucks. The body has a deck structure and a central vertical web assembly running along the car. The vertical web assembly extends upwardly of the deck structure. A top truss assembly surmounts the vertical web assembly. The deck structure includes first and second end decking portions mounted over the respective first and second trucks. The first and second end decking portions have structural members presenting respective first and second end portion load bearing interfaces, and a medial decking portion lying between the trucks. The medial decking portion has at least one member presenting a medial load bearing interface. The medial load bearing interface is stepped downward relative to the first portion load bearing interface through a step distance. The step distance is greater than 30 inches.

In another aspect of the invention, there is a center beam rail road car having a center beam car body mounted on a pair of first and second spaced apart rail car trucks. The body has a deck structure and a central vertical web assembly running along the car between the ends. The vertical web assembly extends upwardly of the deck structure. A top truss assembly surmounts the vertical web assembly. The deck structure includes first and second end decking portions mounted over the respective first and second trucks and a medial decking portion lying between the trucks. The medial decking portion is stepped downward relative to the first and second end decking portions. At least one of the first and second end deck portions has staging mounted thereupon. The staging has a load support member spaced upwardly of at least one first and second end deck portions.

In another aspect of the invention there is a center beam rail road car having a center beam car body mounted on a pair of first and second spaced apart rail car trucks. The body has a deck structure and a central vertical web assembly running along the car between the ends. The vertical web assembly extends upwardly of the deck structure. A top truss assembly surmounts the vertical web assembly. The deck structure includes first and second end decking portions mounted over the respective first and second trucks. A medial decking portion lies between the trucks. The medial decking portion is stepped downwardly relative to the first and second end decking portions. The deck structure has laterally outboard side sills running therealong. Each of the side sills has first and second end decking side sill portions mounted to respective ones of the first and second end decks, and a medial side sill portion mounted to the medial deck portion. The medial deck portion is joined to the end deck portions by knee braces. Each of the knee braces has a longitudinally inboard flange adjacent to the medial portion. The inboard flange extends vertically and each of the knee braces has a longitudinally outboard flange. The longitudinally outboard flange extends from a lower portion thereof lying at a first height relative to top of rail, to an upper portion thereof lying at a second, greater, height relative to top of rail. The upper portion lies further from the longitudinally inboard flange than the lower portion.

In another aspect of the invention, there is a center beam rail road car having a center beam car body mounted on a pair of first and second spaced apart rail car trucks. The body has a deck structure and a central vertical web assembly running along the car. The vertical web assembly extends upwardly of the deck structure. A top truss assembly surmounts the vertical web assembly. The deck structure includes first and second end decking portions mounted over the respective first and second trucks, and a medial decking portion lying between the trucks. The medial decking portion is stepped downward relative to the first and second end decking portions. The medial decking portion has a pair of medial decking side sills mounted therealong. Each of the side sills has a web. The web has an upper edge and a lower edge. The upper edge lies further outboard than the lower edge. In an additional feature, the medial decking side sill has a load securing device mounted transversely outboard thereof.

In another additional feature, at least one of the end decking portions has an end decking side sill. The end decking side sill has a web. The end decking side sill web has an upper edge and a lower edge, and the upper edge of the end decking side sill web lies further outboard than the inner edge thereof.

In another additional feature, the medial decking side sill portion is inclined at a first angle relative to the vertical, and the end decking side sill web is inclined at a second angle relative to the vertical. The first angle is greater than the second angle. In still another additional feature, the end decking side sill web has a load securing device mounted transversely outboard thereof.

In another aspect of the invention, there is a center beam rail road car having a center beam car body mounted on a pair of first and second spaced apart rail car trucks. The body has a deck structure and a vertical web assembly running along the car. The vertical web assembly extends upwardly of the deck structure. A top truss assembly surmounts the vertical web assembly. The deck structure includes first and second end decking portions mounted over the respective first and second trucks, and a medial decking portion lies between the trucks. The medial decking portion is stepped downward relative to the first and second end decking portions. The medial decking portion has a pair of medial decking side sills mounted therealong. At least one of the end decking portions has a pair of end decking side sills mounted therealong. The end decking side sills have a greater depth of section than the medial decking side sills.

In another aspect of the invention, there is a center beam rail road car having a center beam car body mounted on a pair of first and second spaced apart rail car trucks. The body has a center sill and a deck structure extending outboard of the center sill. A vertical web assembly runs along the car. The vertical web assembly extends upwardly of the center sill structure. A top truss assembly surmounts the vertical web assembly. The top truss lies at a height exceeding AAR Plate C. The deck structure includes first and second end decking portions mounted over the respective first and second trucks. A medial decking portion lies between the trucks. The medial decking portion is stepped downward relative to the first and second end decking portions. At least one of the end decking portions has a cargo support interface lying at a level greater than 42 inches above top of rail.

In another aspect of the invention, there is a center beam rail road car having a center beam car body mounted on a pair of first and second spaced apart rail car trucks. The body has a center sill having an upper flange and a lower flange. A deck structure extends outboard of the center sill. A vertical web assembly runs along the car. The vertical web assembly extends upwardly of the center sill structure. A top truss assembly surmounts the vertical web assembly. The top truss lies at a height exceeding AAR Plate C. The deck structure includes first and second end decking portions mounted over the respective first and second trucks, and a medial decking portion lying between the trucks. The medial decking portion is stepped downward relative to the first and second end decking portions. At least one of the end decking portions has a cargo support interface lying at a greater height than the upper flange of the center sill.

BRIEF DESCRIPTION OF THE DRAWINGS

FIG. 15*c* shows an alternate detail to that of FIG. 15*a;*

FIG. 15*d* shows an alternate detail to that of FIG. 15*c;*

FIG. 15*e* shows an alternate detail to that of FIG. 15*c;*

FIG. 15*f* shows an alternate detail to that of FIG. 15*d;*

DETAILED DESCRIPTION OF THE PREFERRED EMBODIMENT

Figure 1:
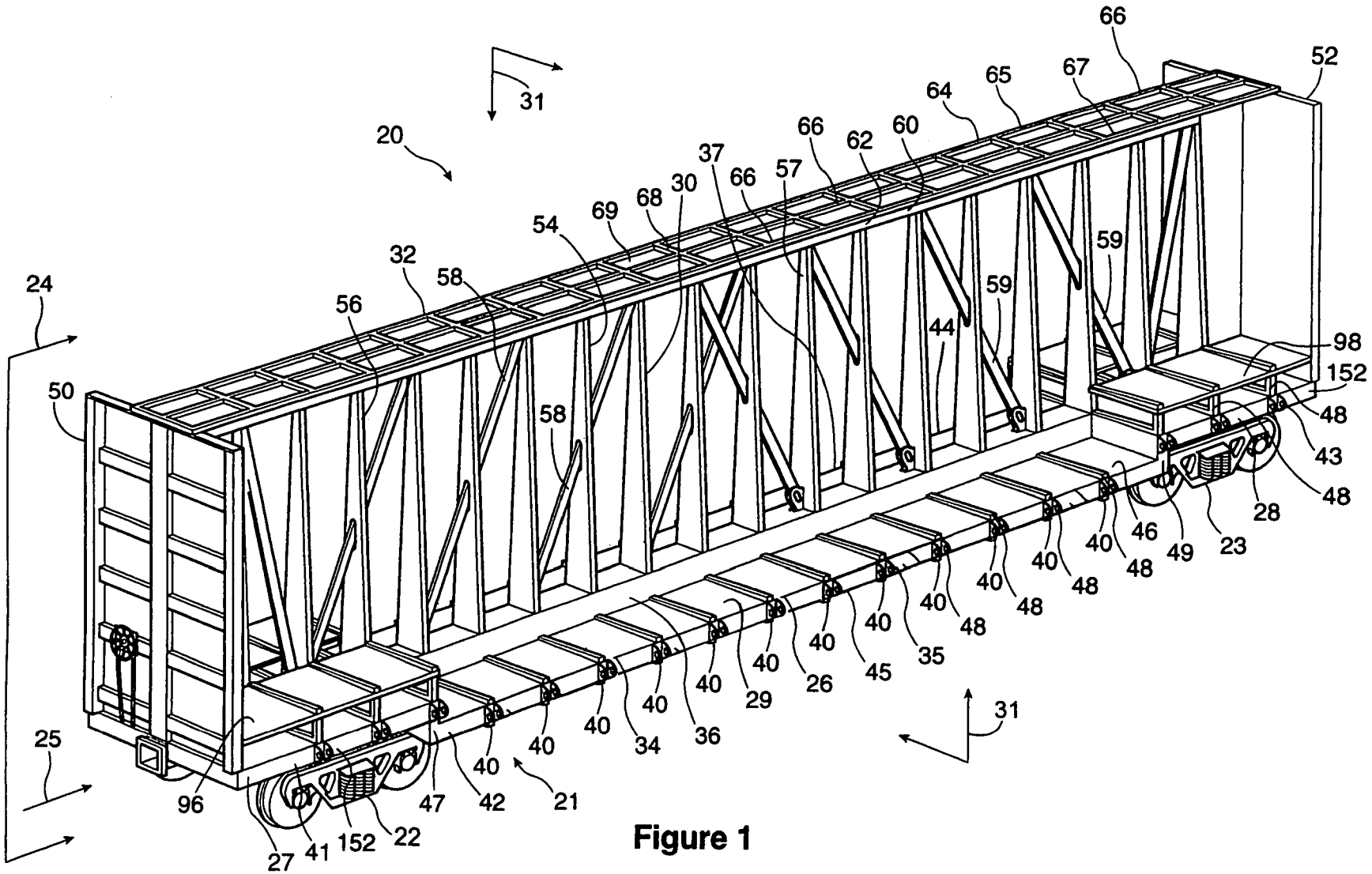
FIG. 1 shows an isometric, general arrangement view of a center beam rail road car having a depressed center deck.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

A center beam railroad car is indicated in FIG. 1 generally as 20. It has a center beam rail road car body 21 carried on a pair of longitudinally spaced apart railroad car trucks 22 and 23 and operable to roll in a rolling, direction along rails in the generally understood manner of rail cars. Car 20 has a longitudinal centerline 25 lying at the center of the coupler height and in a longitudinal plane of symmetry, indicated generally as 24, which intersects the kingpin connections of trucks 22 and 23. Car 20 has a deck structure 26 that has end deck portions 27, 28 and a medial deck portion 29, carried between the trucks at a height, relative to the top of rail (TOR) that is lower than the height of the end deck portions 27, 28. The structure of a center beam car is analogous to a deep beam having a tall central structure to approximate the web of a beam, or a web-like structure or truss assembly, a wide flange at the bottom, and a wide flange at the top. In the case of car 20, the central web assembly is indicated generally as 30 and runs in the longitudinal direction (that is, the rolling direction of the car), the top flange function is served by a top truss assembly 32, and the lower flange function is performed by an assembly that includes a lateral support structure 34, in the nature of a deck, or frame, or staging upon which cargo can be placed, and that extends laterally outward to either side of a main center sill 36, and main center sill 36 itself. Lateral support structure 34 generally includes deck structure 26, and its outboard left and right hand side sills 42 and 44.

It will be appreciated that aside from fittings such as hand grabs, ladders, brake fittings, and couplers, the structure of car 20 is symmetrical about the longitudinal plane of symmetry 24, and also about a transverse plane of symmetry 31 at the mid-length station of the car. In that light, a structural description of one half of the car will also serve to describe the other half. The features of car 20 thus enumerated are basic structural features of a center beam car having a depressed center deck.

In detail, main center sill 36, is a fabricated steel box beam that extends longitudinally along centerline 25 of car 20 throughout its length, having couplers 38 mounted at either end. Cross bearers 40 extend outwardly from center sill 36 to terminate at a pair of longitudinal left and right hand side sills 42, 44 that also run the length of the car. In the various embodiments of rail cars shown herein, cross-bearers are indicated as item 40 and cross-ties are indicated as item 41. These cross bearers and cross ties extend laterally outward from center still 36 on approximately 4 ft centers. Decking 46 is mounted to extend between cross-bearers 40, and cross-ties 41 providing a shear connection between adjacent cross-bearers when side loads are imposed on the car. Structural members in the nature of tapered risers 48 are mounted above the cross-bearers to form the base of a bunk for carrying loads. Risers 48 are tapered so that loads stacked thereupon will tend to lean inwardly toward the center-line of car 20. The upper surfaces of risers 48 define respective end decking portion and medial decking portion load-bearing interfaces. The combined structure of center sill 20, cross-bearers 40, and side sills 42, 44 and decking 46 provides a wide, lower beam or lower flange assembly extending laterally outward from the longitudinal centerline of car 20.

As noted above, deck structure 26 has a first end portion, namely end deck portion 27, a second end deck portion, namely end deck portion 28, and a medial deck portion 29. At each of the transitions from either end deck portion 27 or 28 to medial deck portion 29 there is a knee, indicated as either 47 or 49. Not only is deck structure 26 stepped in this manner, but so too are side sills 42 and 44, each having end members 41, 43, and a medial span member 45.

At either end of car 20 there are vertically upstanding fore and aft end bulkheads 50 and 52 which extend from side to side, perpendicular to the central longitudinal plane 24 of car 20. Running the full length of car 20 between end bulkheads 50 and 52 is an array 54 of upright posts 56, 57. Array 54 is reinforced by diagonal braces 58, 59, that provide a shear path for vertical loads.

The array 54 of posts 56, 57 is surmounted by an upper beam assembly 60 and deep beam top chord assembly 62. An open framework top truss 64 is mounted atop deep beam top chord assembly 62. Truss 64 has lateral wings 65 and 67 that are mounted to extend outboard from the central plane of car 20 in a cantilevered manner. Truss 64 has longitudinal stringers 66, cross members 68 and shear plates 69.

Figure 2A:
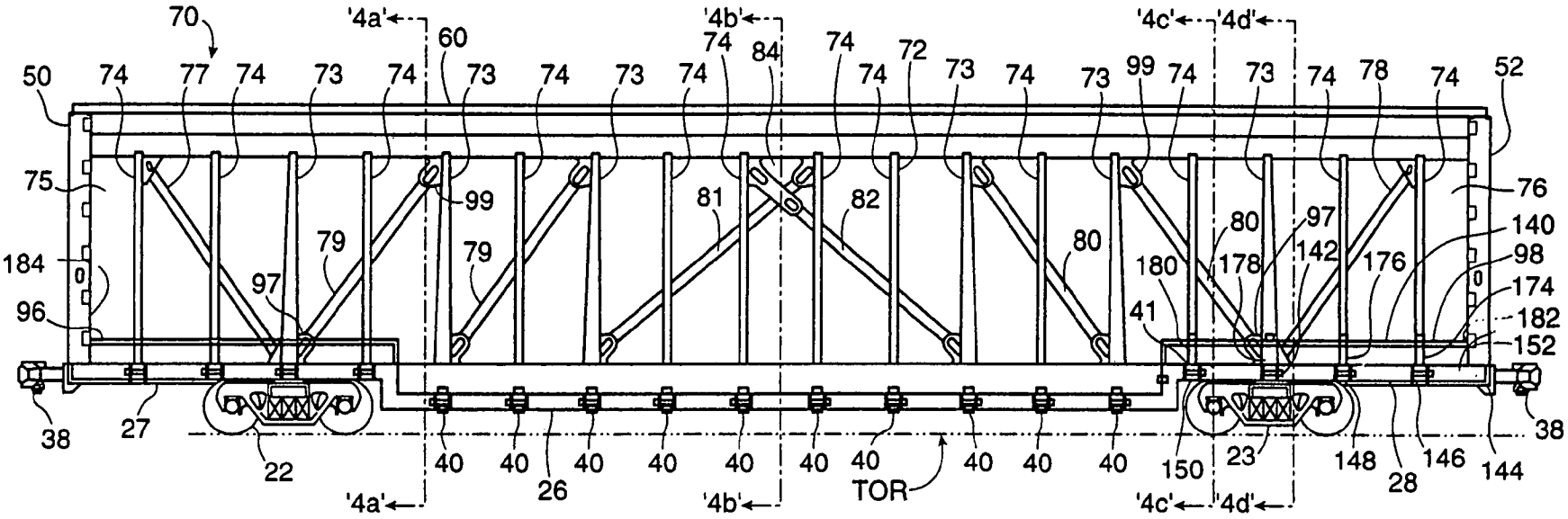
FIG. 2*a* shows a side view of one half of a center beam rail road car similar to the center beam car of FIG. 1.

As indicated in FIGS. 2*a*, 2*b*, 2*c*, 2*d*, 2*e* and 2*f*, there are many different possible configurations of posts and diagonal bracing. In FIG. 2*a*, a center beam railroad car with a depressed center deck is indicated as 70. It has an array of vertical posts 72 that includes fabricated posts 73 having a generally H shaped section, and posts 74 having a generally C-channel shaped section, both type being more fully described below. The end bays have solid panels 75, 76 respectively. End diagonal struts 77, 78 extend upwardly and longitudinally outboard away from the respective truck centers. Structural reinforcement members in the nature of left and right hand two-bay inboard diagonal braces, are indicated as 79, 80. Left and right hand three-bay diagonal braces are indicated as 81, 82 with the upper ends of braces 81, 82 overlapping at the upper region of central bay 84.

Figure 2B:
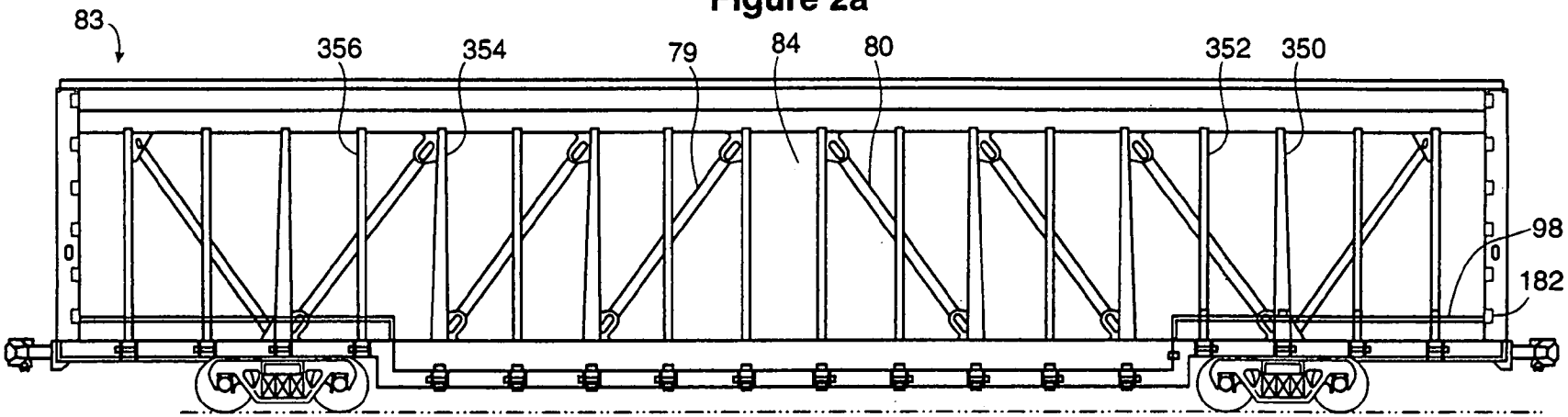
FIG. 2*b* shows an alternate configuration of car to that shown in FIG. 2*a;*
Figure 2C:
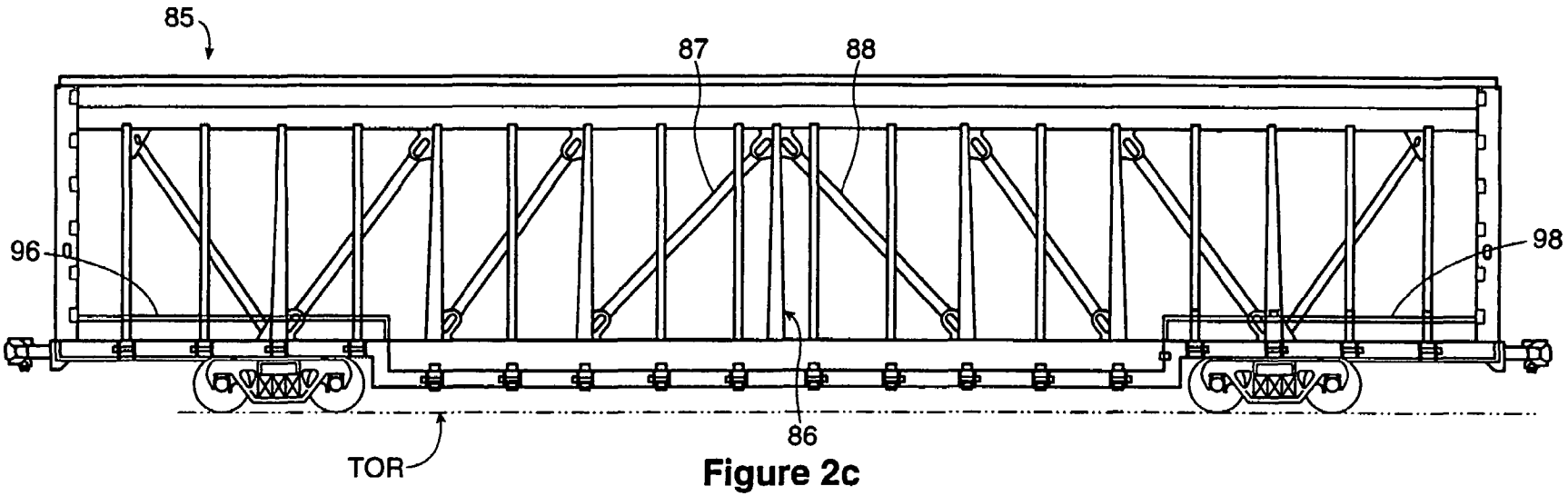
FIG. 2*c* shows an alternate configuration of car to that shown in FIG. 2*a;*
Figure 2D:
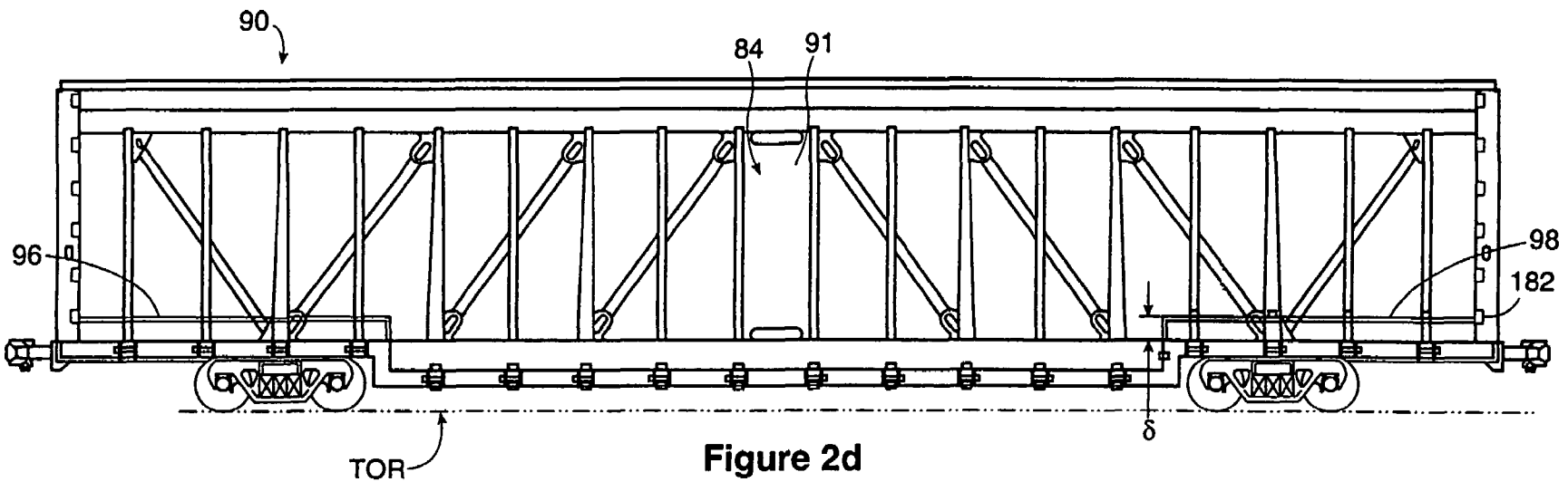
FIG. 2*d* shows an alternate configuration of car to that shown in FIG. 2*a;*
Figure 2E:
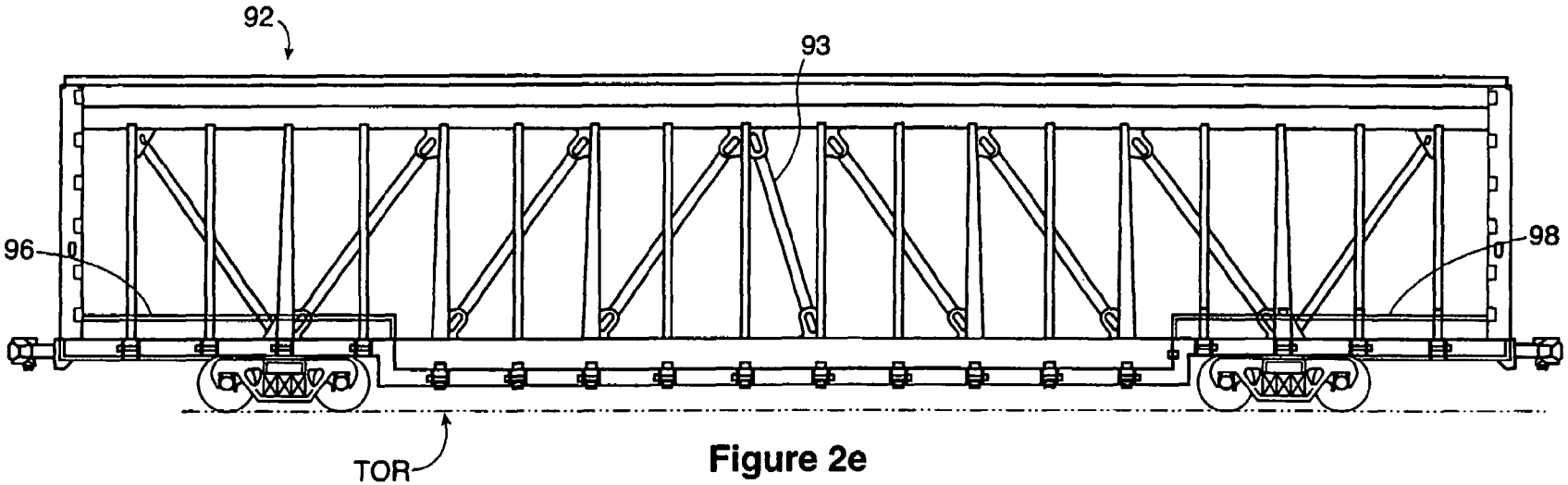
FIG. 2*e* shows an alternate configuration of car to that shown in FIG. 2*a;*
Figure 2F:
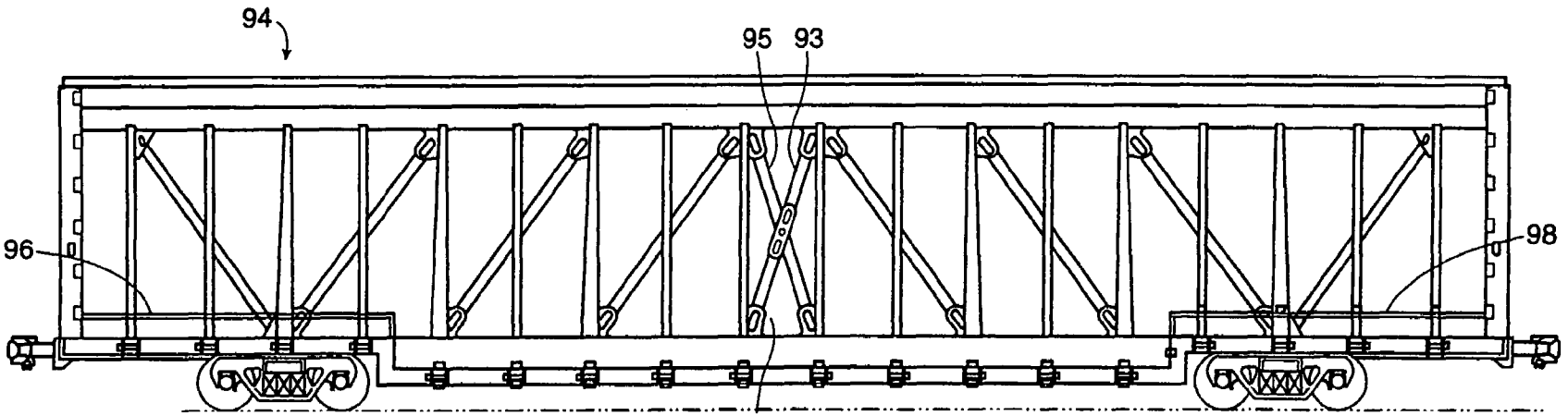
FIG. 2*f* shows an alternate configuration of car to that shown in FIG. 2*a;*

In FIG. 2*b*, a car 83 is similar to car 70, except insofar as an extra pair of two-bay diagonal braces 79, 80 being employed in place of braces 81, 82 with central bay 84 being free of diagonal bracing. In FIG. 2*c*, a center beam railroad car 85 is similar to car 70, but rather than using overlapping three-bay braces, 81 and 82, an additional tapered vertical post 86 is mounted at mid-span in central bay 84, and a pair of two-and-a-half bay braces 87, 88 meet at an upper portion of post 86. In FIG. 2*d*, a car 90 is similar to car 85, but a shear plate 91 is mounted in central bay 84. In FIG. 2*e*, a center beam railroad car 92 is similar to cars 85 and 90, but employs a single-bay diagonal brace 93. In FIG. 2*f*, a center beam railroad car 94, similar to cars 85, or 90, or 92, employs a pair of crossed single-bay braces 93, 95 in central bay 84. Of these, the embodiment of FIG. 2*f* is preferred.

Figures 4A, 4B:
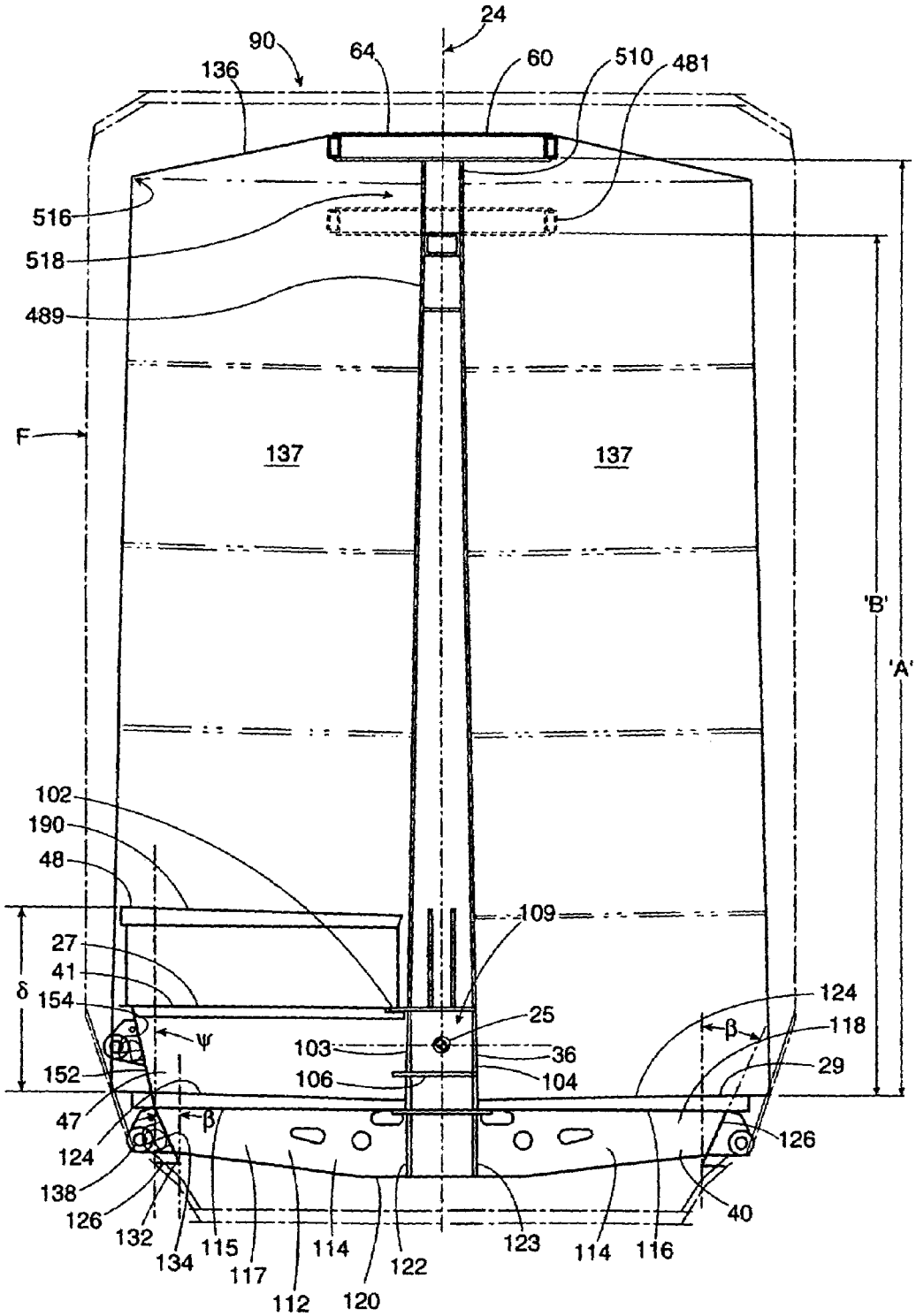
FIG. 4*a* shows a half-section of the car of FIG. 2*a* taken on section '4*a*-4*a*'.
FIG. 4*b* shows a half-section of the car of FIG. 2*a* taken on section '4*b*-4*b*'.

In all of cars 70, 83, 85, 90, 92 and 94, staging, in the nature of false floors 96, 98 is carried above the respective end deck portions. This staging is offset from the lading supporting structure of medial deck portion 29 by a height increment indicated as 8 (FIG. 4*a*). In all of the embodiments illustrated in FIGS. 2*a*, 2*b*, 2*c*, 2*d*, 2*e* and 2*f*, the step increment corresponds to the height of a nominal 32 inch bundle of lumber, plus dunnage, (that is, 31 and ½ inches of lumber plus 1 and ½ inches of dunnage).

FIGS. 4*a* and 4*b* are half sectional views of center beam railroad car 70 taken, respectively, at cross-tie 41 of end deck portion 27 looking inboard parallel to centerline 25, and at mid-span of medial deck portion 29, looking toward the nearest adjacent cross-bearer 40. The outline of AAR Plate F is indicated generally as 'F'. A main center sill is indicated, as above, as 36. It has an upper horizontal member in the nature of upper main flange 102, and a pair of spaced apart vertical shear carrying members in the nature of left and right hand main sill webs 103, 104, thus forming three sides of a box. The fourth side of the box is formed by a lower horizontal member, in the nature of a main sill lower flange 106. Lower flange 106 has an end portion, running along the outboard portion of main sill 36, in a manner similar to a stub sill, indicated in FIG. 3*a* as 108 at a height for mounting upon truck 22 or 23 as the case may be. The rectangular female socket 28 defined by the inner walls of items 102, 103, 104 and 108 is of a size and shape for receiving the male end of a coupler, such as coupler 38.

Figure 3A:
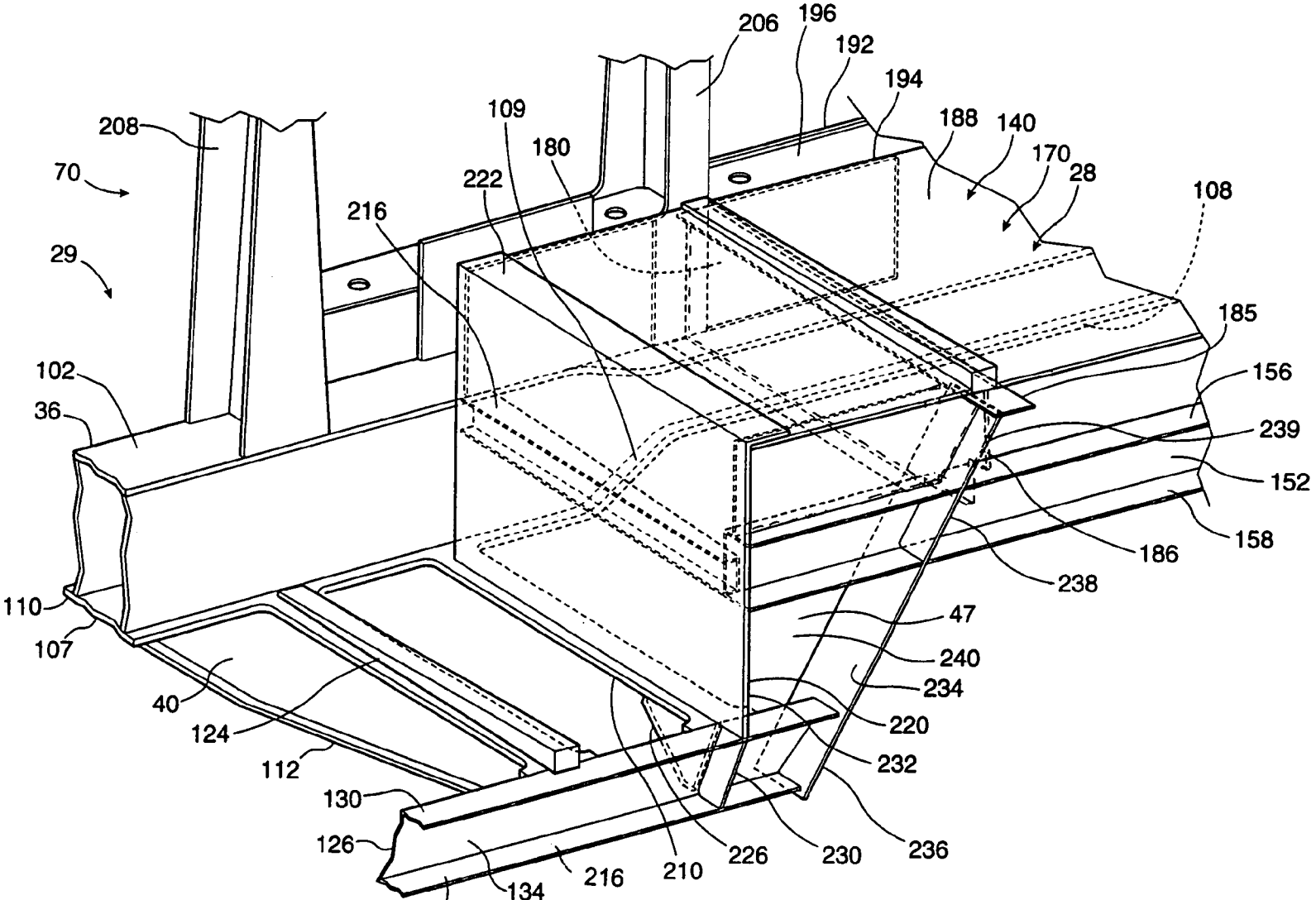
FIG. 3*a* shows a perspective view of a detail of a deck transition section of the center beam car of FIG. 2*a;*

As seen in FIG. 3*a* the inboard portion of lower flange 106 of main sill 36, such as extends along medial deck portion 29, is indicated as 107 and lies at a height relative to TOR that is below portion 108. Lower flange portions 108 and 110 are joined by a smoothly swept transition section 109, as indicated in phantom in FIG. 3*a*.

As seen in FIGS. 3*a*, 4*a*, and 4*b*, in the medial, or drop deck portion of the car, indicated as 29, there are cross-bearers, 40, as noted above. The endmost cross bearer of portion 29 next to knee 47 is indicated as 112. It is suspended from, and extends transversely to, main center sill 36. Cross bearer 112 has a vertically standing web, 114, and left and right hand upper flanges 115, 116. Flanges 115, 116 lie flush, and co-planar, with the outboard extremities of lower flange portion 110. (That is, flush with the portions of flange portion 110 that stand outwardly proud of vertical webs 103 and 104). The join between flanges 115, 116 and flange portion 110 is smoothly radiused.

Web 114 has left and right hand tapered portions 117, 118, and a continuous lower flange 120 that follows the profile of the lower edge of portions 117, 118. Longitudinal gussets 122,123 are placed between adjacent cross-bearers 112 to encourage the maintenance of parallelism between adjacent webs 114. Each upper flange 115, 116 of each cross bearer 112 has mounted on it a riser 124 that is tapered in profile, being shallowest closest to the car centerline 25, and deepest at its outboard extremity so that lading borne thereon will tend to have an inward slant. The ends of upper flanges 115, 116 and lower flange 120 are flared and radiused to meet the inner face of longitudinally extending medial side sill portion 126. The upper flange 130 of side sill portion 126 lies flush, and co-planar with, upper flange 115, (or 116 as may be), the outboard end of riser 124 overlying side sill flange 130. Those portions of flange 110, flange 115 (or 116) and flange 130 that remain exposed provide a peripheral lap surface upon which floor sheets 127, 128 can be welded, providing a shear connection between those elements.

Figure 4D:
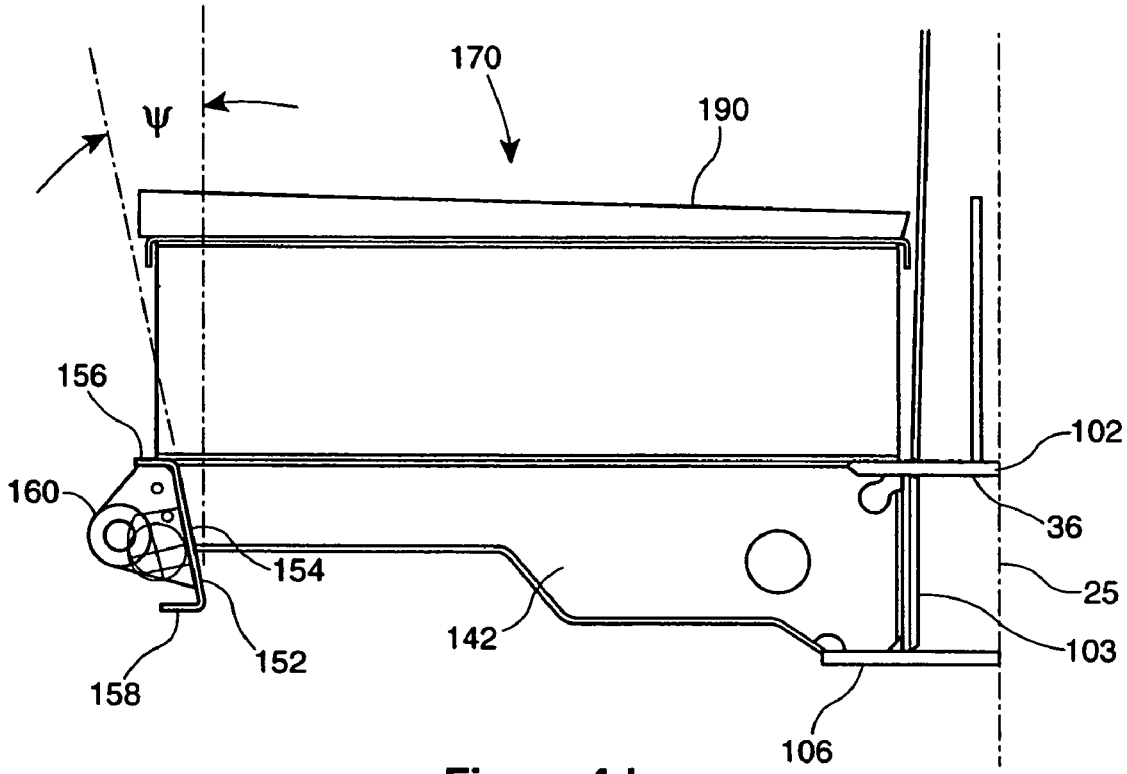
FIG. 4*d* shows a cross-section of an end deck taken on section '4*d*-4*d*' looking toward the main bolster of the car of FIG. 2*a;*
Figure 4C:
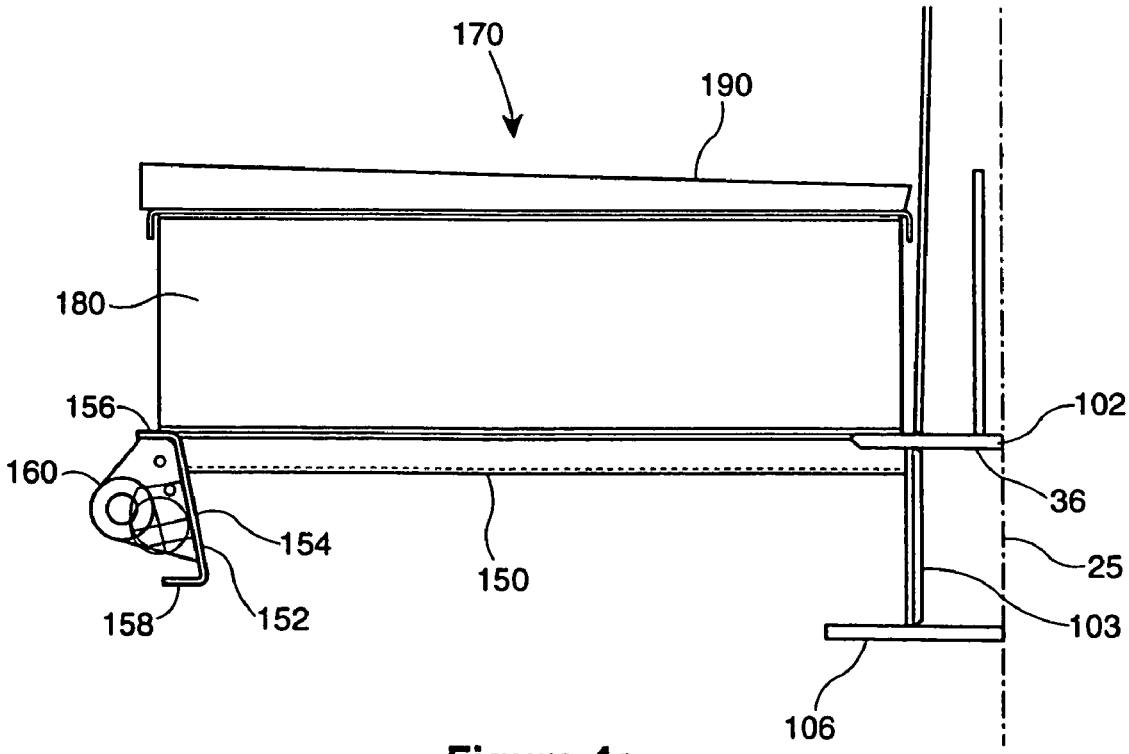
FIG. 4*c* shows a half-section of an end deck taken on section '4*c*-4*c*' looking toward a cross-tie of the car of FIG. 2*a;*
Figure 4E:
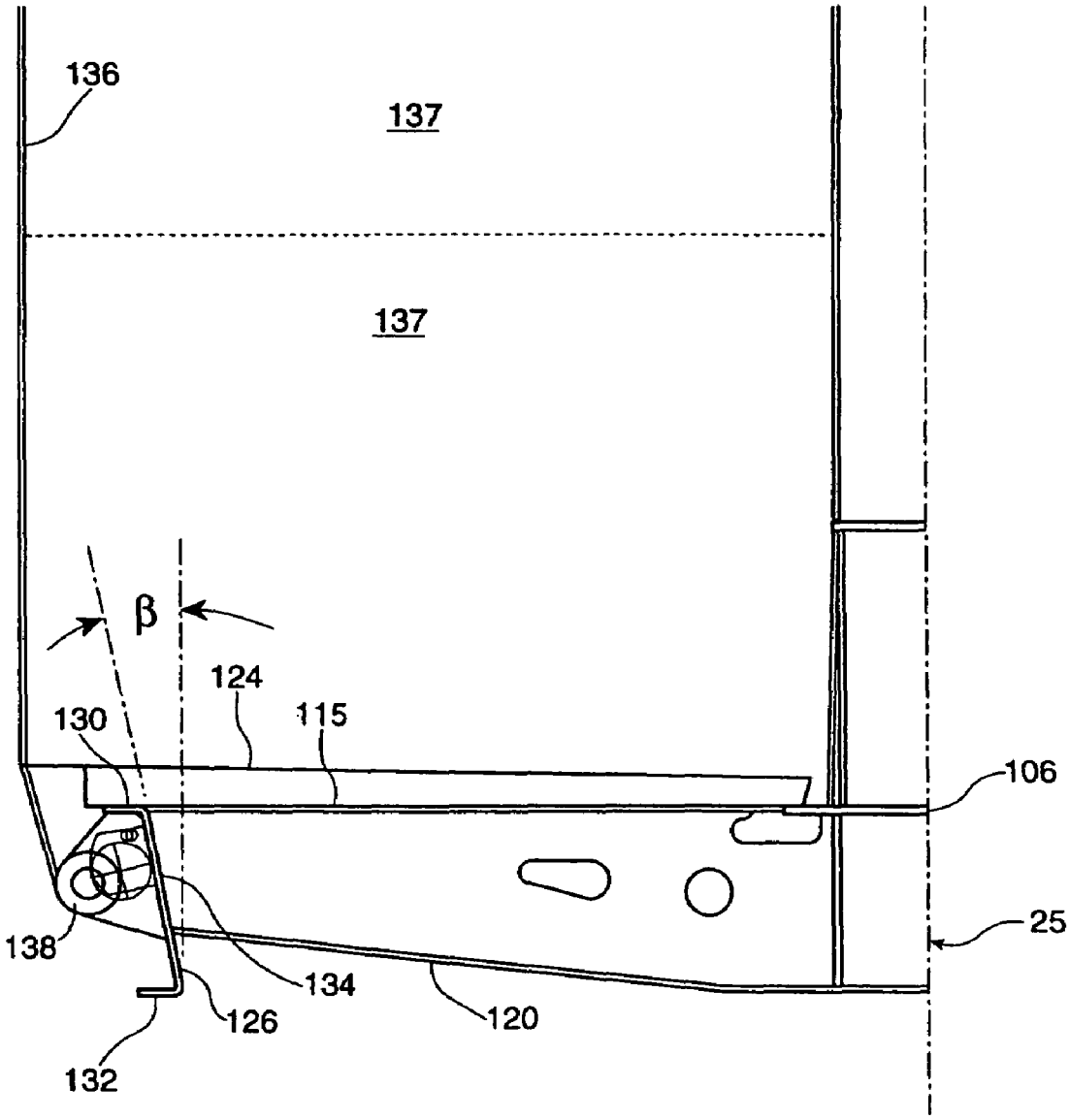
FIG. 4*e* shows an enlarged detail of the cross-section of FIG. 4*a;*

As best seen in FIGS. 4*a*, 4*b* and 4*e* medial side sill portion 126 has a channel like profile, having top or upper flange 130, noted above, a bottom or lower flange 132, and a back, or web, 134. However, while top flange 130 and bottom flange 132 lie in parallel horizontal planes, web 134 does not stand perpendicular to them, and does not stand vertically perpendicular. Rather, web 134 is canted upward and outward at an angle β measured from the vertical, such that flange 130 is displaced, or skewed, or stepped, outward relative to flange 132. As seen in FIG. 4*a*, the extent of this outward positioning is such that both upper and lower flanges fall within the envelope of Plate F. A load securing device in the nature of a winch 138 is mounted to the outboard face of web 134 for tightening strapping 136 about the lading 137. The slanted incline of web 134 permits the center of rotation of winch 138 to be drawn inward toward the center line of rail car 70 (or 20, 83, 85, 90, 92, or 94 as the case may be), thus tending to permit the medial portion 29 of deck structure 26 to be carried at a lower height than otherwise.

The construction of end deck portion 28 (or 27), is shown in FIGS. 3*a*, 4*a*, and 4*d*. Main bolster 142 extends laterally outward from the main sill 36 at the longitudinal station corresponding to the truck center, whether of truck 22 or 23, the car being symmetrical about its mid span transverse plane. The lower flange of bolster 142 is formed to follow an upwardly and outwardly stepped profile to clear the wheels of truck 22 (or 23) through the turning envelope of the truck relative to the car generally. End deck structure 140 (FIG. 3*a*) includes a cross tie 146 located roughly 8 ft longitudinally outboard of main bolster 142, (FIGS. 2*a* and 4*c*) cross tie 148 (FIG. 2*a*) located roughly 4 ft. longitudinally outboard of main bolster 142, and cross tie 150 (FIG. 2*a*) located roughly 4 ft. longitudinally inboard of main bolster 142. A side sill end portion is indicated as 152 (FIG. 3*a*), and extends along the transversely outboard, or distal, ends of main bolster 142, and cross ties 146, 148 and 150.

In FIG. 4*d*, side sill end portion 152 also has the form of a skewed C-channel, having an outwardly and upwardly slanted web or back 154 having an upper edge and a lower edge, the upper edge lying further transversely outboard than the lower edge. Back 154 is inclined from the vertical at an angle Ψ. Ψ is less than β described above. Side sill end portion 152 has a top flange 156 that is substantially level in a horizontal plane, and a bottom flange 158 that is parallel to top flange 156, but inwardly inset according to the horizontal run of slanted back 154. Winches 160 (not shown in FIG. 3*a*) are mounted at the longitudinal stations corresponding to main bolster 142 and cross ties 146, 148, and 150.

A staging assembly, in the nature of a false floor is indicated generally as 170. It includes lateral vertical web members in the nature of false floor webs 174, 176, 178 (FIG. 2*a*) and 180 mounted above, and at the longitudinal stations of, cross tie 146, cross tie 148, main bolster 142 and cross tie 150. A false floor support, in the nature of an angle iron 182, is mounted to the inboard wall face of end bulkhead 184 at a level corresponding to the level of the upper edges of false floor web top flanges 185 (FIG. 3*a*) of false floor webs 174, 176, 178 and 180 (FIG. 2*a*). A vertically extending longitudinal false floor web 186 (FIG. 3*a*) is mounted above, and runs along, side sill end portion 152. A floor sheet 188 is then welded above, and is supported by items 174, 176, 178, 180 and 182. Tapered risers, 190 (not shown in FIG. 3*a*), upon which lading can rest, are mounted above the respective laterally extending vertical web members. The incremental height distance of the rise from the load supporting interface of risers 124 (FIG. 4*a*) to the load supporting interface of risers 190 (FIG. 4*a*), measured perpendicular to the slope of risers 124, 190, corresponds to the height of a bundle of lumber, plus dunnage. In the preferred embodiment this incremental height is 33⅝"+/−⅛", although it can be a lesser height, such as 30 inches with any discrepancy being made up by dunnage. Vertical webs, namely gussets 192, 194 (FIG. 3*a*) are mounted between adjacent pairs of vertical posts to the level of the false floor as supports for the otherwise unsupported inner edge of floor sheet 188. Covers 196 act as gussets filling the gaps between adjacent posts and gussets 192, 194.

Knee 49 is located at the transition, or step, between end portion 28 and medial deck portion 29. Knee 47 is located at a mid-bay longitudinal station between the longitudinal stations of formed post 206 and fabricated post 208. A laterally extending, generally horizontal transition flange 210 extends flush with, and between, main sill lower flange 107 and side sill medial portion upper flange 102. At the same longitudinal station, a side sill end portion stiffener, in the nature of a rectangular tube 216, is mounted to extend between center main sill 36 and the inboard end of side sill end portion 152. A vertical wall member, in the nature of a well bulkhead sheet 220 is mounted to extend vertically upward from transition flange 210, past the inboard end of side sill end portion 152 and rectangular tube 216, up to the level of false floor sheet 188. Sheet 220 terminates at its upward end in a formed flange 222, which overlaps, and is welded to, sheet 188. An inner tapered gusset 226 is located at the longitudinal station of transition flange 210 and extends between the inner face of medial side sill portion and the underside of transition flange 210. Similarly, at the same longitudinal station, a side sill gusset 230 reinforces the section of side sill portion 126.

As viewed from the side of car 70 as illustrated in FIG. 3*a*, knee 47 appears to have a longitudinally inboard vertical flange 232, that is, the transversely outboard or distal margin of well bulkhead sheet 220, and an outboard, angled flange 234 that faces, generally, toward truck 23, with a web or webs extending between sheet 220 and flange 234. Flange 234 includes three aligned portions. The first, lowest portion is a side sill gusset member 236, that closes the end of side sill portion 126 and extends upwardly on a slant toward the lower or bottom flange 158 of side sill end portion 152, to a locus of intersection somewhat inboard of the longitudinal station of formed post 206. The line of member 236 is continued by side sill end portion gusset 238, which is slanted to lie within the flanges and back of side sill end portion 152, and by a false floor gusset 239, located on the same angle between the top flange of side sill end portion 152 and false floor sheet 188. A trapezoidal gusset 240 fills the void between the bottom flange 158 of portion 152, the upper or top flange 130 of the end of medial portion 126, sheet 220, and flange 234. When seen in end view, as in FIG. 4*a*, flange 234, and the outboard edge of sheet 220, both follow an upwardly and outwardly angled profile, lying within Plate F. Providing an angled flange in this way, and thereby effectively deepening the width of section of vertical leg 232 of knee 47 may tend to increase the width of structure over which a moment couple generated in side sill medial portion 126 can be carried, thus tending to reduce the stress levels in the transition. Member 234 terminates, at its upward and outward end, at false floor support top flange 185. Upper main sill flange 102 is trimmed back flush with main sill side webs 103 and 104 in the well section or medial portion of the car so that a smooth face is presented next to the lading.

Figure 3B:
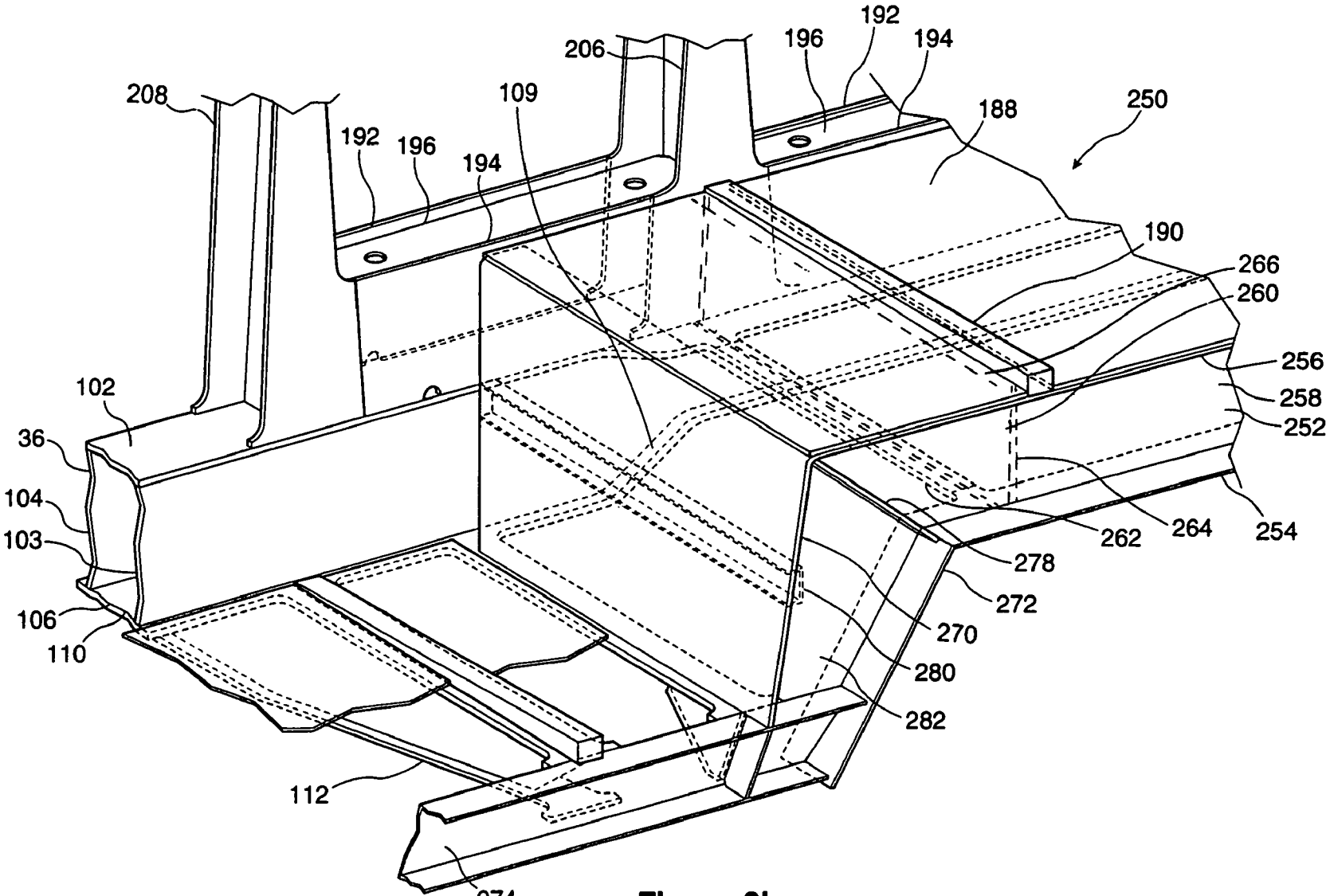
FIG. 3*b* shows an alternative to the transition section of FIG. 3*a;*

An alternative embodiment of end deck structure is shown in FIG. 3*b*. Rather than employing a false deck mounted above the side sill end portion, a deeper side sill end section is employed. An end deck portion is indicated generally as 250. It includes a main bolster and vertical posts, both formed and fabricated, as above. A deep side sill end section 252 has a lower flange 254 at the same level as that of lower or bottom flange 158 of side sill end portion 152 described above (that is, at a height to clear the operational envelope of the adjacent truck 22 or 23). The upper flange 256 of section 252 is carried at the same height as the false floor top flange 185 described above. The vertical web 258 of section 252 then serves as the longitudinal outboard web of the staging, or false floor. In place of cross-ties 146, 148 and 150, and transversely oriented vertical false floor webs 174, 176, and 178, a transverse support 260 has a bottom flange 262, a vertical false floor web 264, and an upper flange 266. Bottom flange 262 is carried at an elevation equal to that of lower flange 254 of side sill end section 252 and upper flange 102 of main center sill 36.

In place of diagonal, angled flange 234, knee 270 has an inclined flange 272 that boxes in the end of medial side sill portion 274 and meets lower flange 254 of end section 252. Web 258 of side sill end section 252 has a knee, and a web stiffener 278 is run across the corner between upper and lower flanges 256, and 254. A boxed end stiffener 280 is used in place of rectangular tube 216, and a web 282 fills the space between well bulkhead sheet 220, side sill medial portion upper flange 130, inclined flange 272, and web stiffener 278. Web 258 and web 282 are portions of a single, monolithic port. As in the embodiment of FIG. 3*a*, the tapered vertical leg that is created in this manner has a greater depth of section and may tend to be advantageous in carrying moment couples through the end deck to well deck transition. False floor sheets and risers are located as described above.

Figure 3C:
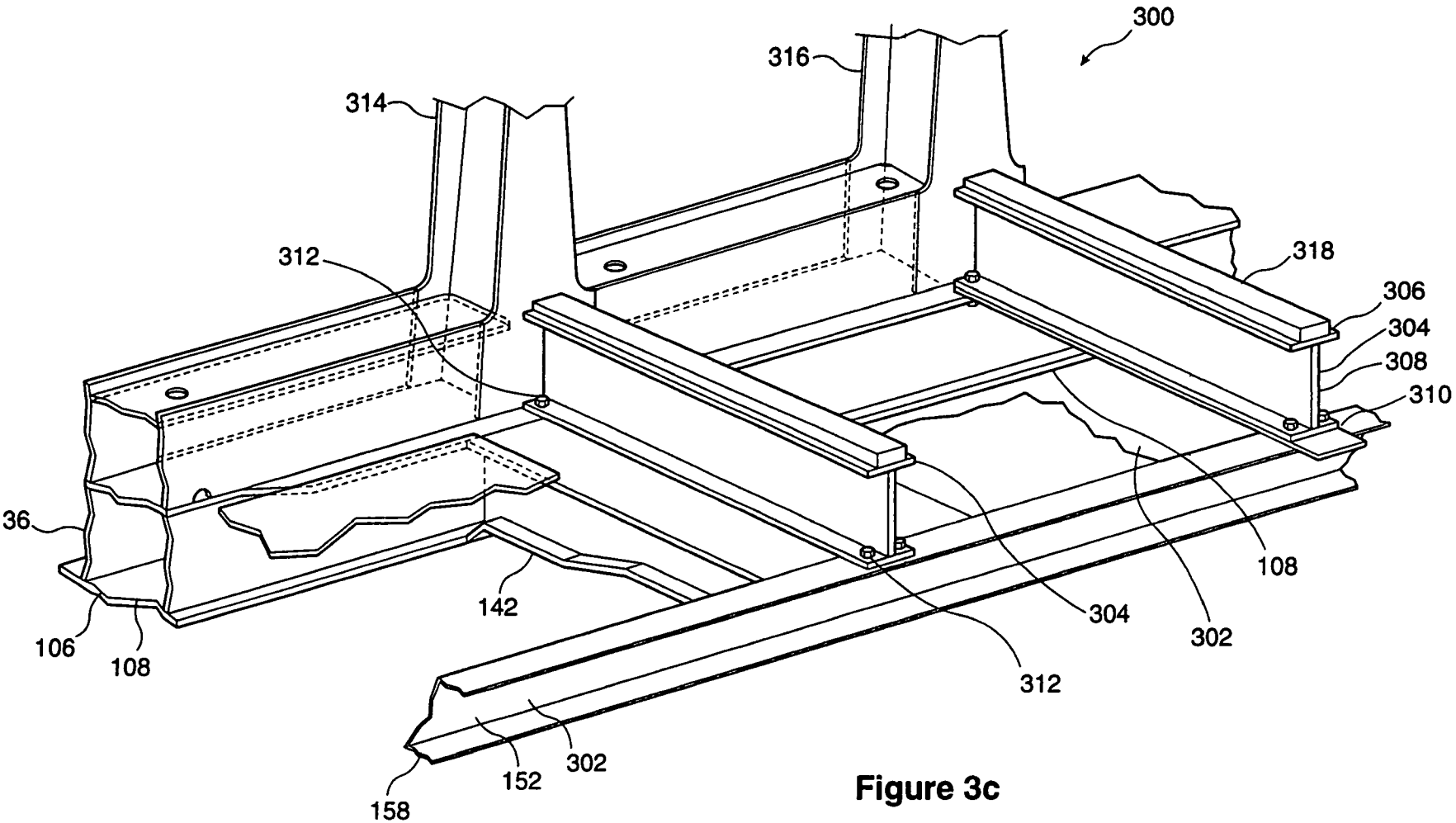
FIG. 3*c* shows an alternative, removable, load supporting structure for an end section of a center beam car otherwise similar to the rail car of FIG. 2*a;*

In FIG. 3*c*, removable staging, or a removable false floor assembly 300, includes a conventional end decking structure medial side sill, and a series of removable lading support beams 304 upon which bundles of lumber can be carried. Each beam has an upper flange 306, a web 308, and a lower flange 310. Lower flange 310 carries attachment fittings in the nature of bolts 312 to permit it to be located at a longitudinal station abreast of respective ones of posts 314 and 316. Tapered risers 318 are separable, and have the same attachment fitting footprint as lower flange 310, so it can be re-applied to the conventional deck. Support beams 304 can be located in storage positions nested inside the flanges of posts 314 and 316, as desired.

Figure 3D:
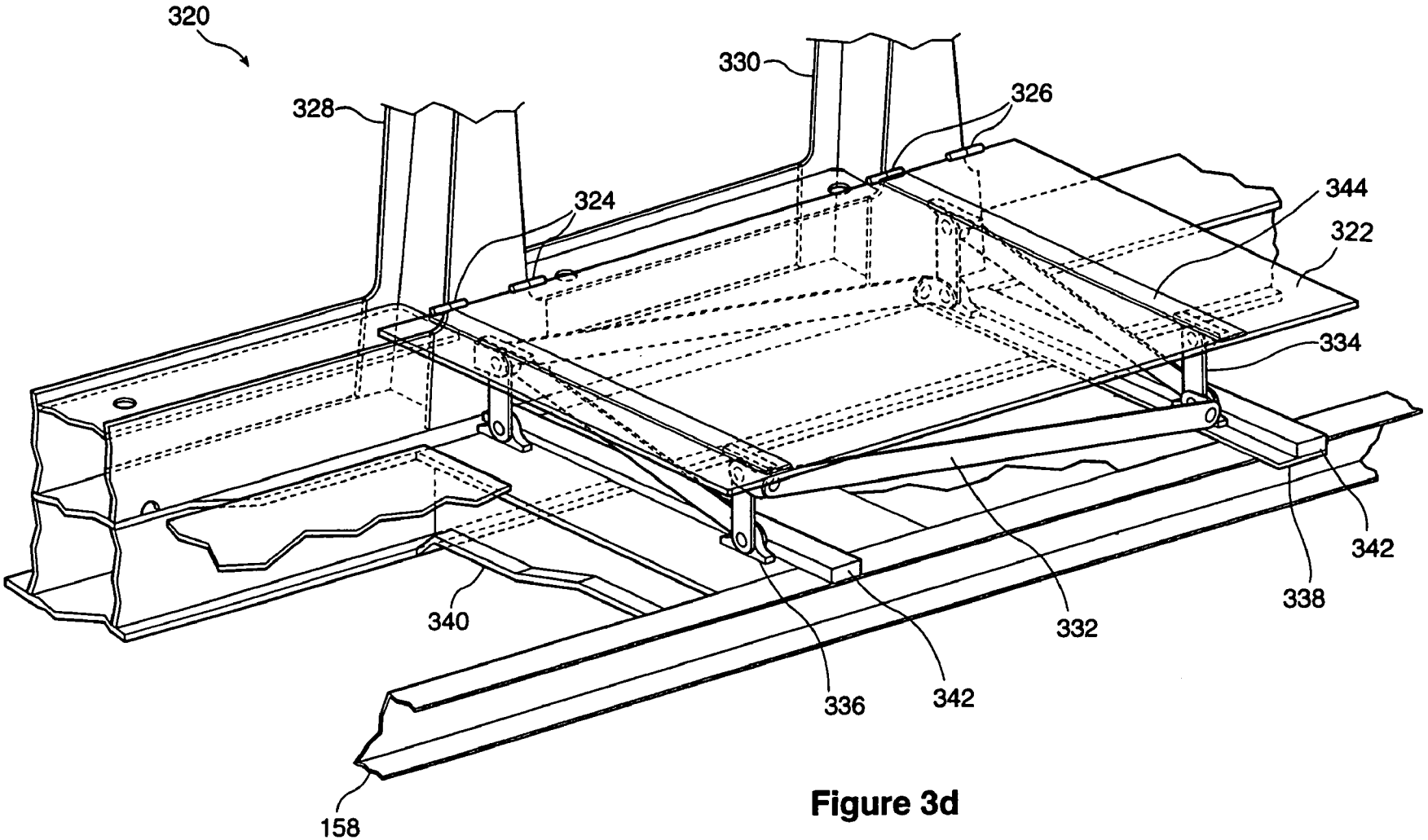
FIG. 3*d* shows an alternative, collapsible load supporting structure for an end section of a center beam railroad car similar to the car of FIG. 2*a;*

In the further alternative embodiment of FIG. 3*d*, a center beam rail road car 320 has a moveable decking end portion sheet indicated generally as 322. Sheet 322 is hinged at 324, 326 to permit rotation upward to lie in an up, or storage position against the outside face of posts 328 and 330. A collapsible support structure, in the nature of a set of diagonal links 332 and vertical struts 334 support sheet 322 when it is deployed in its down, or use, position. Links 332 and struts 334 are mounted to lugs 336 mounted on cross tie 338 and main bolster 340 respectively. Risers 342 are also mounted to cross tie 338 and main bolster 340, the height of risers 342 exceeding the height of lugs 336. Fenders 344 are mounted to the underside of sheet 322, and stand proud of those of lugs 336 that are also mounted to the underside of sheet 322, and to which the upper ends of links 332 and struts 334 mount.

Figure 2G:
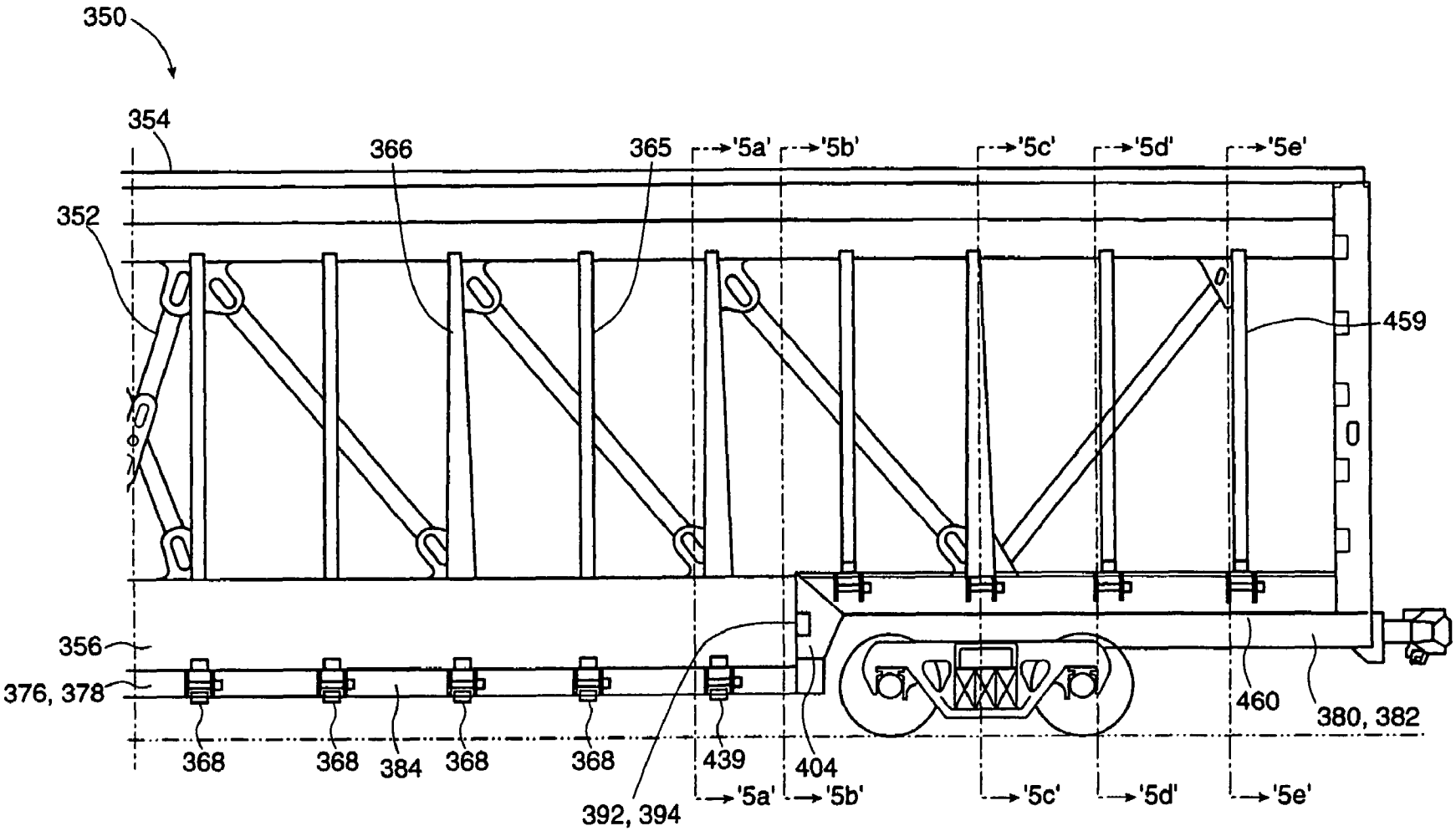
FIG. 2*g* shows a side view of one half of an alternate center beam rail road car to the center beam rail road car of FIG. 1.

In FIG. 2*g*, a dropped deck center beam rail road car is indicated generally as 350. It has a web structure 352 and a top truss structure 354 substantially the same as those shown in FIG. 2*f*. Car 350 differs from those described above as shown in the isometric view of FIG. 3*e* and the sectional views of FIGS. 5*a*-5*e* and the detail views of FIGS. 6*a* to 6*e*. The main sill is indicated as 356. It has a top cover plate 358, left and right hand side webs 360, 361, and a bottom flange 364, all welded in a box structure. Side webs 360 and 361 are tapered inward at the same angle, and in the same planes as, the flanges of the upright posts, 365, 366, so that there is slope continuity. Cross-bearers 368 are mounted transversely below main sill 356, the web 370 of cross bearers 368 running beneath main sill 356 and having left and right hand portions extending to either side of main sill 356, generally similar to the embodiment of FIG. 4*e* described above. Hollow structural members, in the nature of hollow steel tubes, identified as risers 374, locate over the top flanges of cross-bearers 368, each having an inboard end seated upon the upper side of bottom flange 364, abutting respective side webs 360 and 361.

Figure 3E:
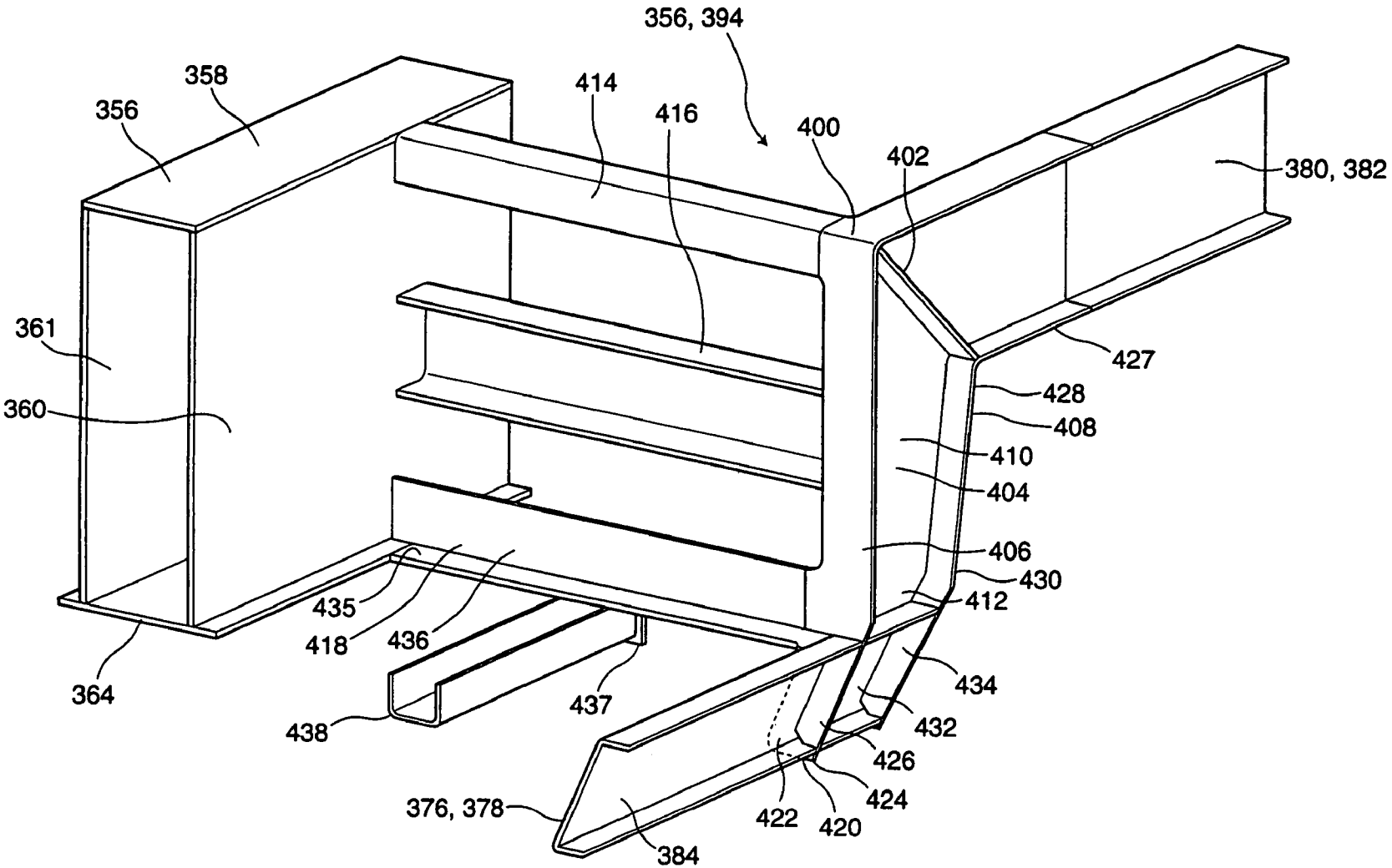
FIG. 3*e* shows an isometric view of a detail of a deck transition of the center beam rail road car of FIG. 2*g;*

Side sills 376 and 378 extend along the outboard ends of cross-bearers 368. Side sills 376 and 378 have end portions 380 and 382, and medial portions 384 (FIG. 3*e*). Medial portions 384 extend along the dropped deck portion of the car, and are, consequently, stepped downwardly relative to end portions 380 and 382. As with side sills 126 and 152 described above, each of side sills 376 and 378 is skewed—that is, while the flanges are parallel, the lower side sill flange is stepped inboard relative to the upper side sill flange, and the back, or web, of the side sill is canted inward at an angle. Web 370 has a depth at its left and right hand outboard, or distal, extremities that corresponds to the depth of the side sill between the top and bottom flanges. The bottom flanges 369 of cross-bearers 368 extend outwardly such that the bottom flange of side sills 376 and 378 seat thereon. The winch arrangement is similar to that described above.

As above, the dropped deck portion of the deck ends at left and right hand knees, indicated as 392, 394. Other than being of opposite hands, they are of identical construction. The medial portion of the side sills, 384, has been described above. The end portions 380 and 382 are formed from deep wide flanged beams. As noted above, the depth of the beam is determined at the lower flange by the height required to give adequate clearance over the wheels when the car is fully loaded and cornering, and the upper height limit of the upper flange is determined by the 33⅝" height increment at the step in the deck at knees 392 and 394. Notably, there is no false floor. End portions 380 and 382 terminate, at their inboard ends at knees 392 and 394, at a corner, 400, that is enclosed with an angled end gusset 402 running on the diagonal between the upper and lower flanges of end portion 380 or 382, as the case may be.

The upright portion, 404 of side sills 376 and 378, have a front flange member 406 facing the well, a rear facing flange member 408 facing the adjacent truck, an irregular quadrilateral upper web portion 410 and a lower web portion 412. Front flange member 406 is a substantially flat metal plate, and is mounted in a vertical plane. The metal plate is trimmed to provide smoothly radiused transitions to mate with an upper cross member 414, a medial cross member 416, and a bottom cross member 418. At its lower extremity front flange member 406 has a sill engagement fitting, or seat, in the nature of a hook-shaped cut-out conforming to the inward profile of medial side sill member 384. That is, the upper edge of the cut-out conforms to the top flange of the medial side sill portion, the outboard edge of the inwardly curving leg 422 conforms to the back, or web, of the medial side sill portion, and the smoothly curved toe 424 conforms to the bottom flange of the medial side sill. A gusset 426 seats within medial side sill portion 384, in the plane of front facing flange member 406, completing the section.

Rear facing flange member 408 is made from a bent plate cut to the desired profile. An upper leg 428 of member 408 runs downwardly from the end of the lower flange 427 of end side sill portion 380 (or 382) on an angle along the edge of quadrilateral web member 410. It bends downward into a lower leg 430 lying in a vertical plane at the longitudinal station of the end of the medial portion 384. Member 408 also has an inwardly tending leg 432 cut to a similar profile to leg 422 and toe 424, although having greater width when seen perpendicular to the vertically extending plane. A gusset 434 seats within the end section of side sill medial section 384 in the plane of leg 432, in a manner similar to gusset 426.

Lower cross-member 418 is an angle iron having one leg 436 trimmed to lie in a vertical plane, perpendicular to the longitudinal centerline of car 350, between side web 360 (or 361) of main sill 356 and the trimmed transition of forward facing member 406. The other leg 435 of member 418 is trimmed to lie between, and be welded to, the outer edge of bottom flange 364 of main sill 356 and the juncture of the back or web, and upper flange of medial side sill portion 384. A stringer in the nature of an upwardly opening channel 438 extends from a hangar bracket web mounting 437 on the underside of member 418 to the first cross-bearer 439 (FIG. 2g).

In this embodiment it will be noted that the cap, or upper flange of main sill 356 is carried at a height corresponding to the height of the upper, or end, deck portions.

Figures 5A, 5B, 5C:
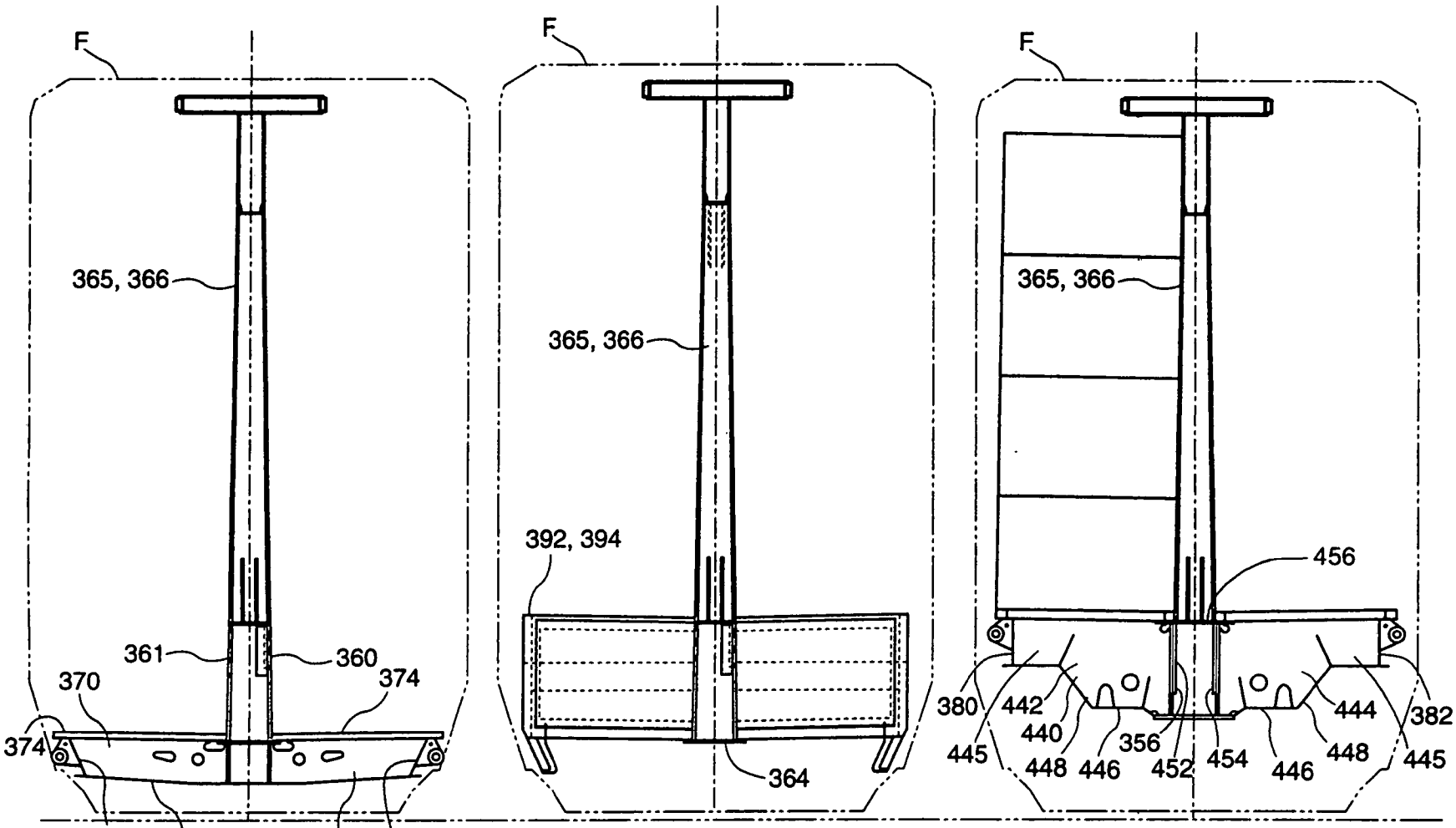
FIG. 5*a* shows a cross-section of the car of FIG. 2*g* taken on section '5*a*-5*a*'.
FIG. 5*b* shows a cross-section of the car of FIG. 2*g* taken on section '5*b*-5*b*'.
FIG. 5*c* shows a cross-section of the car of FIG. 2*g* taken on section '5*c*-5*c*' looking toward the main bolster.

FIG. 5c shows the deep main bolster 440 at section 5c-5c. As can be seen, left and right hand arms 442 and 444 of main bolster 440 have outer, or distal extremities 445 that have the same depth of section as side sill end portions 380, 382. The root of main bolster 440 at the juncture of main sill 356 has a depth extending from the truck center plate mounting to the height of the upper deck. Main bolster 440 has inner shoulders 446, and sloped intermediate portions 448 joining the inner and distal portions, with a stepped flange 450 extending fully along the lower edge of the bolster web. At this section, the tapered walls or webs, of main sill 356 are bracketed by two heavier, vertical plates 452, 454. Plates 452 and 454 form the inner end of the end portion of the center sill 356. A heavier top flange 456 forms the top plate of the end portion of main sill 356.

Figure 5E:
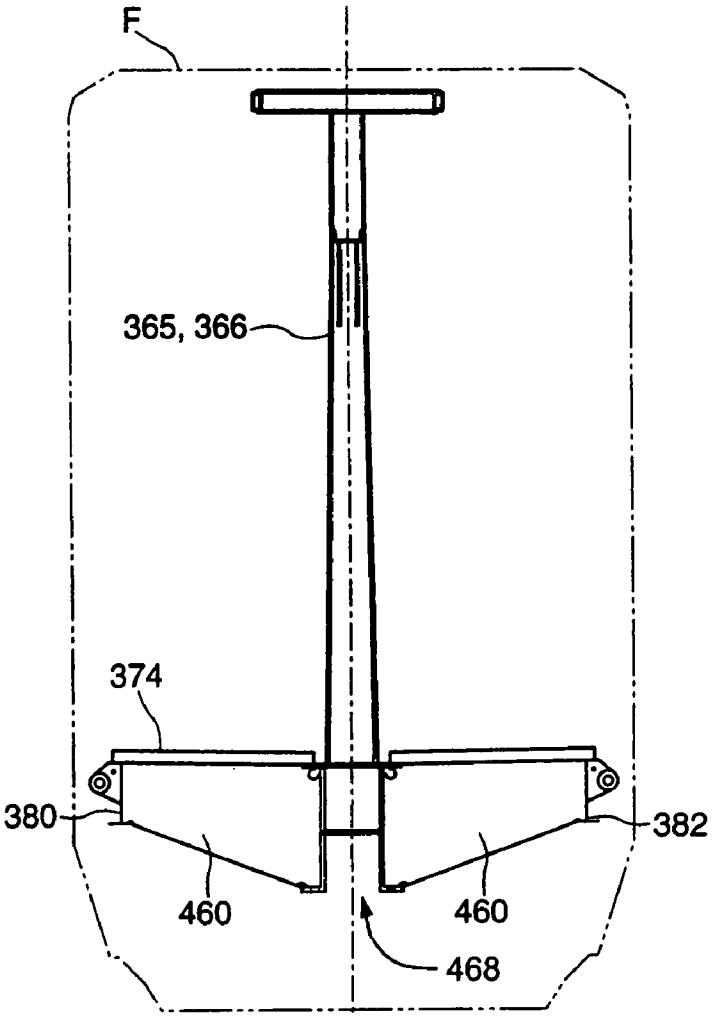
FIG. 5*e* shows a cross-section of the car of FIG. 2*g* taken on section '5*e*-5*e*'.
Figure 5D:
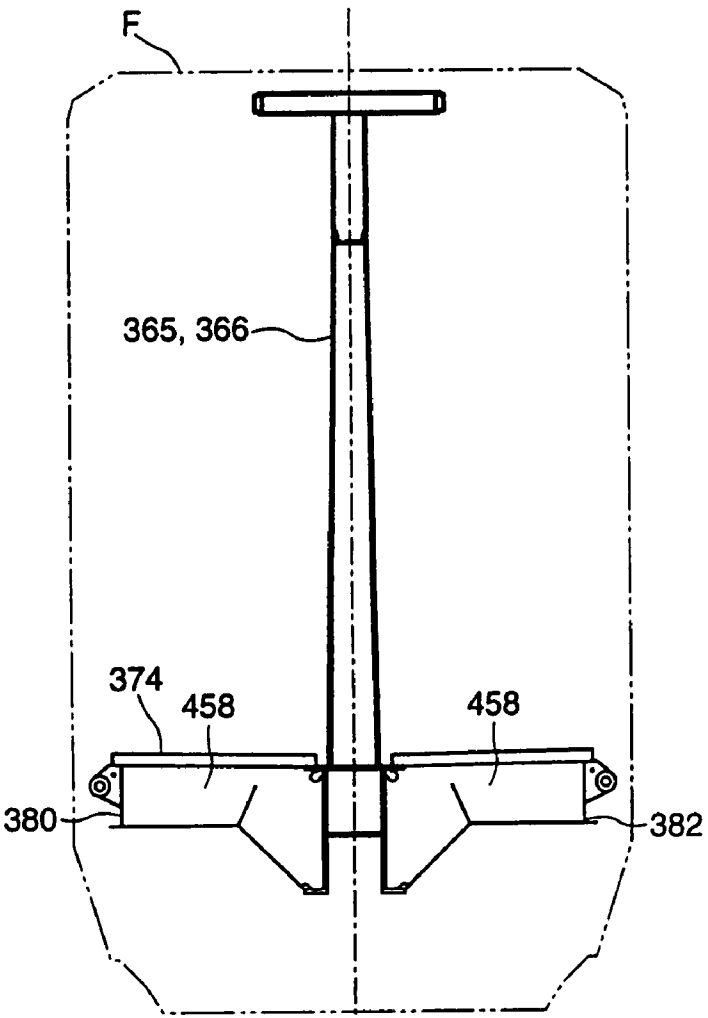
FIG. 5*d* shows a cross-section of the car of FIG. 2*g* taken on section '5*d*-5*d*'.
Figure 6A:
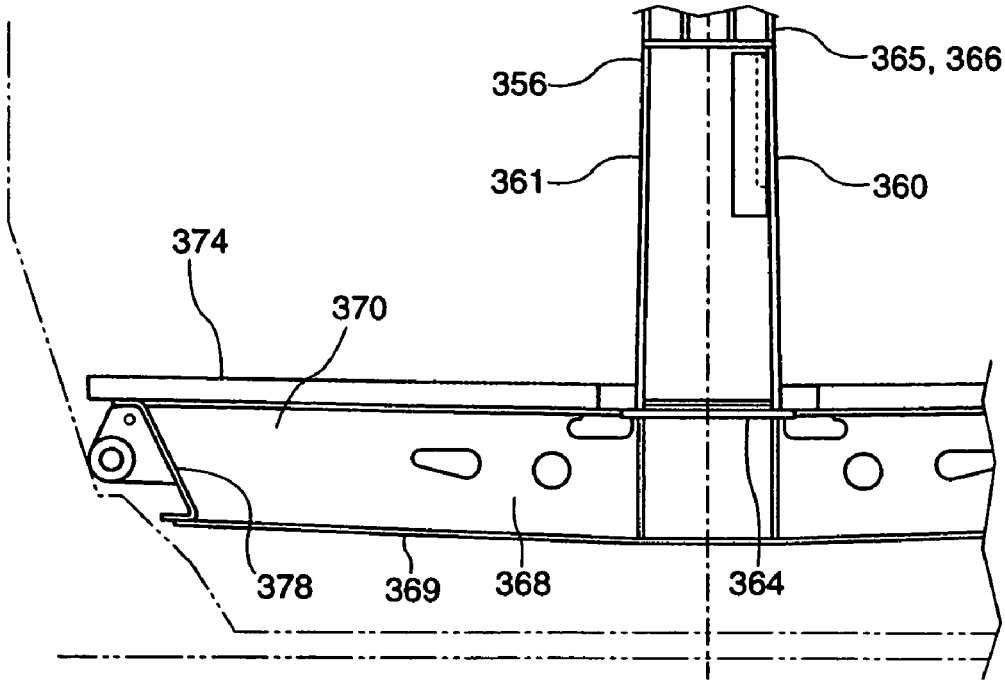
FIG. 6*a* shows an enlarged detail of FIG. 5*a;*
Figure 6B:
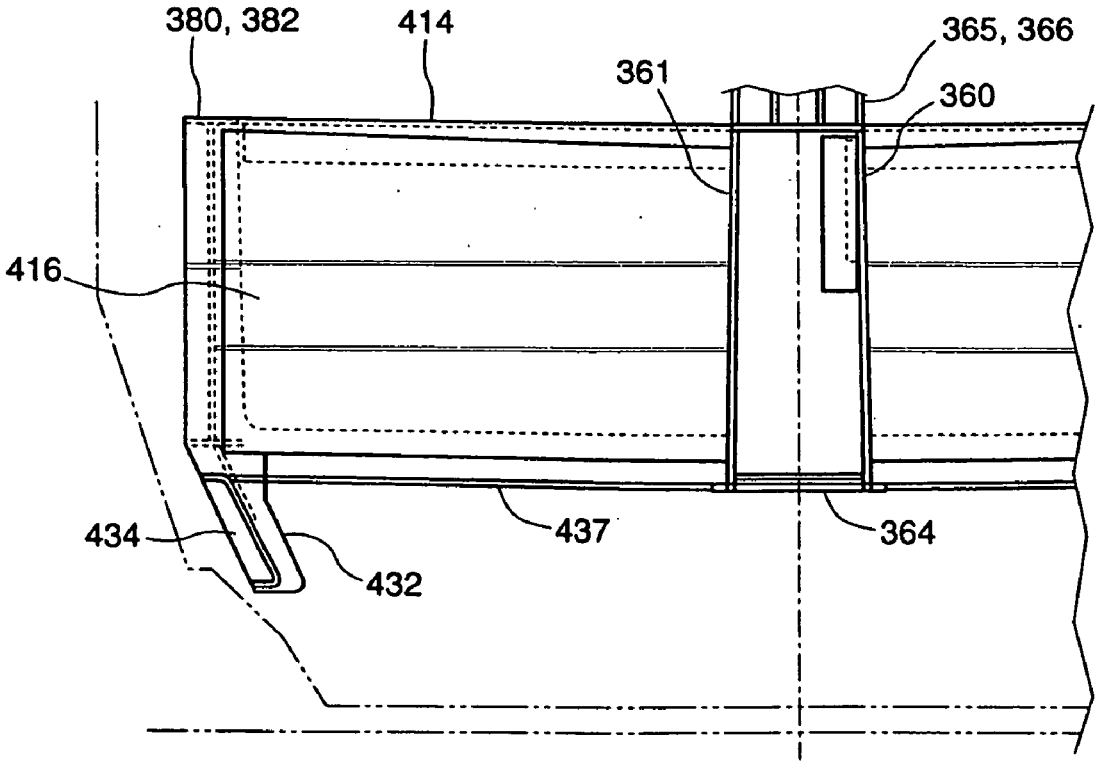
FIG. 6*b* shows an enlarged detail of FIG. 5*b;*
Figure 6C:
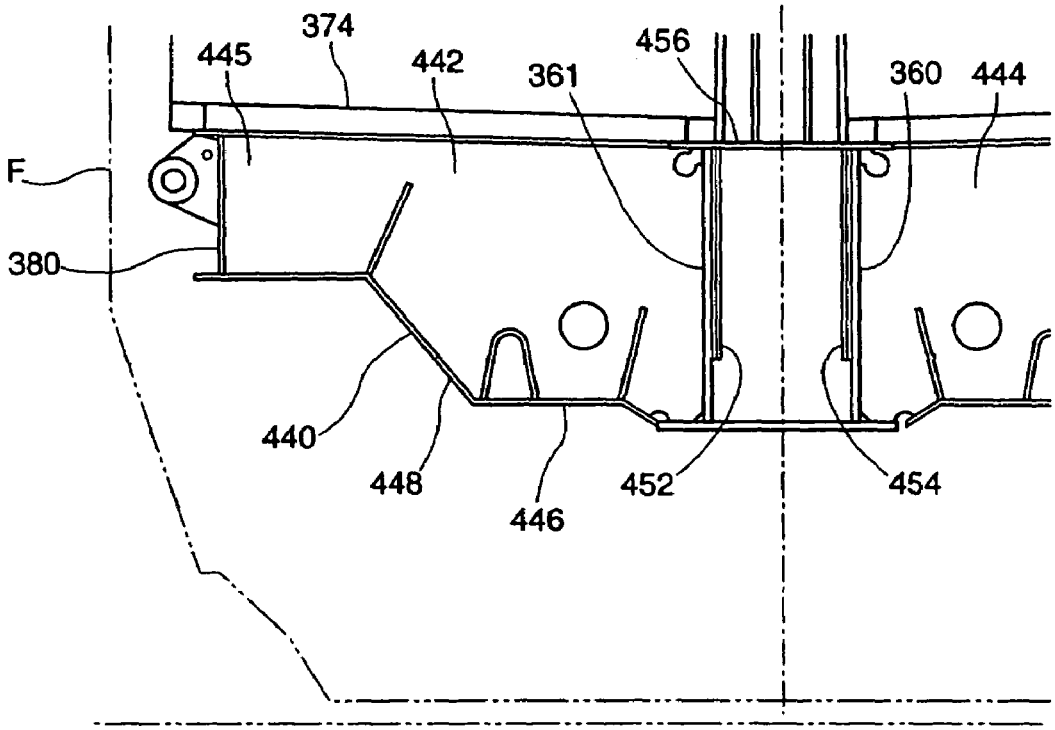
FIG. 6*c* shows an enlarged detail of FIG. 5*c;*
Figure 6D:
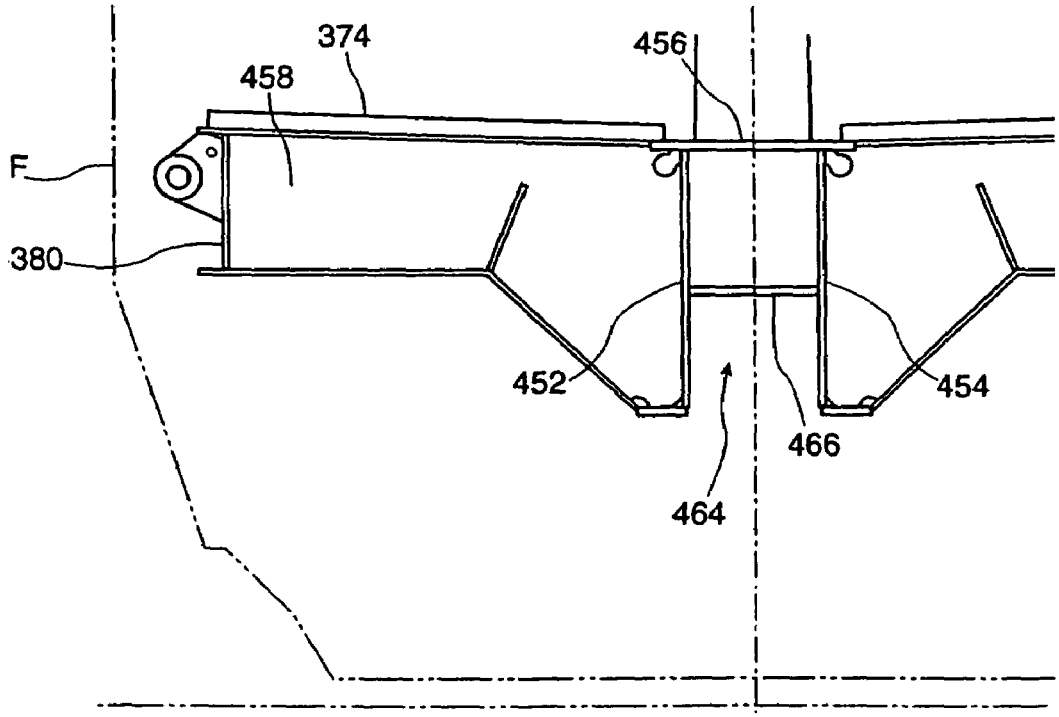
FIG. 6*d* shows an enlarged detail of FIG. 5*d;*
Figure 6E:
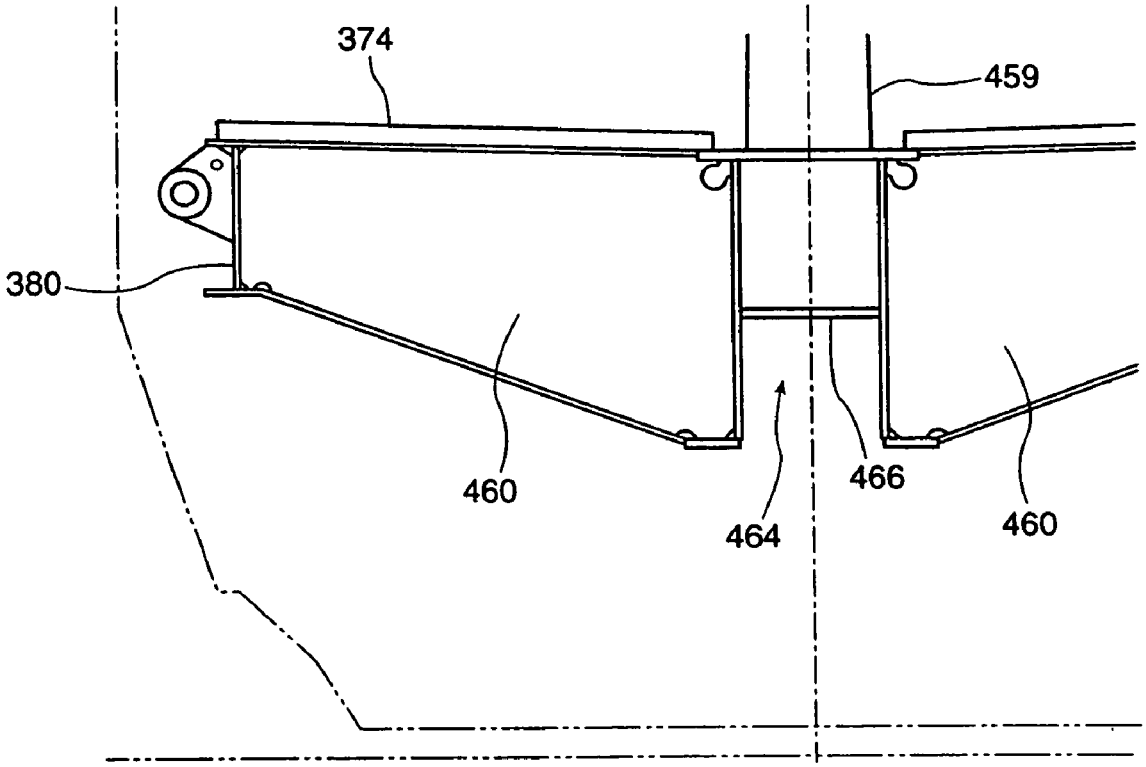
FIG. 6*e* shows an enlarged detail of FIG. 5*e;*

FIGS. 5d and 6d show the penultimate cross-bearer 458 located at the longitudinal station between upright post 459 and main bolster 440. A coupler pocket 464 is formed by welding a lower web 466 between plates 452 and 454. Pocket 468, and smoothly tapered cross member 460 are shown in FIG. 5e.

In the one embodiment, car 70 has a well deck portion that is 40 ft-6 in. long. The internal lading height of the well, that is, the nominal loading height of the bunk defined between the medial decking portion load bearing interface and the wings 65, 67 (FIG. 7a) of top truss 64 is 165 inches. As such, the height of top truss 64 from TOR, at roughly 16 ft-7 in., significantly exceeds the AAR Plate C maximum allowable height of ft-6 in. The upper flange of main sill 36 is carried at a height, relative to TOR, that is high enough to permit the top surface of the coupler to fit within main center sill 36 as in a socket. The centerline coupler height is 34½ inches above TOR. For a Plate F car, the height of the top of the coupler head is roughly 40¾ inches above TOR for a car, as new, with un-worn wheels, unloaded. Thus the top surface height of a ¾" thick main center sill top flange is roughly 41-½ inches above TOR. In the case of the staging, or false floor structures described above, the level of the false floor sheeting and hence of all points on the associated tapered risers, is above the level of the top flange 102 of main center sill 36, that is, at a level that is at least 42 inches from TOR. In the preferred embodiment of FIG. 3a, this height, taken at the truck centers, for a new car with no lading and un-worn wheels, is 12-½ inches above the level of the main sill, or roughly 53-½ inches above TOR (+/−1 inch). Further, when loaded with 51 inch wide bundles of kiln dried softwood of a density of 1740 lbs per 1000 board feet, the fully loaded center of gravity of car 70 does not exceed 98 inches above TOR, that is, the center of gravity falls within a range whose upper limit is 98 inches. Lesser volumes of higher density lumber up to 2000 Lbs. per 1000 board feet can also be carried.

Although a 40 ft., 6 in. medial deck, or well deck, is preferred, a shorter well deck could be employed, such as 28 ft. 6 in., 32 ft. 6 in., or 36 ft. 6 in., it being advantageous that the well deck be at least 28 ft. long.

Each of center beam cars 20, 70, 83, 85, 90, 92 and 94 and 350 has an array of center beam web posts, indicated generally as 54 in the context of FIG. 1. Each of these arrays includes fabricated posts, having a generally H-shaped cross-section, and roll formed posts having a generally C-shaped cross-section. In the embodiments of FIGS. 2a, 2b, 2c, 2d, 2e, 2f, 3a, 3b and 3c, while all of these posts are rooted to main center sill 36, the posts mounted on the end portions of the respective railcars are formed to meld with main sill extensions, such as gussets 192 and 194, (both FIG. 3a).

Other than as described above in the context of FIGS. 3a, 3b, 3c and 3d, a description of post 73 will serve also to describe the other posts having H-shaped cross-section in the various embodiments of rail road cars described herein. Similarly, a description of post 74 will serve to describe the other posts having C-shaped cross-sections in the various embodiments Each of posts 73 has a central web 494 lying in a vertical plane perpendicular to the plane 24 of car 20 or car 70, 83, 85, 90, 92, 94, or 350. Web 494 is tapered from a wide bottom adjacent main center sill 36 to a narrow top. At the outboard extremities of web 494 there are left and right hand flanges 496 and 498 (FIG. 7a) that each lie in a longitudinal plane inclined at an angle $\alpha$ defined (from the vertical) by the slope of the taper of web 494. At the top of each post 73, 74 web 494 has been trimmed back to a pair of tabs 500, 502 at the ends of flanges 496, 498. This yields a seat, socket, relief, or rebate in the nature of a generally U-shaped notch or slot 504 into which top chord assembly 62 can seat.

A horizontal cross-section of post 73 will generally have an H-shape, with web 494 lying centrally relative to flanges 496 and 498. Post 74, by contrast, although tapered in a similar manner to post 474, has a horizontal cross-section of a U-shaped channel, with its web being the back of the U, and the flanges being a pair of legs extending away from the back. Each diagonal member 58 (or 59 or struts 77, 78 or braces 79, 80, 81, 82, 87, 88) has a first end rooted at a lower lug 97 welded at the juncture base of one of posts 73 adjacent to the juncture of post 73 with main center sill 36, and a second diagonal end rooted in an upper lug 99 at the juncture of another adjacent post 73 and top chord assembly 62. Midway along its length, diagonal beam 58 (or 59 or struts 77, 78 or braces 79, 80, 81, 82, 87, 88) passes through post 74 intermediate the pair of posts 73 to which diagonal 58 (or 59 or struts 77, 78 or braces 79, 80, 81, 82, 87, 88) is mounted. It is intended that the respective flanges of the various posts 73 and 74 lie in the same planes on either side of the central plane 24 of car 20 (or 70, 83, 85, 90, 92, 94, 350) to present an aligned set of bearing surfaces against which lading can be placed.

The incline of flanges 496, 498 is roughly at right angles to the inward taper of risers 48. This permits generally square cornered bundles to be stacked neatly in the clearance opening of the bunk defined between the underside of the top truss 64 and risers 48.

Figure 7B:
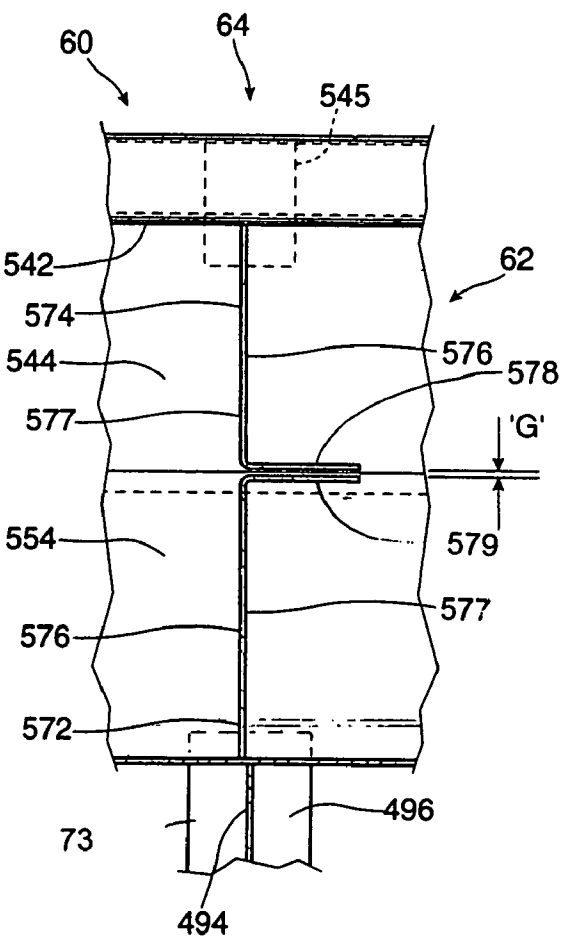
FIG. 7*b* shows a side sectional view of the detail of FIG. 7*a;*
Figure 7A:
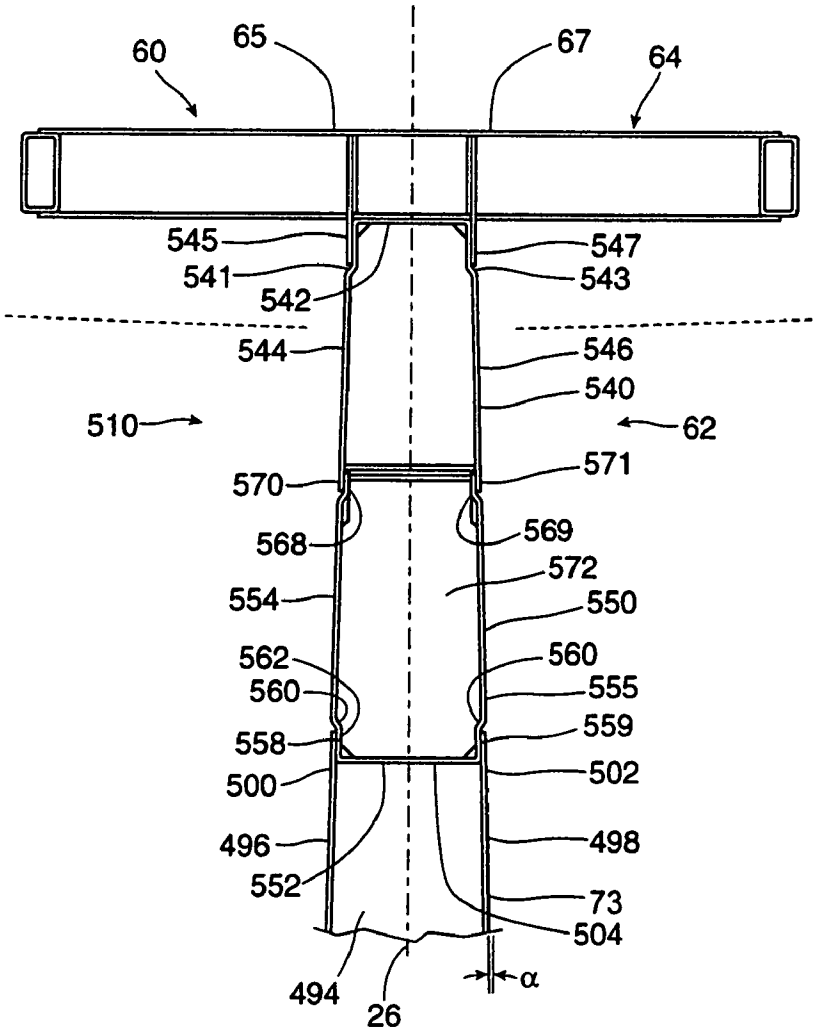
FIG. 7*a* shows a detail of the upper beam structure of the car of FIG. 2*a;*

In the embodiment of FIGS. 7a and 7b, upper beam assembly 510 can be defined as the combination of top chord assembly 62 and top truss 64. It has a cross section in the shape, generally, of a 'T', with the cross-bar of the T being defined by wings 65 and 67 of top truss 64, and the stem of the 'T' being defined by top chord assembly 62, described more fully below.

Straps 136 (FIG. 4a) are provided to attach to the outboard, distal extremities of wings 65 and 67 of top truss 64, to be wrapped outboard of the load, and to be tightened by a come-along, a winch, a pawl-and-ratchet type of mechanism, noted above as 138, or similar tightening device mounted to the respective side sill 42 or 44. An operator turns mechanism 138 with the aid of an extension bar or handle (not shown). When tightened, straps 136 bear against the outboard, upper corners of bundles indicated as 137, tending to force their inboard, upper regions, indicated generally as 518, most tightly against the upright center beam web structure of the railroad car that extends along plane of symmetry 24, namely array 54 and the outer shank, or skirt, of the stem of upper beam assembly 60.

The embodiment illustrated in FIGS. 7*a* and 7*b* has an inside loading clearance indicated as 'A' of 169⅜ inches perpendicular to risers 48. It also has a loading limit indicated as 'B' extending perpendicular to the slope of web 74, at a height 163½ inches above, and measured perpendicular to, risers 48. The nominal load height is then 165 inches for 5 bundles at 33 inches each, including dunnage. The nominal load height, in general, for 31-½ inch bundles of kiln dried lumber is thus the largest integer multiple of 33 inches that is less than the load limit height. In the illustrations of FIGS. 7*a* and 7*b*, 4*a* and 4*b*, this loading limit permits 51 inch wide bundles to fall within the loading envelope defined by AAR plate 'F'.

Deep beam section 510 is shown in cross-section in FIG. 7*a*. It includes a first, or upper formed section 540 in the shape of an inverted U, having a back 542 and left and right hand legs 544, 546. Legs 544, 546 are splayed outwardly relative to the vertical at angle $\alpha$ to match the angle of the taper of the flanges of posts 73 and 74. Upper formed section 540 also has inwardly stepped shoulders 541 and 543 to accommodate the mating ears of gusset plates 545 and 547 which join top truss 64 to top chord assembly 62. Deep beam section 510 also includes a second formed section 550 that is generally U-shaped, having a back 552, and a pair of left and right hand legs 554 and 555. Legs 554 and 555 each have a proximal region 558, 559 relative to back 552 that is stepped inwardly to form a shoulder to 560 and a neck 562 of a size to nest between tabs 500, 502 of post 73 or 74, as the case may be. Tabs 500, 502 are formed by trimming web 494 to conform to the depth of shoulder 560. Legs 554, 555 also each have an inwardly stepped toe 568, 569 stepped inward a distance equal to the wall thickness of legs 554, 555 such that toes 570, 571 of legs 544, 546 of member 540 can overlap, and seat outside of, outside toes 568, 569 respectively, and be fillet welded in place. Legs 554 and 555 are angled inward to yield slope continuity with both legs 544 and 546 and also with flanges 496 and 498 of post 73 (or corresponding flanges of posts 74 as may be). That is, legs 554, 555 are toed inward at the same angle from the vertical at which legs 544, 546 are splayed outward so that the exterior surfaces are flush with, and lying in the planes of, the respective flanges of posts 73 and 74. The exterior surfaces so defined can be termed skirts.

Gussets 572 and 574 are welded inside formed section 550 and 540 respectively at longitudinal stations along the length of car 20, (or 70, 83, 85, 90, 92, 94, 350) corresponding to the various longitudinal stations of the webs of posts 73 and 74 respectively, thus providing a substantially continuous web from main sill 36 to top truss 64.

There is, however, a web discontinuity between gusset 572 and gusset 574 indicated by gap 'G', seen in FIG. 7*b*. In light of this discontinuity, gussets 572 and 574 have main web legs 576, 577 that, when installed, lies in the vertical plane of web 494 and a toe 578, 579 extending at a right angle therefrom, lying in a horizontal plane. The lateral edges of toes 578 and 579 are welded along the inside faces of toes 568, 569 and 570, 571 respectively and extend a distance comparable to the width between the respective toes at that point. In the preferred embodiment the overall height of top chord assembly 62 is 27 inches, with ¼ inch wall thickness on legs 544, 546, 554 and 555. In the preferred embodiment the length of legs 544, 546 is 13½ inches, and the overall length of legs 554, 555 is 14½ inches. Nominally, shoulder 560 overlaps tabs 500 and 502 by 2 inches. That is, tabs 500, 502 extend 2 inches beyond web 494. Toes 578 and 579 are both 6 inches long, and the nominal width of gap 'G' is about 6¾ inches.

In this way, when assembled, legs 554, 555 and 544, 546 form respective left and right hand outwardly facing bearing surfaces against which a load may bear, and over which a reaction force to tension in the tightening straps can be spread. In the span between the stations of adjacent posts (whether 73 or 74), the skirts, or bearing surfaces, formed in this way are reinforced by the laterally inward web, (that is, back 552) which connects both skirts (that is, legs 544 and 554, and legs 546 and 555). The laterally inward reinforcement need not be immediately behind the respective skirt or facing, but rather can be offset, as illustrated in FIG. 7*a*, with the influence of the web stiffening the face some distance away. The web is "inward" of the skirts in the sense of lying behind, or shy of, the profile of the contact interface with the wood bundles, since the reinforcement lies toward the centerline of the rail car, rather than proud of, the respective skirt faces. In this way an inwardly disposed stiffener will not protrude and rub against an object bearing against the outwardly facing surface of the respective skirt.

Figures 8A, 8B:
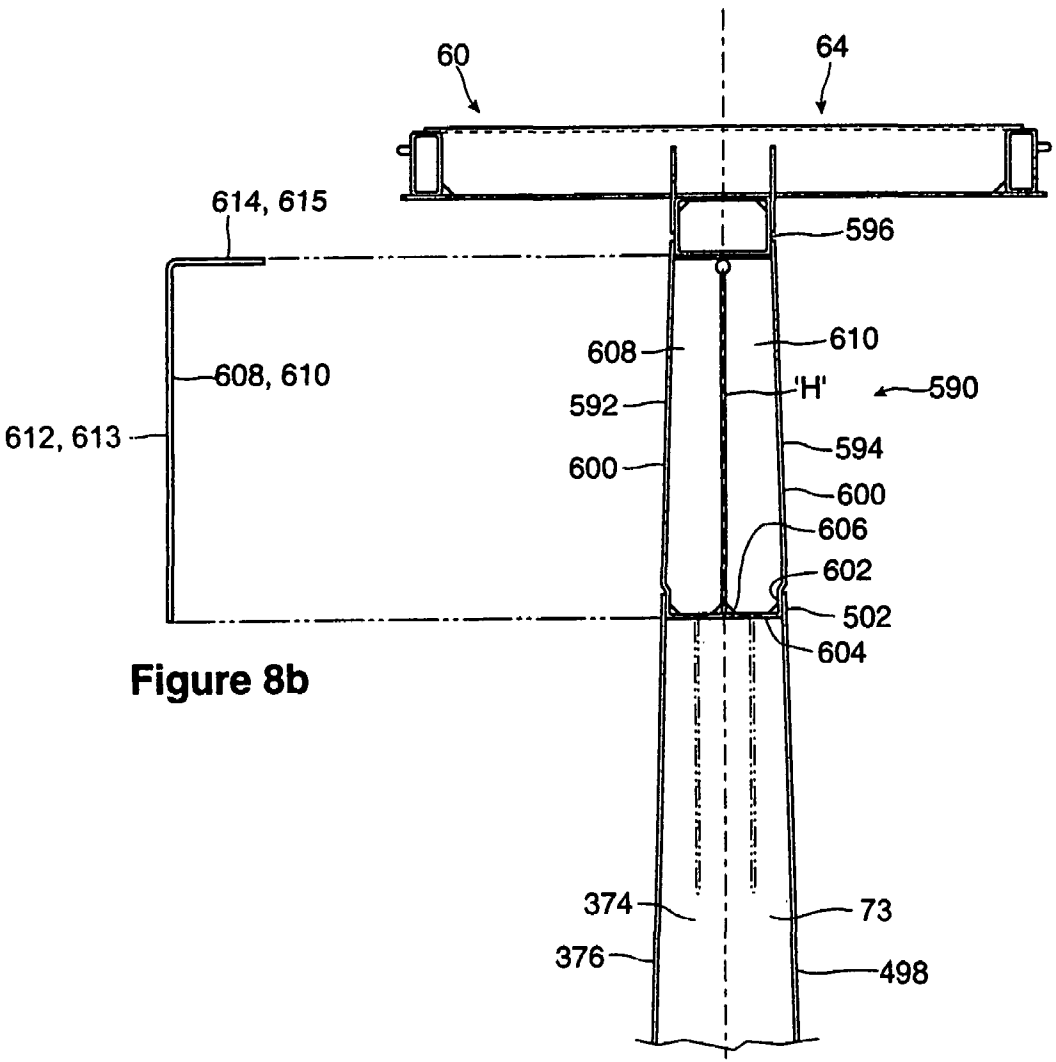
FIG. 8*a* shows an alternate detail to that of FIG. 7*a;*
FIG. 8*b* shows a side sectional view of the detail of FIG. 8*a;*

In an alternative embodiment shown in FIGS. 8*a* and 8*b*, a deep beam section 590 has a pair of left and right hand formed sections 592, 594 surmounted by a rectangular tube 596, upon which top truss 64 is mounted. Each of sections 592, 594 has a main sheet 600, an inwardly stepped shoulder 602, an inwardly extending leg 604 and an upturned toe 606. In place of gussets 572 and 574, section 590 has gussets 608, 610 having a main, vertical leg 612, 613 and a horizontal leg 614, 615. Vertical legs 612, 613 are contoured to match the inside wall shape of formed sections 592, 594 respectively, and are located at longitudinal stations to correspond to the longitudinal stations of the webs of posts 73 and 74 as above. Vertical legs 612, 613 are separated by a vertically extending gap having a width 'H'. Once gussets 608, 610 are welded in place, formed sections 592, 594 are welded along the seam where legs 604 of sections 592, 594 abut along the centerline of car 20 or 70, 83, 85, 90, 92, 94, 350. As above, the step in sections 592, 594 is of a size to seat between tabs 500 and 502 of posts 73, or 74, and the distal tips of main sheets 600 are fillet welded to the side faces of tube 596. As above, there is slope continuity between main sheets 600 and the corresponding flanges 496, 498.

Figure 9B:
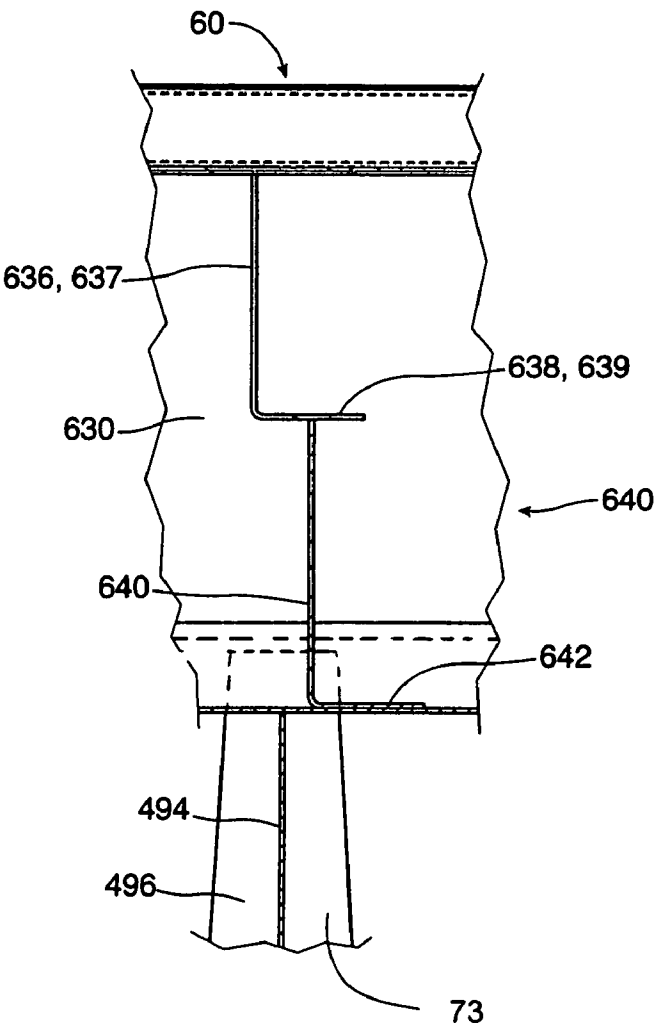
FIG. 9*b* shows a side sectional view of the detail of FIG. 9*a;*
Figure 9A:
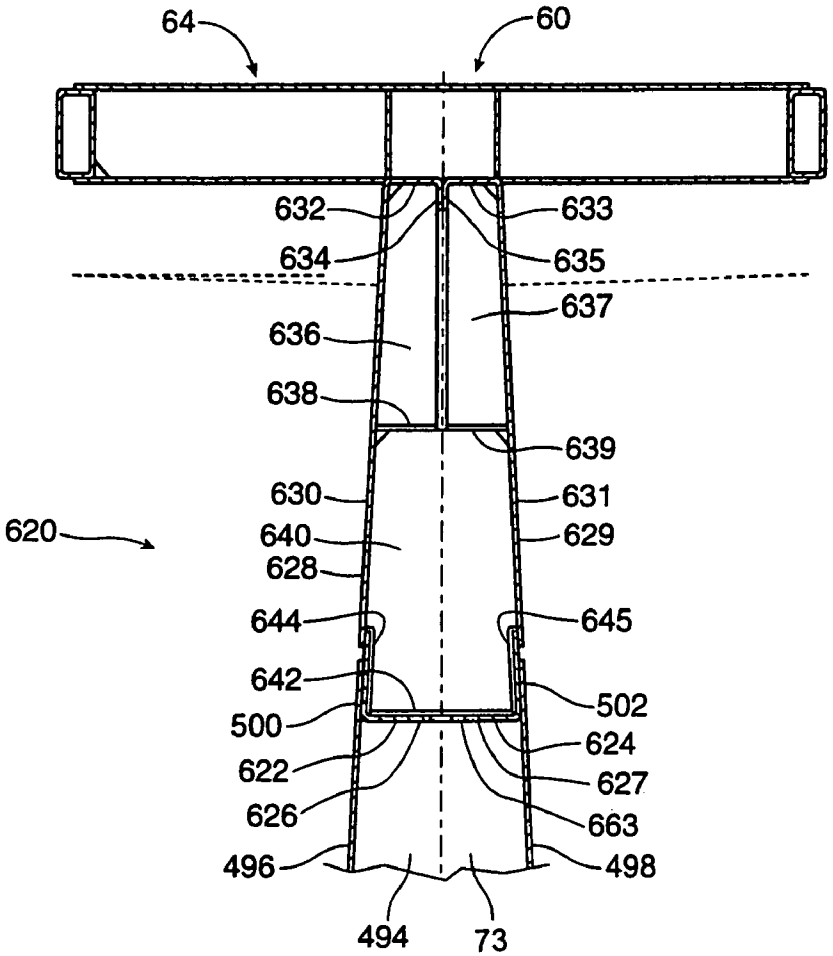
FIG. 9*a* shows an alternate detail to that of FIG. 7*a;*

In the alternative embodiment of FIGS. 9*a* and 9*b*, a deep upper beam assembly 620 has a pair of angle irons 622 and 624 welded longitudinally inside tabs 500 and 502 of posts 73 and 74. Angle irons 622 and 624 each have an inwardly extending toe 626, 627 which bottoms on the cut edge of web 494, and an upwardly extending leg bent to conform to the slope of flanges 496 and 498. Beam 620 also has a pair of left and right formed sections 628, 629 each having a main sheet portion 630, 631, an inwardly extending leg 632, 633 and a re-entrant toe 634, 635.

On assembly, L-shaped gussets 636, 637 are welded in each of sections 628, 629.

Gussets 636 and 637 each have a profile to match the inside profile of the upper regions of main sheet portions 630, 631, legs 632, 633 and toe 634, 635. The toes of gussets 636 and 637 are welded along their outboard edges to the inside face of main sheet portions 630, 631. Sections 628 and 629 are welded along the centerline seam between abutting toes 634 and 635. A further, main, gusset 640 is trimmed to a shape to permit welding of its top edge to the underside of the toes 638, 639 of gussets 636, 637, its side edges to the inner face of the lower regions of main sheet portions 630 and 631; once welded in this manner, the base leg 642 of gusset 640 can be welded to toes 626 and 627 of angle irons 622 and 624, with a plug weld formed to fill the longitudinal gap therebetween. Gusset 640 is also trimmed to have reliefs 644, 645 to permit entry between the upwardly extending legs of angle irons 622, 624. Gussets 636, 637 and 640 are located at longitudinal stations that correspond generally to the longitudinal stations of posts 56 and 57 as the case may be. Legs 632, 633 of sections 628, 629 form, ideally, a flat surface to weld to top truss assembly 64, as before. Similarly, when installed, main sheet portions 630, 631 have slope continuity with flanges 496 and 498.

Figure 10B:
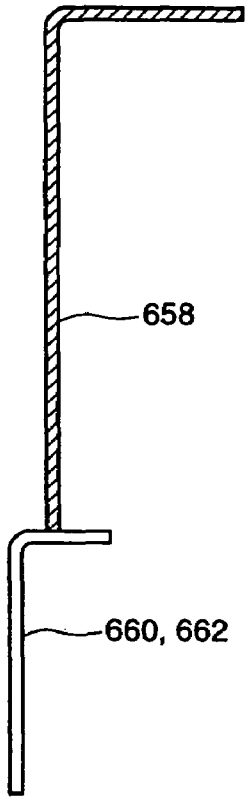
FIG. 10*b* shows a side sectional view of the detail of FIG. 10*a;*
Figure 10A:
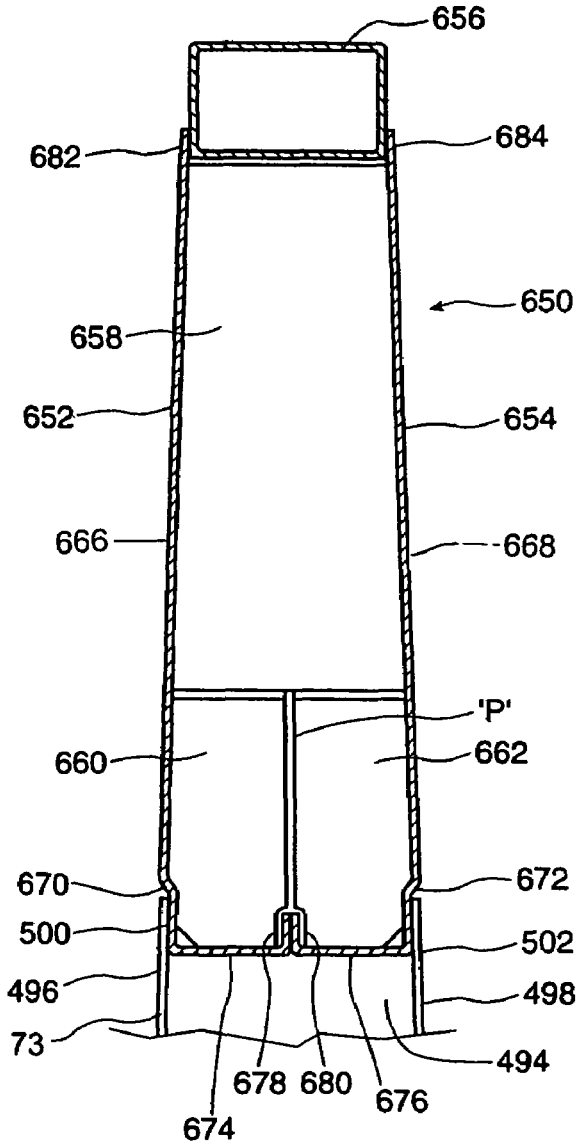
FIG. 10*a* shows an alternate detail to that of FIG. 7*a;*

In the alternative embodiment of FIGS. 10*a* and 10*b*, a deep upper beam 650 has a pair of formed sections 652, 654, a rectangular steel tube 656, a main gusset 658 and minor gussets 660 and 662. On assembly, minor gussets 660 and 662 are welded inside the lower regions of formed section 652 and 654, being shaped to conform to the shape of the lower region of outer main sheets 666, 668, inwardly stepped shoulder 670, 672, and inwardly extending legs 674, 676. A gap 'P' is left between the respective inboard edges of gussets 660 and 662, and their outboard edges are welded to the inner face of main sheets 666, 668. Gussets 660, 662 are trimmed to be clear of re-entrant toes 678, 680. Main gusset 658 is welded upon minor gussets 660, 662, with its lateral edges welded to the inside face of main sheets 652 and 654. Tabs 682, 684 at the distal ends of main sheets 666, 668 embrace the outer side faces of steel tube 652.

Figures 11A, 11B:
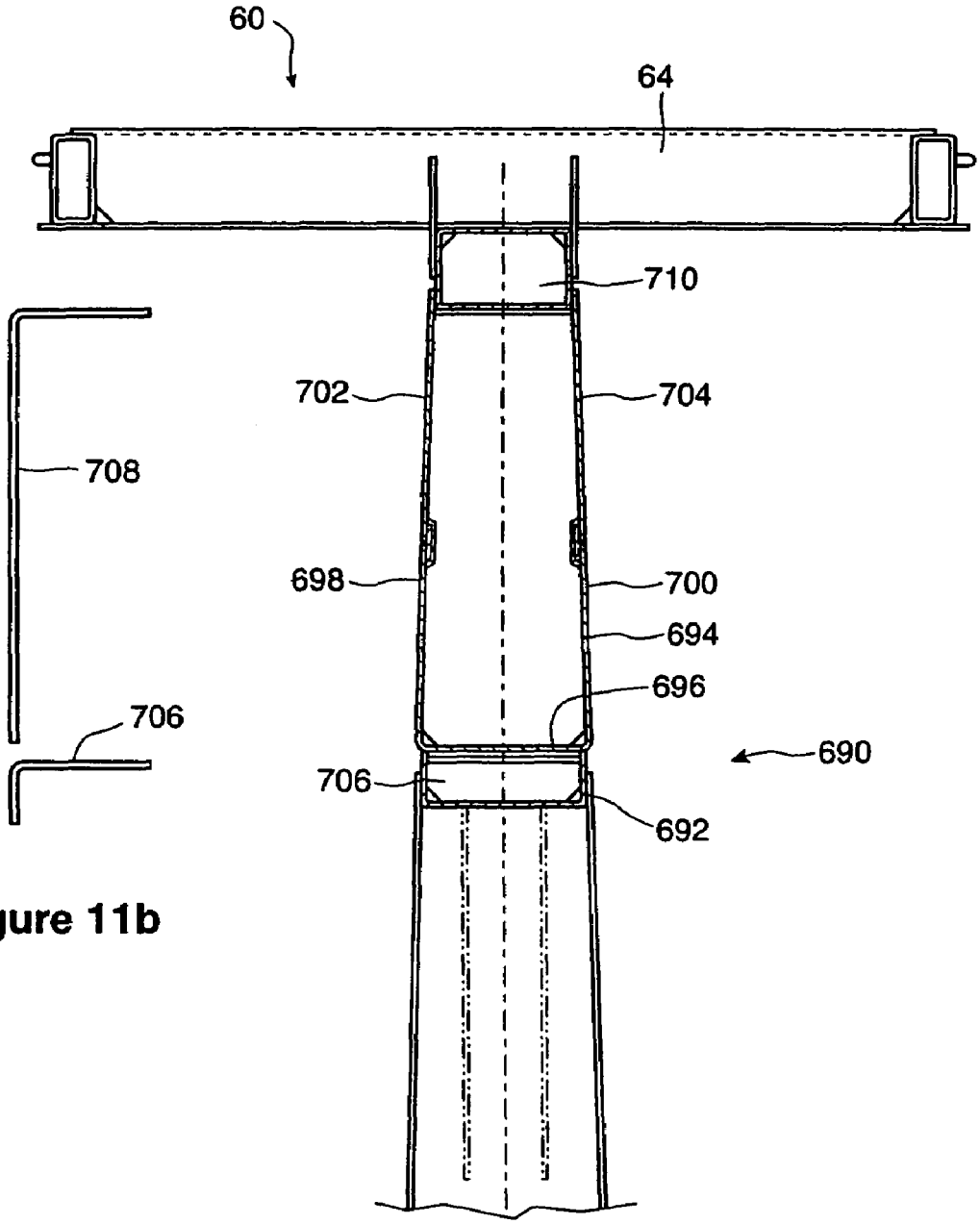
FIG. 11*a* shows an alternate detail to that of FIG. 7*a;*
FIG. 11*b* shows a side sectional view of the detail of FIG. 11*a;*

In the alternative embodiment of FIGS. 11*a* and 11*b*, a deep upper beam assembly 690 has a longitudinally extending inverted C-channel 692 upon which is welded a generally U-shaped formed section 694 having a back 696 and upwardly extending legs 698, 700 bent to lie on the slopes of the flanges of posts 73 and 74, as above. The distal ends of legs 698 and 700 abut the lower edges of a pair of skirt plates 702 and 704. A weld is formed along the abutting edges of the legs and skirts. At their furthest ends, skirt plates 702, 704 are welded to the outside faces of a steel tube 710. Top truss assembly 64 surmounts assembly 690. Minor gussets 706 are welded inside C-channel 692 at the longitudinal stations of posts 56 and 57, as above, and gussets 708 are welded inside legs 698, 700 and plates 702, 704 thereby providing a form to define the angular profile upon which they lie. As before, that profile is such as to yield a surface lying flush with the outer surfaces of posts 73 and 74.

Figures 12A, 12B:
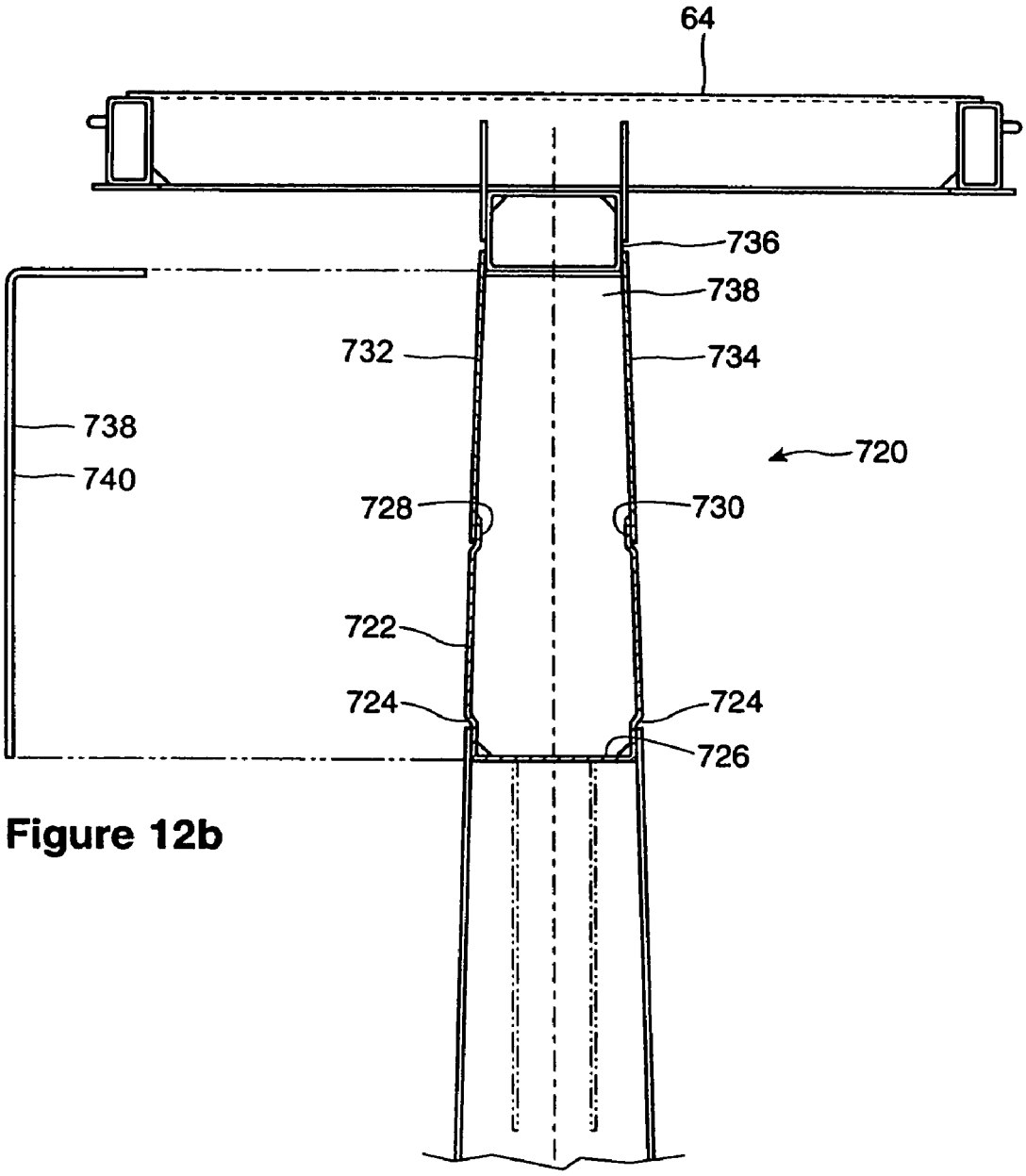
FIG. 12*a* shows an alternate detail to that of FIG. 7*a;*
FIG. 12*b* shows a side sectional view of the detail of FIG. 12*a;*

The alternate embodiment of deep beam 720 of FIGS. 12*a* and 12*b* is similar to that of FIGS. 11*a* and 11*b*, but differs insofar as C-channel 692 and formed section 694 have been combined into a singular formed section 722 having inwardly stepped shoulders 724 to yield a plug shaped head 726, similar to that described in the context of FIG. 7*a*. Further, rather than straight legs 698 and 700, formed section 722 has inwardly stepped toes 728 and 730, again, similar to those shown in FIG. 7*a*. Skirt plates 732 and 734, similar to skirt plates 702 and 704, again extend between toes 728 and 730 to terminate on the outer side faces of a rectangular steel tube 736.

In this instance a large gusset 738 is welded inside section 722, and plates 732 and 734. Gusset 738 has a vertical leg 740 having a profile cut to yield the desired slope continuity with the flanges of posts 73 and 74.

Figure 13:
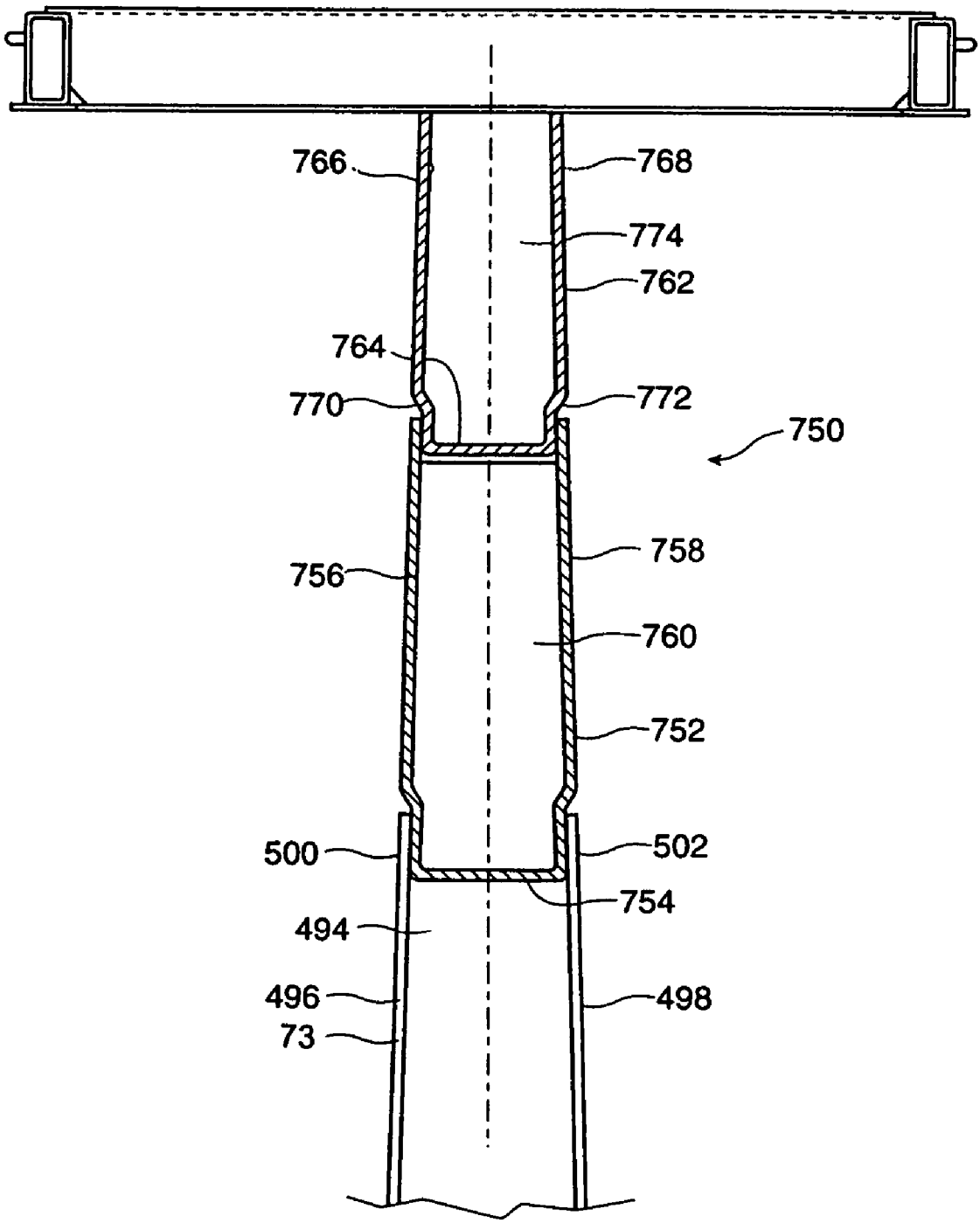
FIG. 13 shows an alternate detail to that of FIG. 7*a;*

The alternate embodiment of deep beam 750 of FIG. 13 is similar to that of FIG. 11*a*. However, as in FIG. 12*a*, C-channel 692 and formed section 694 have been supplanted by a single formed section 752 having a back 754, a pair of legs 756, 758 having inwardly stepped shoulders and a pair of distal toes. A gusset 760 is mounted within formed section 752 at each of the longitudinal stations of car 20 corresponding to the longitudinal stations of the webs of posts 73 and 74, as described above. However, gussets 760 terminate in a horizontal leg lying shy of the tips of the distal toes of legs 758 and 756 such that another formed section 762 can seat between them. Formed section 762 has a back 764, legs 766, 768 and shoulders 770, 772. An internal stiffener in the nature of a gusset 774 is located at each of the longitudinal post stations. Back 764 provides a horizontal web sufficiently close to top truss assembly 64 that no rectangular steel tube is employed. As before, the outer faces of legs 766, 768 and legs 758, 756 are intended to lie in the same planes as the flanges of posts 73 and 74. The external faces of each of formed sections 752 and 762 each extend about a foot in depth, relative to top truss assembly 64, and present, more or less, a 2 foot wide skirt, or band, that overlaps the load limit, and the maximum loading height.

Figure 14:
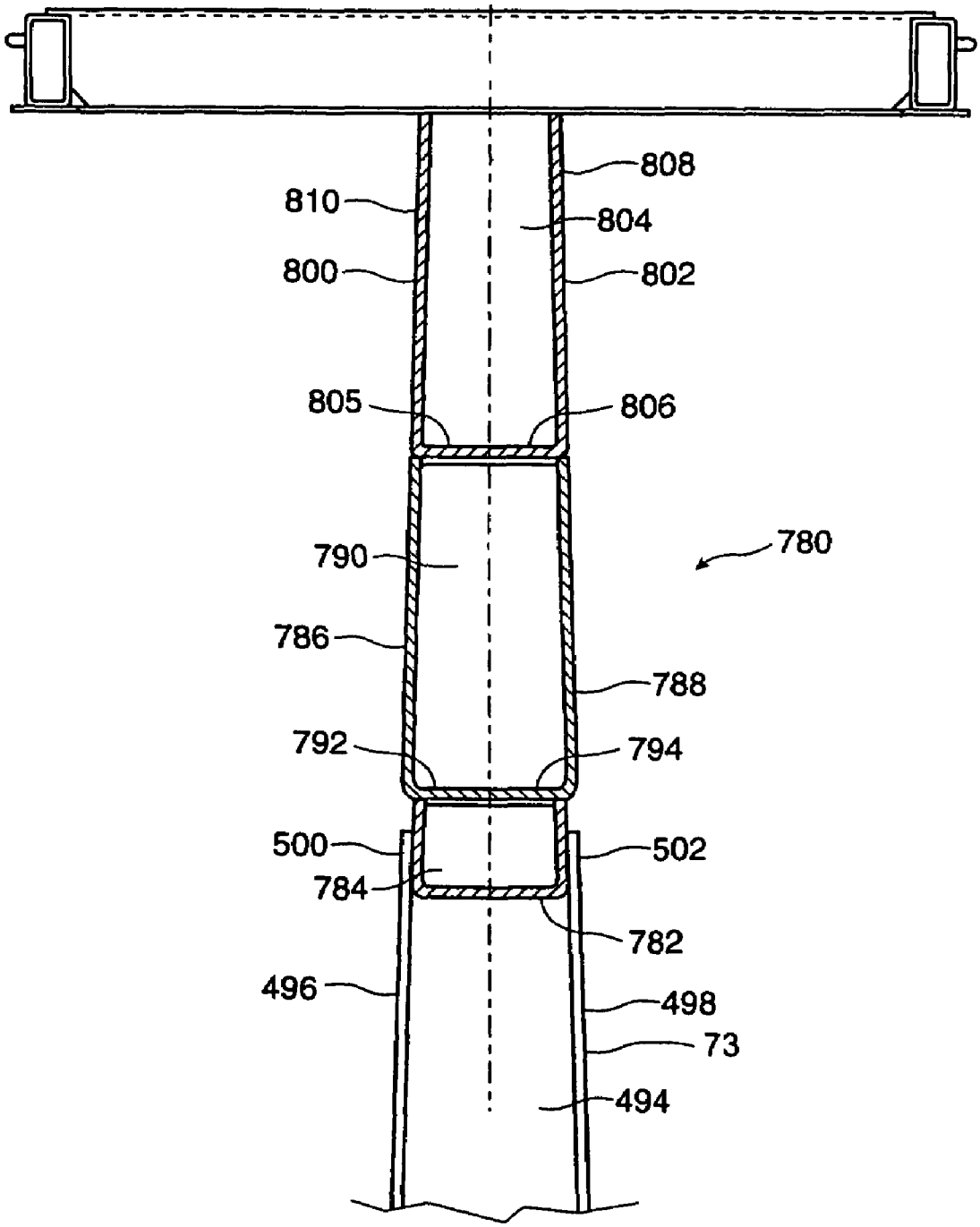
FIG. 14 shows an alternate detail to that of FIG. 7*a;*

In the embodiment of FIG. 14, a deep beam assembly 780 is generally similar to deep beam assembly 750, but rather than have step-shouldered formed sections it has a C-channel 782 for mounting between tabs 500 and 502 as in FIG. 11*a* above, with gussets 784 mounted as described in FIG. 11*a*. Above this is a first pair of angle irons 786, 788, bent to present outer faces lying on the desired slope of the flanges of posts 73 and 74 as the case may be. Formed angles 786, 788 are welded on a series of lateral gussets 790, again, at the longitudinal stations of vertical posts 73 and 74. Formed angles 786 and 788 are also butt welded to each other along the tips of their inwardly extending toes 792, 794. Another pair of angle irons 800, 802 are welded on an array of gussets 804, and along a butt welded seam at their inwardly extending toes 805, 806, and mounted above angle irons 786 and 788, as shown, such that their generally upwardly extending legs 808, 810, and the consequent skirt-like surface they present, lie flush with, and on the same slopes as, the respective flanges of posts 73 and 74.

Figures 15A, 15B:
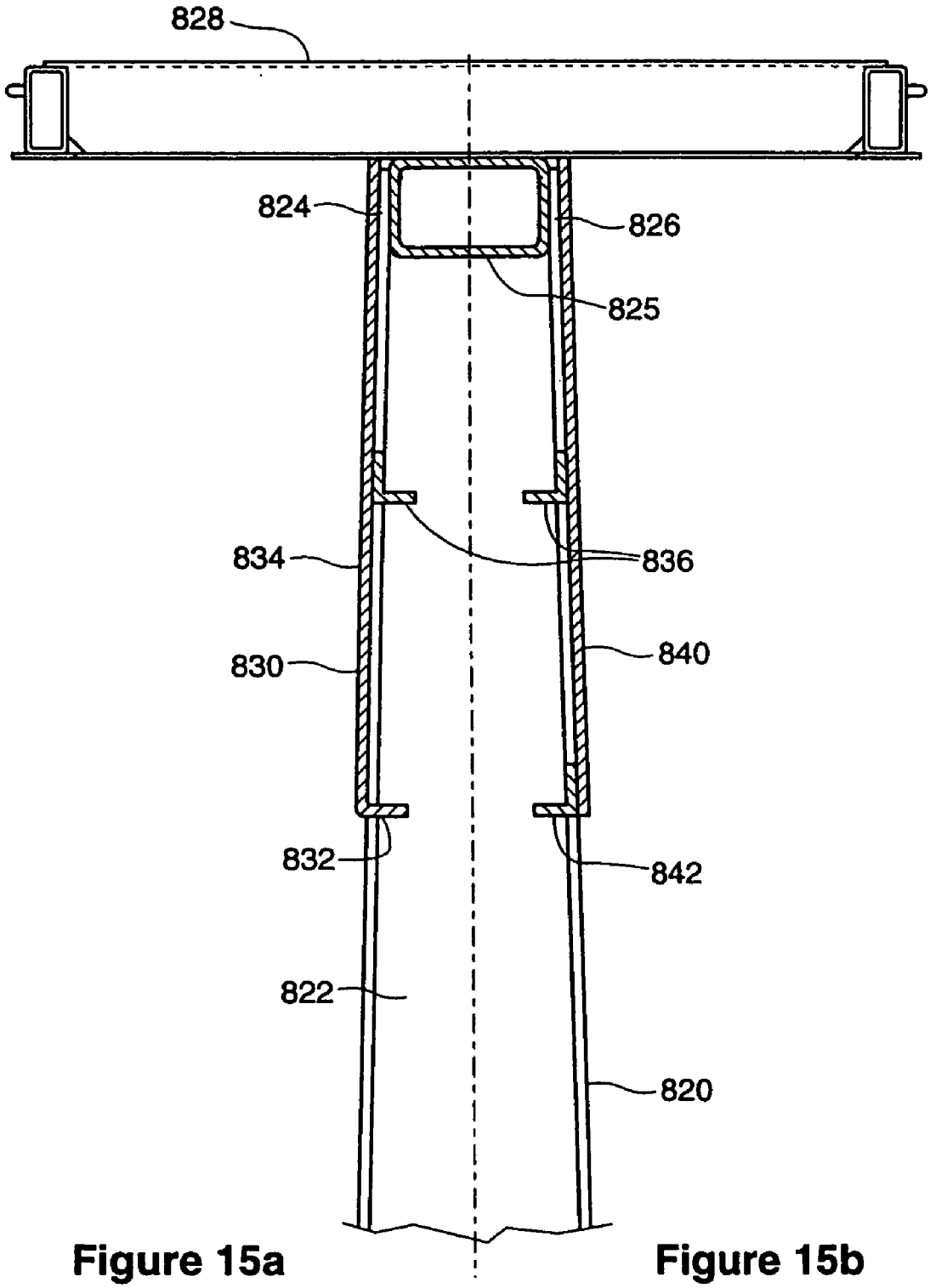
FIG. 15*a* shows an alternate detail to that of FIG. 7*a;*
FIG. 15*b* shows an alternate detail to that of FIG. 15*a;*

The embodiment of FIG. 15*a* shows a half view of a retro-fit installation. (As the section is symmetrical about the center line of the car, only one half is illustrated.) An existing center beam post is shown as 820. It has a web 822 trimmed down to leave tabs 824 and 826 which lie to either side of, and are welded to, a rectangular steel tube 825 upon which a top truss assembly 828 is mounted. A skirt panel 830 is formed with a stiffener in the nature of an inwardly bent toe 832. The length of main leg 834 is roughly 2 feet, such that its outer face overlaps both the maximum load height and the load limit height. Toe 832 is trimmed to accommodate the flanges of post 820 (analogous to posts 56 or 57). An additional reinforcement, or longitudinal stiffener, in the nature of angle 836 of a length to lie between successive posts 820, is welded to the inner face of main leg 834 at an intermediate level roughly halfway between top truss assembly 828 and toe 832. Angle 836 will tend to cause main leg 834 to resist lateral deflection between adjacent posts 820, thereby tending to maintain main leg 834 in a position to spread loads placed against it.

Panel 830 could be as thick as ½ or ⅝ inches. Although panel 830 is preferably a metal sheet welded to posts 820, a different fastening means, such as rivets, bolts or the like, could be used. A smooth steel face is preferred, but other metals, such as aluminum, could be used, or a suitable, rot resistant, UV resistant polymer could be selected, either as a solid sheet or as a face coating or layer, or sheet, upon a metal substrate. It is preferred that the material chosen be a non-consumable material, that is, one that may tend not to be prone to require frequent replacement such as may be required if softwood lumber battens are used, and also one that has little or no tendency to develop wood rot or to support the growth of molds Panel 830 need not be integrally formed with bent toe 832, but could be fabricated by using a flat sheet 840 as the external face plate, with an angle iron 842, or similar stiffener, welded along the inward facing bottom edge of the face plate between pairs of posts 820, as indicated in the other half view shown in FIG. 15*b*.

FIG. 15*c* is again a half section, showing a hollow cell panel 844 in place of panel 830. Hollow cell panel 844 has an external skin 846, an internal skin 848, and an intermediate hollow cell core 847 for carrying shear between skins 846 and 848. The hollow cells usually have a hexagonal columnar shape, the columns running perpendicular to the skins. The thickness of hollow cell panel 844 has been exaggerated for the purposes of illustration. Although skins 846 and 848 may be made of steel, they may also be made of other substances, such as structural polymers, reinforced polymers, aluminum, or other suitable material.

FIG. 15*d* is similar to FIG. 15*c*, but web 850 of post 852 has been trimmed back to permit outwardly facing external face 854 of hollow cell panel 856 to lie flush with flange 858 of post 852. Hollow cell panel 856 is similar in construction to hollow cell panel 844, having a pair of skins and a hollow core.

FIGS. 15*e* and 15*f* correspond to FIGS. 15*c* and 15*d* respectively, and illustrate the use of a corrugated core sandwich, either standing proud of the flange of the post, as illustrated by sandwich 849 in FIG. 15*e*, or flush with a trimmed down flange 851 as shown by sandwich 853 in FIG. 15*f*. The corrugated sandwiches have inner and outer metal skins, with a reverse folded, corrugated core maintaining the skins in a spaced apart, parallel planar relationship.

In each of the embodiments illustrated in FIGS. 15*a*, 15*b*, 15*c*, 15*d*, 15*e* and 15*f* the vertical extent of the skirt can be chosen according to the lading customarily carried by the car. As noted above, in general the skirt overlaps the nominal loading height, and extends a modest distance below the nominal loading height, whether 6 inches, 12 inches, 18 inches, 24 inches, 30 inches, or 36 inches. The skirt may also tend to overlap the maximum load limit height, and, further still, to be joined at a welded lap joint to the top chord, or top chord assembly.

Figure 16:
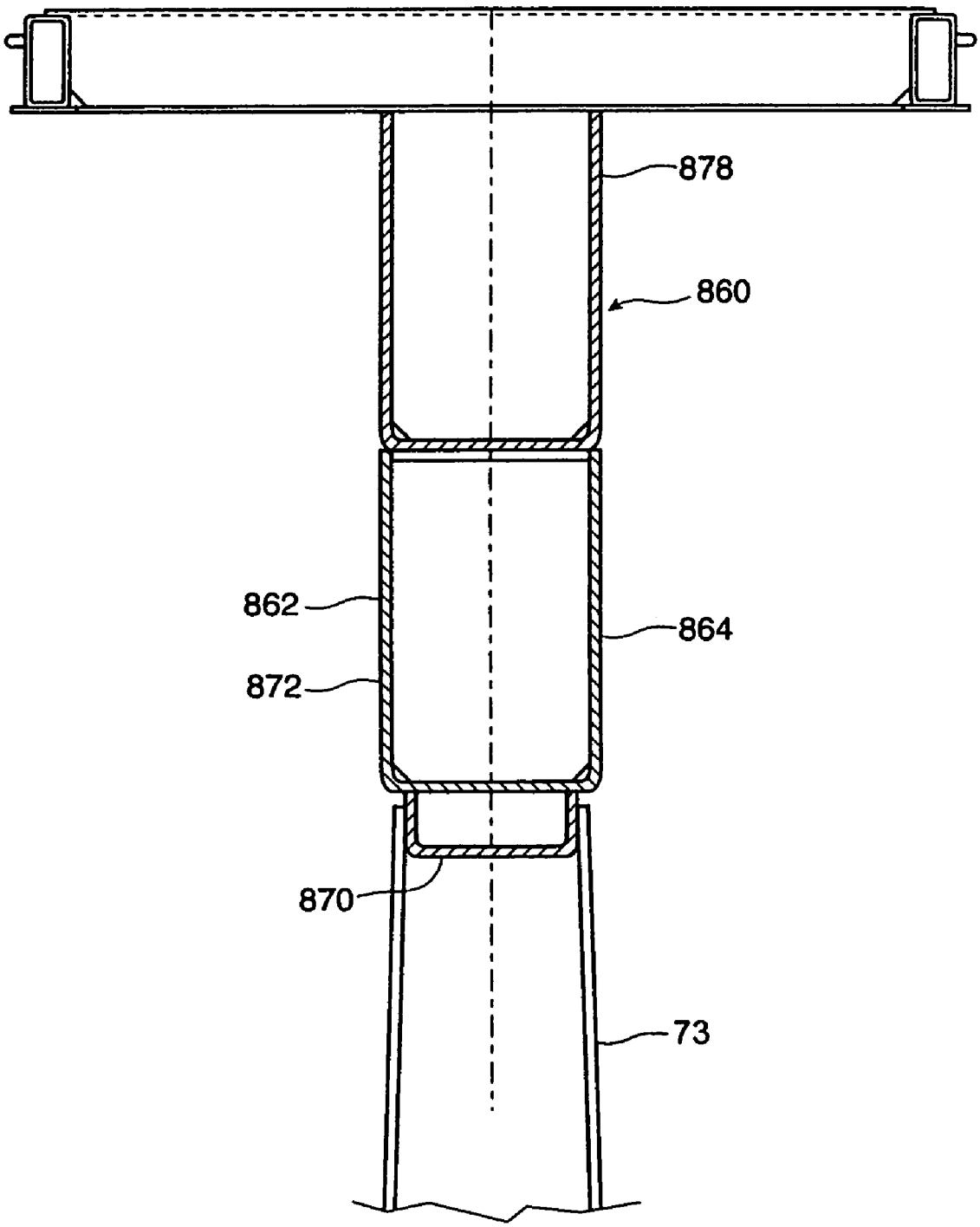
FIG. 16 shows an alternate detail to that of FIG. 7*a;*

The embodiment of FIG. 16 shows a deep beam assembly 860 that is similar to deep beam assembly 780 of FIG. 14 but does not have slope continuity with the flanges of posts 73 and 74. Rather, the sides 862 and 864 of deep beam assembly 860 are parallel, and rise generally vertically. A channel 870 is welded along the back of pressing 872 to engage the notch formed in the upper end of post 73 (or 74, as may be). A further U-shaped pressing 878 is welded above pressing 872.

Figure 17:
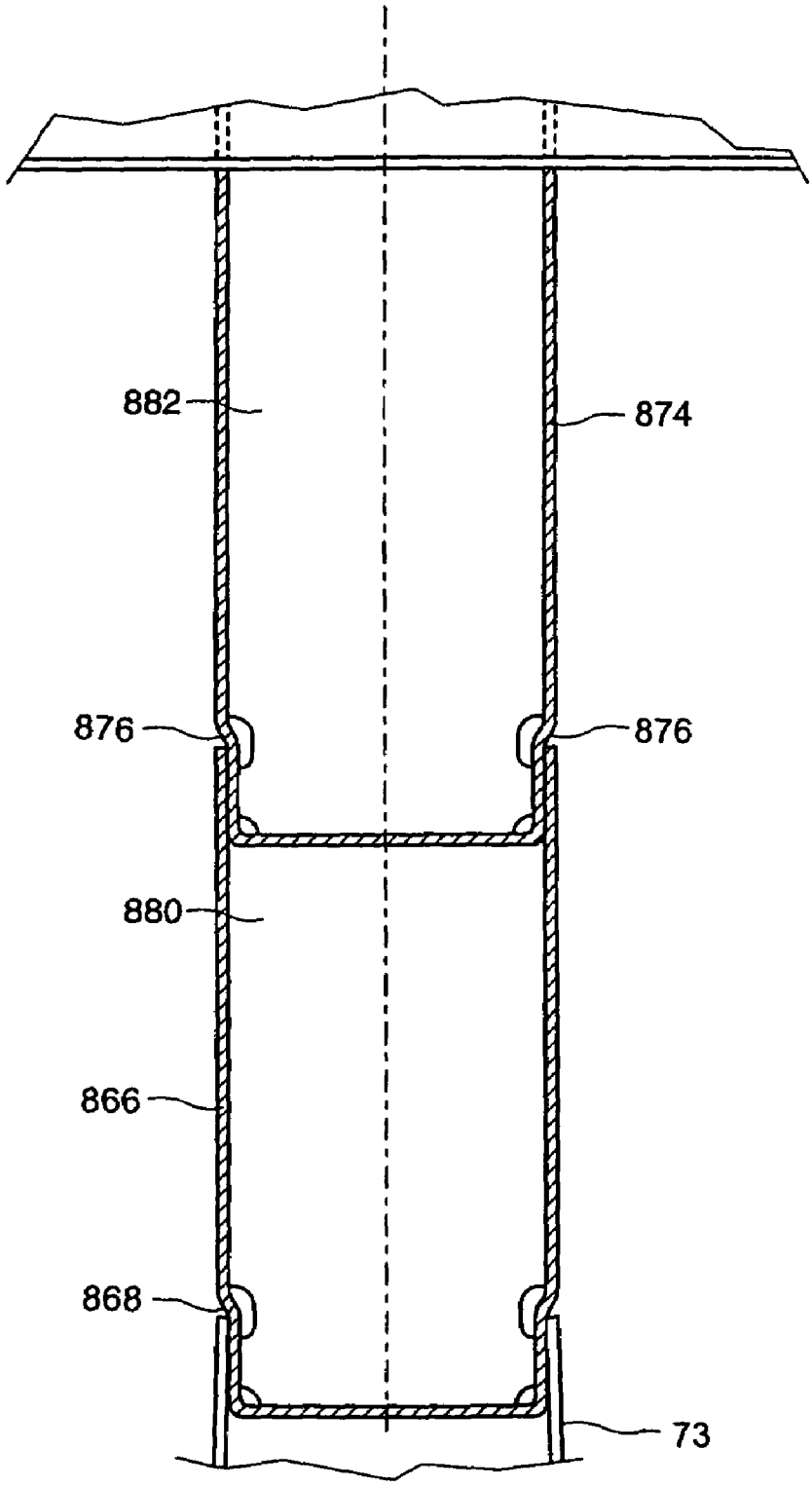
FIG. 17 shows an alternate detail to that of FIG. 7*a;*

The embodiment of FIG. 17 is similar to the embodiment of FIG. 16, except insofar as it has a single formed section 866 with shoulders 868 in lieu of a C-channel 870 and section 862. Similarly, its upper formed section 874 also has shoulders 876, in contrast to upper section 878 of assembly 860. Gussets are indicated as 880 and 882.

Figure 18:
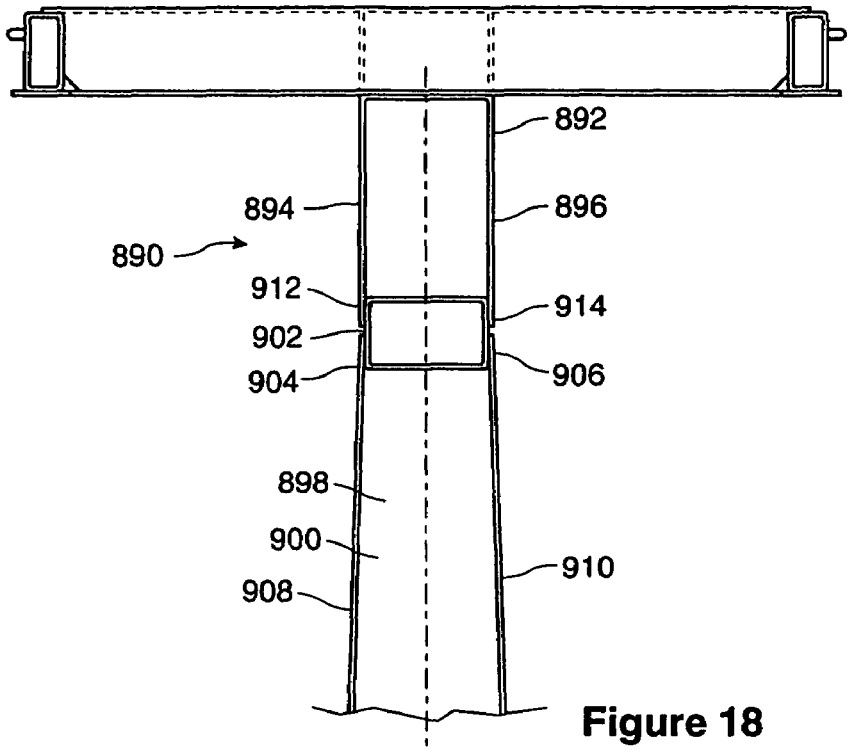
FIG. 18 shows an alternate detail to that of FIG. 7*a*.
Figure 19:
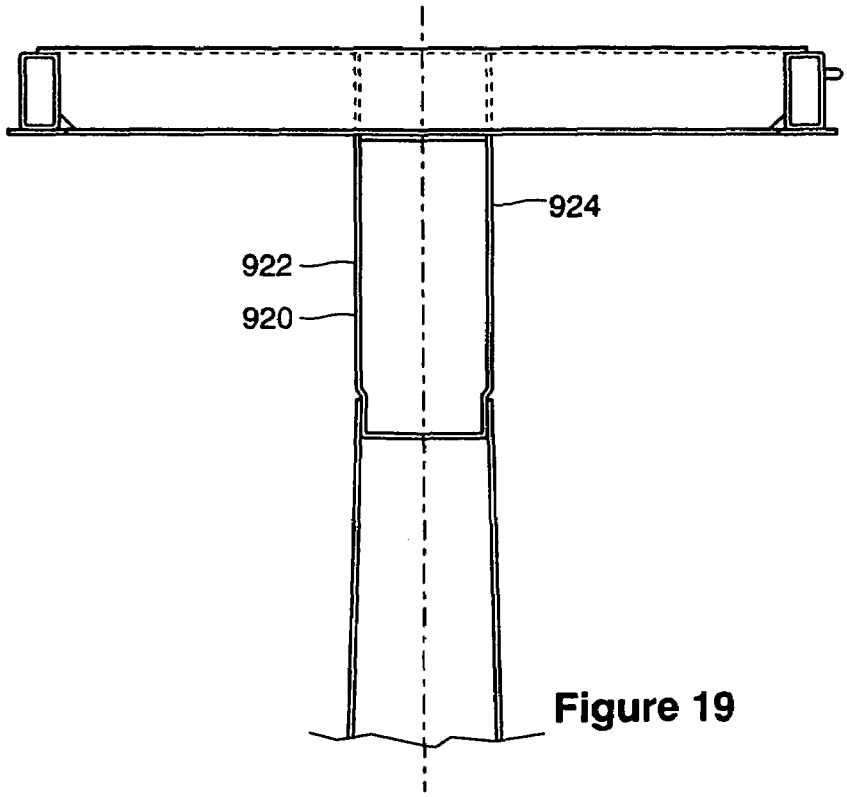
FIG. 19 shows an alternate detail to that of FIG. 7*a.*

In the embodiment of FIG. 18 deep beam assembly 890 has an inverted U-shaped formed section 892 having parallel legs 894, 896. A notch has been cut in web 898 of post 900 such that a longitudinally extending rectangular steel tube 902 can seat between tabs 904 and 906 of flanges 908 and 910. The distal tips 912 and 914 of legs 894 and 896 are welded along the side faces of tube 902. In the embodiment of FIG. 19 a formed section 920 is used in place of rectangular steel tube 902. In the cases of both FIG. 18 and FIG. 19, the overall depth of the side skirts defined by legs 894, 896 or 922, 924, is roughly half that of the embodiments of FIGS. 7*a*, 8*a*, 9*a*, 10*a*, and 11*a*, being roughly 1 ft. This width overlaps both the load limit height and the maximum load height.

In the embodiment of FIG. 2*f*, legs 544 and 546 extend from a root at the join to top truss 64, to a level below the upper load limit. Legs 544 and 546 are roughly 24 inches long so that the bottom edge of legs 544 and 554 will extend down roughly half the height of the top bundle to act as a skirt against which a larger bearing area of the bundle can bear, as compared to the width of the flanges of the posts by themselves. The skirt has a mid level reinforcement between its upper and lower extremities, namely web stiffener 504 to discourage lateral deflection of the skirt, or bowing inward.

In alternative embodiments, the level of the bottom edge of the legs could be as little as one board (1 and ½ inches, kiln dried wood) below the top edge of the design bundle height, but is expected to be most commonly 12 inches, 24 inches (as in the preferred embodiment) or 30 inches deep when measured from the join to the top truss.

It is possible to manufacture a generally similar center beam car to fall within the loading profile defined by AAR plate 'F', or some other height. In that case, the desired load limit height is the height that is the largest integer multiple of 33 that is less than the clearance opening. The minimum height of the bottom edge of the leg, or skirt, is desirably 1 and ½ inches or more below the nominal load height, typically such that the overall height of the skirt is, nominally, an integer multiple of 6 that is at least 12 inches. Preferably, the skirt extends to a height that is at least half way down the top bundle of the nominal design load, and possibly to a height that is the full depth of the top bundle.

Although the main deck could be a continuous decking structure, this need not necessarily be so. The main deck, or lower beam structure could be in the form of an open truss, or grid work. Car 20, and the other rail road cars described herein, are preferably of all-steel construction. However, although the web work assembly of the center beam, and the top truss section is preferably a welded steel fabricated structure, it could be made of aluminum.

Various embodiments of the invention have now been described in detail. Since changes in and or additions to the above-described best mode may be made without departing from the nature, spirit or scope of the invention, the invention is not to be limited to those details, but only by the appended claims.

I claim:

1. A center beam rail road car comprising:

a center beam car body mounted on a pair of first and second spaced apart rail car trucks, said body having a deck structure, a central upstanding web assembly running along said car, said web assembly extending upwardly of said deck structure, and an upper beam assembly surmounting said vertical web assembly;

said deck structure including first and second end decking portions mounted over said respective first and second trucks, and a medial decking portion lying between said trucks, said first and second end decking portions being stepped upwardly relative to said medial decking portion;

said center beam car body being selected from the group consisting of (a) a center beam car body in which said central upstanding web assembly includes an array of upwardly extending posts, said posts having a lower region adjacent said deck structure and an upper region adjacent said upper beam assembly; and a skirt member extending longitudinally between said upper regions of said posts, said skirt member having a laterally outwardly oriented face against which lading can seat, said face of said skirt member lying in a position chosen from the set of positions consisting of (i) a position flush with said posts and (ii) a position proud of said posts; said array of posts being free of any member obstructing said face, and (b) a center beam car body in which said central upstanding web assembly includes an array of upwardly extending posts, said posts having a lower region adjacent said deck structure, and an upper region adjacent said upper beam assembly, and said upper beam assembly has a lengthwise extending, laterally outwardly facing member against which lading can seat, said laterally outwardly facing member being mounted in a position that is chosen from the set of positions consisting of (i) flush with said posts; and (ii) proud of said posts; said array of posts being free of any member obstructing said outwardly facing member, wherein said car has a center sill, said deck structure being supported thereby;

said upper beam assembly includes a top truss and a beam stem, said top truss being mounted upon said beam stem and said beam stem being mounted to said upper region of said web assembly; and said beam stem includes said lengthwise extending, laterally outwardly facing member.

2. The center beam rail road car of claim 1 wherein said body has a bunk defined between said deck structure and said upper beam assembly, said bunk having a loading clearance height measured upwardly from said medial decking portion that is at least 165 inches.

3. The center beam rail road car of claim 1, wherein said upper region of said web assembly has at least one longitudinally extending skirt against which lading can be placed.

4. The center beam rail road car of claim 1 wherein said medial decking portion lies between said two trucks and is at least 28'-0" long.

5. The center beam rail road car of claim 1 wherein said medial decking portion lies between said two trucks and is at least 40'-0" long.

6. The center beam rail road car of claim 1 wherein said upper beam assembly extends to a height exceeding AAR Plate C.

7. The center beam car of claim 1 wherein said end decking portions and said medial decking portion each have a load bearing interface, and the load bearing interface of said end decking portions is stepped upwardly relative to the load bearing interface of said medial decking portion a distance of at least 30 inches.

8. The center beam rail road car of claim 1 wherein:

said end decking portions include lading support structure mounted thereon defining an end section lading interface; and said end section lading interface lies at a height greater than 42 inches above Top of Rail.

9. The center beam rail road car of claim 1 wherein said medial decking portion has a pair of medial decking side sill mounted therealong, each of said side sills having a web, said web having an upper edge and a lower edge, said upper edge lying further transversely outboard than said lower edge.

10. The center beam rail road car of claim 9 wherein said medial decking portion has at least one lading securement apparatus mounted to said medial portion side sill web.

11. The center beam rail road car of claim 1, wherein:

said car has a pair of side sills extending along said deck structure;

said side sills each have a side sill medial portion mounted to said medial decking portion, said medial side sill portion having a first depth of section;

said side sills each have side sill end portions mounted to said end decking portions, said end side sill portions having a second depth of section;

each of said side sills has a knee joining each said side sill medial portion to respective adjacent side sill end portions;

each said knee has a longitudinally inboard flange, a longitudinally outboard flange, and webbing extending therebetween;

said longitudinally outboard flange has a lower extremity and an upper extremity; and said lower extremity lies at a longitudinally inboard station relative to said upper extremity.

12. The center beam rail road car of claim 1, wherein:

said rail road car has a first height, said first height being a load limit height measured upwardly from said medial decking portion;

said rail road car has a second height measured upwardly from said medial decking portion, said second height being a nominal load height, said second height being the largest integer multiple of 33 inches that is less than said first height; and said web assembly has at least one skirt member against which loads placed laterally outward thereof can bear, said skirt member extending between a third height and a fourth height, said third and fourth heights straddling said second height.

13. The center beam rail road car of claim 12 wherein said third height is at least as great as said first height, and said fourth height is at least 6 inches below said second height.

14. The center beam rail road car of claim 1 wherein:

said rail road car has a first height, said first height being a load limit height measured upwardly from said medial decking portion;

said rail road car has a second height measured upwardly from said medial decking portion, said second height being a nominal load height, said second height being the largest integer multiple of 33 inches that is less than said first height;

said upper beam assembly has a lengthwise extending, laterally outwardly facing member against which lading can seat; and said outwardly facing member extends between a third height and a fourth height, said third and fourth heights straddling said second height.

15. The center beam rail road car of claim 14 wherein said third height is at least as great as said first height, and said fourth height is at least 6 inches below said second height.

16. The center beam rail road car of claim 1 wherein:

said car has a center sill;

said medial decking portion includes a plurality of cross-bearers extending between medial decking side sills; and a load securing device is mounted outboard of said web assembly at a longitudinal station corresponding to the junction of one of said cross-bearers with one of said medial decking side sills.

17. A center beam rail road car comprising:

a center beam car body mounted on a pair of first and second spaced apart rail car trucks, said body having a deck structure, a central upstanding web assembly running along said car, said web assembly extending upwardly of said deck structure, and an upper beam assembly surmounting said vertical web assembly;

said deck structure including first and second end decking portions mounted over said respective first and second trucks, and a medial decking portion lying between said trucks, said first and second end decking portions being stepped upwardly relative to said medial decking portion;

said center beam car body being selected from the group consisting of (a) a center beam car body in which said central upstanding web assembly includes an array of upwardly extending posts, said posts having a lower region adjacent said deck structure and an upper region adjacent said upper beam assembly; and a skirt member extending longitudinally between said upper regions of said posts, said skirt member having a laterally outwardly oriented face against which lading can seat, said face of said skirt member lying in a position chosen from the set of positions consisting of (i) a position flush with said posts and (ii) a position proud of said posts; said array of posts being free of any member obstructing said face, and (b) a center beam car body in which said central upstanding web assembly includes an array of upwardly extending posts, said posts having a lower region adjacent said deck structure, and an upper region adjacent said upper beam assembly, and said upper beam assembly has a lengthwise extending, laterally outwardly facing member against which lading can seat, said laterally outwardly facing member being mounted in a position that is chosen from the set of positions consisting of (i) flush with said posts; and (ii) proud of said posts; said array of posts being free of any member obstructing said outwardly facing member, wherein:

said rail road car has a pair of side sills extending along said deck structure;

said side sills each have a medial side sill portion mounted to said medial decking portion, said medial side sill portion having a first depth of section;

said side sills each have end side sill portions mounted to said end decking portions, said end side sill portions having a second depth of section; and said first depth of section is less than said second depth of section.

18. A center beam rail road car comprising:

a center beam car body mounted on a pair of first and second spaced apart rail car trucks, said body having a deck structure, a central upstanding web assembly running along said car, said web assembly extending upwardly of said deck structure, and an upper beam assembly surmounting said vertical web assembly;

said deck structure including first and second end decking portions mounted over said respective first and second trucks, and a medial decking portion lying between said trucks, said first and second end decking portions being stepped upwardly relative to said medial decking portion;

said center beam car body being selected from the group consisting of (a) a center beam car body in which said central upstanding web assembly includes an array of upwardly extending posts, said posts having a lower region adjacent said deck structure and an upper region adjacent said upper beam assembly; and a skirt member extending longitudinally between said upper regions of said posts, said skirt member having a laterally outwardly oriented face against which lading can seat, said face of said skirt member lying in a position chosen from the set of positions consisting of (i) a position flush with said posts and (ii) a position proud of said posts; said array of posts being free of any member obstructing said face, and (b) a center beam car body in which said central upstanding web assembly includes an array of upwardly extending posts, said posts having a lower region adjacent said deck structure, and an upper region adjacent said upper beam assembly, and said upper beam assembly has a lengthwise extending, laterally outwardly facing member against which lading can seat, said laterally outwardly facing member being mounted in a position that is chosen from the set of positions consisting of (i) flush with said posts; and (ii) proud of said posts; said array of posts being free of any member obstructing said outwardly facing member, wherein said rail road car has a first height, said first height being a load limit height measured upwardly from said medial decking portion;

said rail road car has a second height measured upwardly from said medial decking portion, said second height being a nominal load height, said second height being the largest integer multiple of 33 inches that is less than said first height;

said web assembly has at least one skirt member against which loads placed laterally outward thereof can bear, said skirt member extending between a third height and a fourth height, said third and fourth heights straddling said second height, at least one of said end decking portions has an end decking side sill, said end decking side sill has a web, said end decking side sill web has an upper edge and a lower edge, said upper edge of said end decking side sill web lying further transversely outboard than said lower edge thereof.

19. The center beam rail road car of claim 18 wherein said web of said medial decking side sill portion is inclined at a first angle relative to the vertical, and said end decking side sill web is inclined at a second angle relative to the vertical, said first angle being greater than said second angle.

* * * * *